US010642182B2

(12) United States Patent
Momoka et al.

(10) Patent No.: US 10,642,182 B2
(45) Date of Patent: May 5, 2020

(54) IMAGE FORMING APPARATUS HAVING OPTICAL PRINT HEAD

(71) Applicant: CANON KABUSHIKI KAISHA, Tokyo (JP)

(72) Inventors: Toshiki Momoka, Tokyo (JP); Hitoshi Iwai, Abiko (JP); Shinichiro Hosoi, Tokyo (JP); Takehiro Ishidate, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/001,562

(22) Filed: Jun. 6, 2018

(65) Prior Publication Data

US 2018/0364613 A1 Dec. 20, 2018

(30) Foreign Application Priority Data

Jun. 16, 2017 (JP) ..... 2017-118999

(51) Int. Cl.
*G03G 15/04* (2006.01)
*G03G 21/16* (2006.01)

(52) U.S. Cl.
CPC ... *G03G 15/04036* (2013.01); *G03G 21/1647* (2013.01); *G03G 21/1666* (2013.01); *G03G 2221/1654* (2013.01)

(58) Field of Classification Search
CPC ..... G03G 21/1666; G03G 15/04036; G03G 15/04054
See application file for complete search history.

(56) References Cited

U.S. PATENT DOCUMENTS

| | | | |
|---|---|---|---|
| 5,978,626 | A | 11/1999 | Nagamine et al. |
| 7,248,812 | B2 | 7/2007 | Tombs |
| 7,679,798 | B2 | 3/2010 | Sowa |
| 8,112,012 | B2 | 2/2012 | Wong et al. |
| 8,269,812 | B2 | 9/2012 | Morimoto et al. |
| 8,305,419 | B2 | 11/2012 | Morita |
| 8,725,028 | B2 | 5/2014 | Imai |
| 2007/0024943 | A1 | 2/2007 | Namba |
| 2007/0126852 | A1 | 6/2007 | Fukutome |
| 2010/0245525 | A1 | 9/2010 | Morimoto et al. |
| 2010/0271639 | A1 | 10/2010 | Iijima |
| 2011/0050834 | A1 | 3/2011 | Umezawa |
| 2012/0177418 | A1 | 7/2012 | Hashiyada et al. |
| 2012/0207511 | A1 | 8/2012 | Sato |
| 2013/0164027 | A1 | 6/2013 | Sato et al. |

(Continued)

FOREIGN PATENT DOCUMENTS

| | | | |
|---|---|---|---|
| JP | 2006258909 | A | 9/2006 |
| JP | 2007072321 | A | 3/2007 |

(Continued)

*Primary Examiner* — David M. Gray
*Assistant Examiner* — Andrew V Do
(74) *Attorney, Agent, or Firm* — Canon U.S.A., Inc. IP Division

(57) ABSTRACT

A resin holding member is supported by a one link member and another link member at positions further outside from both ends of a lens array and both ends of a circuit board in a rotational axis direction of a photosensitive drum, but further inside from an abutting pin and another abutting pin. Force in the opposite direction from the gravitational direction is applied to a portion of the holding member between the link members in a state where the abutting pins are abutting a drum unit. Accordingly, warping of the holding member is suppressed.

11 Claims, 25 Drawing Sheets

(56) References Cited

U.S. PATENT DOCUMENTS

| | | | |
|---|---|---|---|
| 2013/0170855 | A1 | 7/2013 | Mori et al. |
| 2013/0194369 | A1 | 8/2013 | Shimamoto |
| 2014/0212170 | A1 | 7/2014 | Kato et al. |
| 2015/0050043 | A1 | 2/2015 | Sato et al. |
| 2015/0109398 | A1 | 4/2015 | Park et al. |
| 2018/0095405 | A1 | 4/2018 | Iwai et al. |

FOREIGN PATENT DOCUMENTS

| | | | |
|---|---|---|---|
| JP | 2009244542 | A | 10/2009 |
| JP | 2010230954 | A | 10/2010 |
| JP | 2011020414 | A | 2/2011 |
| JP | 2012234200 | A | 11/2012 |
| JP | 2013134370 | A | 7/2013 |
| JP | 2014213541 | A | 11/2014 |
| JP | 2015018132 | A | 1/2015 |

FIG. 5A
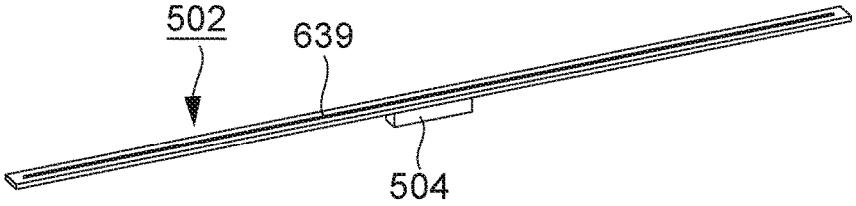
FIG. 5B1
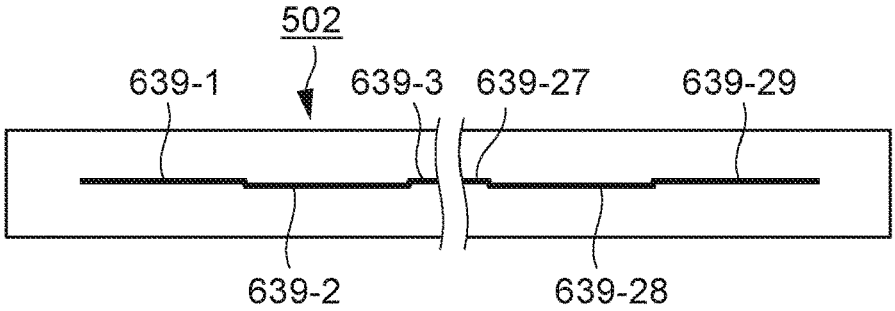
FIG. 5B2
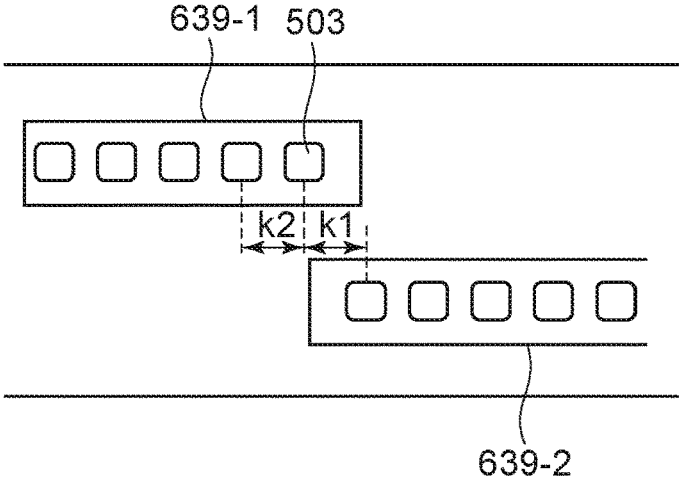
FIG. 5C1
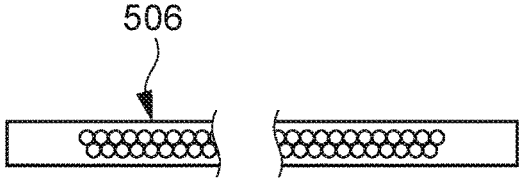
FIG. 5C2
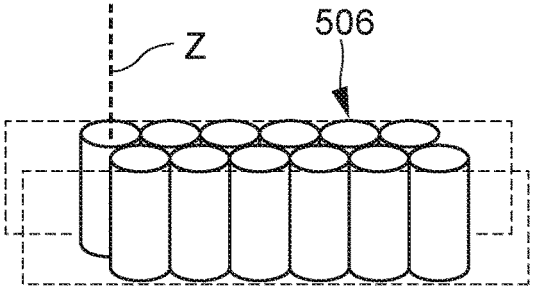

FIG. 7A1
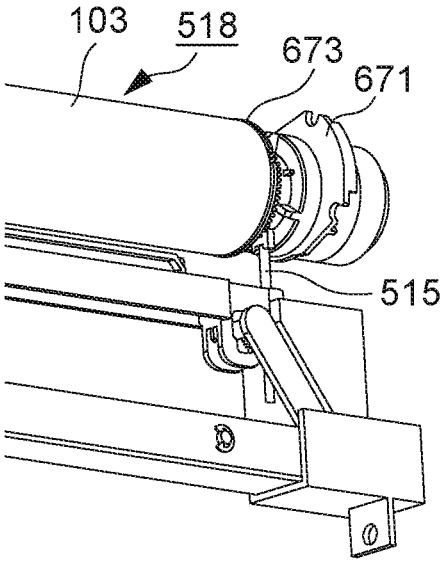
FIG. 7A2
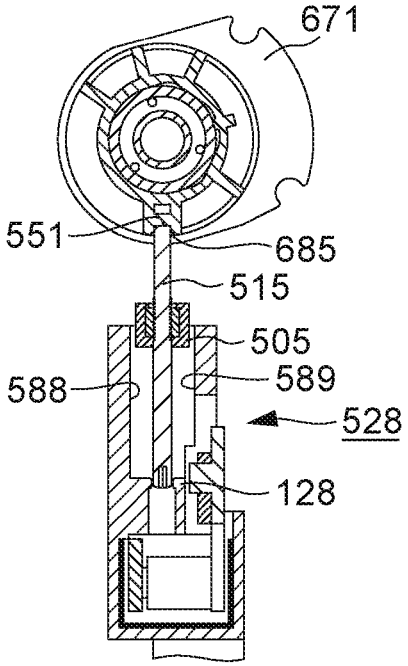
FIG. 7B1
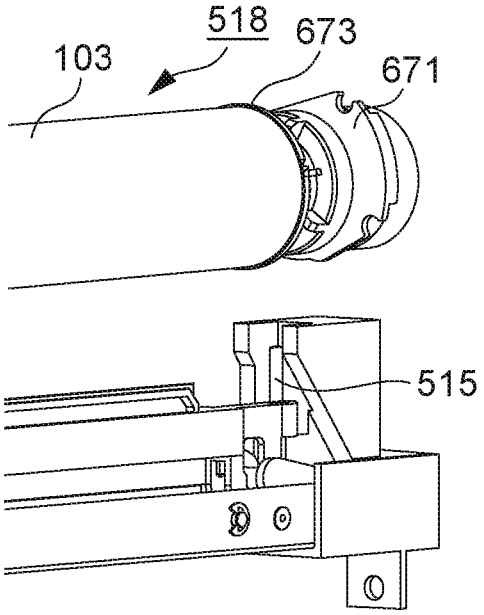
FIG. 7B2
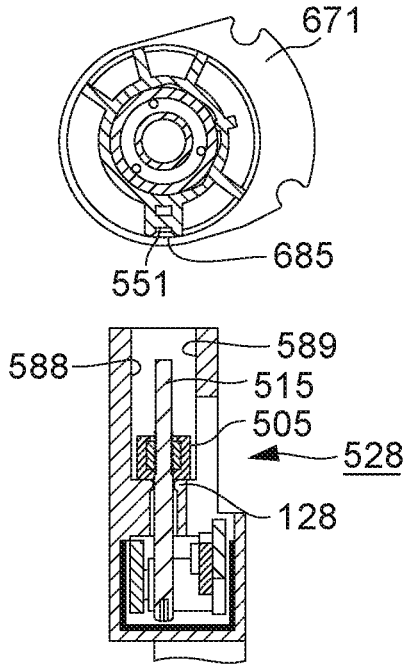

FIG. 15A1
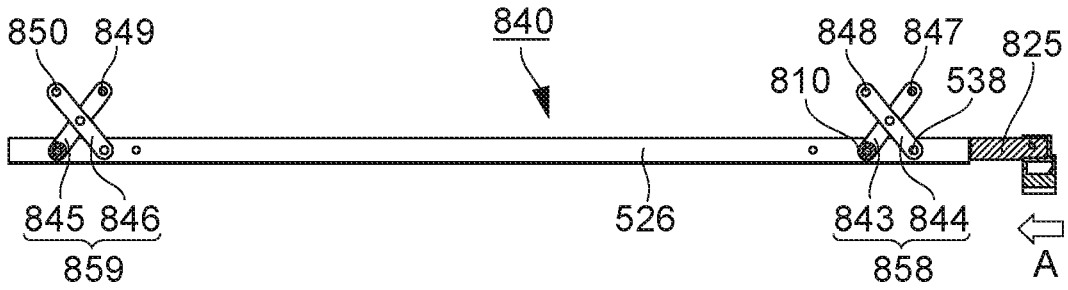
FIG. 15A2
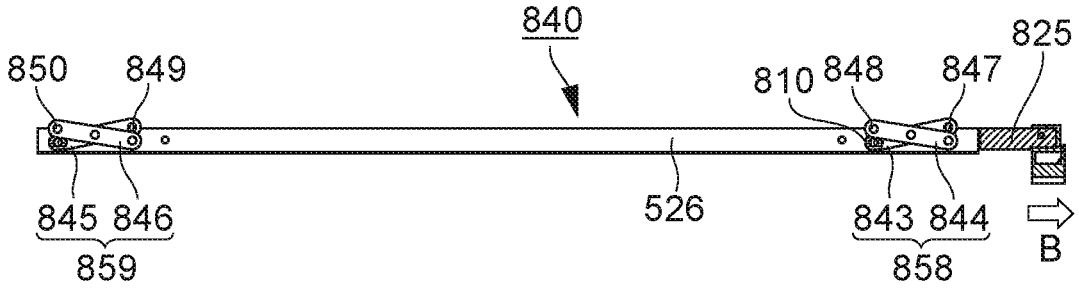
FIG. 15B
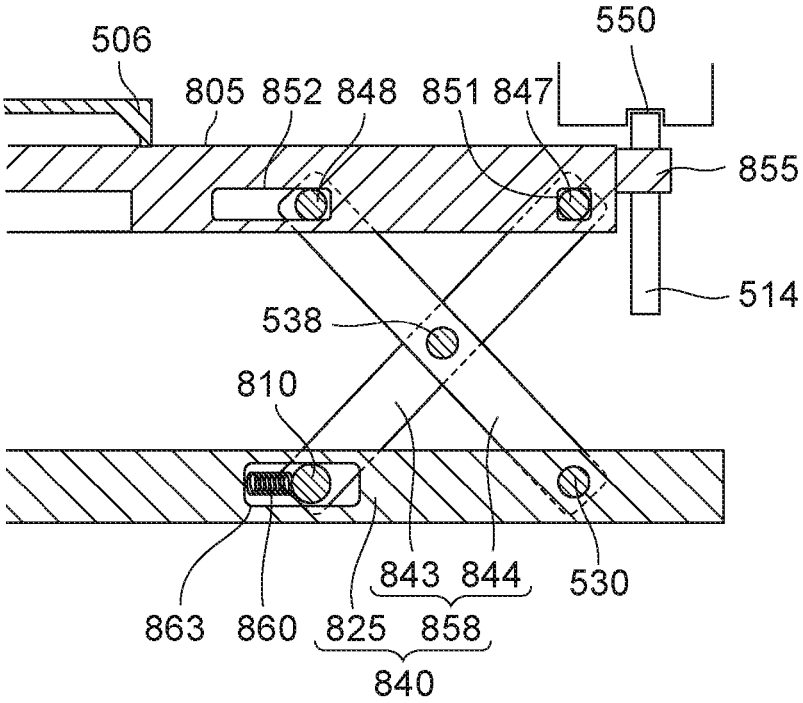

IMAGE FORMING APPARATUS HAVING OPTICAL PRINT HEAD

BACKGROUND OF THE INVENTION

Field of the Invention

The present invention relates to an image forming apparatus having an optical print head that reciprocally moves between an exposure position where the optical print head exposes a photosensitive drum, and a retracted position where the optical print head is retracted from the exposure position to replace a replacement unit including the photosensitive drum.

Description of the Related Art

Image forming apparatuses such as printers, copying machines, and so forth, have an optical print head that has multiple light-emitting elements for exposing a photosensitive drum. Some optical print heads use light-emitting diodes (LEDs) or organic electroluminescence (EL) devices or the like, which are examples of light-emitting elements. There are known arrangements where multiple such light-emitting elements are arrayed in one row or two staggered rows, for example, in the rotational axis direction of the photosensitive drum. Optical print heads also have multiple lenses for condensing light emitted from the multiple light-emitting elements onto the photosensitive drum. The multiple lenses are disposed facing the surface of the photosensitive drum, having been arrayed in the direction of array of the light-emitting elements, between the multiple light-emitting elements and the photosensitive drum. Light emitted from the multiple light-emitting elements is condensed on the surface of the photosensitive drum through the lenses, and an electrostatic latent image is formed on the photosensitive drum.

The photosensitive drum is a consumable item, and accordingly is periodically replaced. A worker performing the work of replacing a photosensitive drum or the like can perform maintenance of the image forming apparatus by replacing the replacement unit containing the photosensitive drum. The replacement unit has a configuration where it is detachably mountable to a main body of the image forming apparatus, by being extracted from and inserted to the apparatus main body from the side face of the image forming apparatus by sliding movement. The clearance between the lenses and the surface of the photosensitive drum is extremely narrow at an exposure position of the optical print head for when exposing the photosensitive drum (a position near to and facing the surface of the drum). Accordingly, the optical print head needs to be retracted from the exposure position when replacing the replacement unit, lest the optical print head and photosensitive drum or the like come into contact and the surface of the photosensitive drum and the lenses be damaged. Accordingly, a configuration is made in the image forming apparatus where the optical print head is reciprocally moved between the exposure position and a retracted position where the optical print head is further distanced from the replacement unit than the exposure position, in order to mount/detach the replacement unit. The following is an example of a configuration where an optical print head moves between an exposure position and a separated position.

An image forming apparatus using an optical print head disclosed in Japanese Patent Laid-Open No. 2014-213541 has an LED print head, and an advancing/retreating mechanism that reciprocally moves the LED print head between the exposure position and retracted position. The LED print head has an LED circuit board where an LED array, a signal generating circuit that drives the LED array, and so forth, are mounted. The LED print head also has a housing that holds the LED circuit board, and a rod lens array that focuses light from the LED array on the surface of a photosensitive drum. The housing has a first front positioning pin at the front side and a first rear positioning pin to the rear side, and these pins are protruding in both directions in a Z direction. A supporting portion supports an end portion of pins protruding in a direction opposite to the side of the housing where the replacement unit is situated.

The advancing/retreating mechanism has a lever, a link mechanism, and the supporting portion. When the lever is turned from an erect position in a direction of arrow C (FIG. 7 of Japanese Patent Laid-Open No. 2014-213541), the supporting portion moves in a direction of drawing near to the photosensitive drum via the link mechanism. That is to say, when the lever is turned from the erect position in the direction of arrow C, the supporting portion pushes the pins that the housing has upwards, and the LED print head moves from the retracted position toward the exposure position. These pins abutting predetermined positions (front ball bearing and rear ball bearing) of a photosensitive module PM forms a gap between the photosensitive drum and the LED print head, and the LED print head is positioned at the exposure position. However, the mechanism shown in Japanese Patent Laid-Open No. 2014-213541, that is supported by two pins (the first front positioning pin and first rear positioning pin) where the housing (holding member) is pushed upward by the supporting portion may have the following problems.

The possibility that the housing will exhibit deflecting with regard to the rotational axis direction of the photosensitive drum, due to its own weight between the two pins, is unignorable in the above-described mechanism. The amount of this deflection of the housing is affected by the material of the housing, with deflection being greater with resin as compared to metal, for example. In a case where deflection occurs in the housing, difference in distance from the LED array at the middle portion in the X direction to the photosensitive drum, and distance from the ends in the X direction to the photosensitive drum, is greater as compared to a case where there is no deflection. Also, in a case where deflection occurs in the housing, difference in distance from the rod lens array at the middle portion in the X direction to the photosensitive drum, and distance from the ends in the X direction to the photosensitive drum, is also greater as compared to a case where there is no deflection. An arrangement can be conceived where a mechanism for supporting the housing is further provided between the two pins, but there is a possibility that application of force to the portion of the frame of the housing holding the LED array and rod lens array will cause the LED array or rod lens array to warp. Difference in the distance of the LED array and rod lens array that the LED print head 14 has to the photosensitive drum depending on the position in the rotational axis direction of the photosensitive drum is one factor in causing electrostatic latent images exposed on the photosensitive drum to be unclear.

SUMMARY OF THE INVENTION

An image forming apparatus according to the present invention has a drum unit rotatably supporting a photosensitive drum, where the lower side of the photosensitive drum is exposed by a plurality of lights from a side lower than a rotational axis of the photosensitive drum in the vertical direction. The image forming apparatus includes: a holding member configured to hold a circuit board having a plurality of light-emitting elements configured to emit light to expose the photosensitive drum, and a lens configured to collect the light on the surface of the photosensitive drum, and configured to reciprocally move between an exposure position where the light-emitting elements expose the photosensitive drum, and a retracted position further retracted from the drum unit than the exposure position; a first moving member configured to support one end side in the longitudinal direction of the holding member in a direction opposite to the gravitational direction, at a side further downstream from the lens and the circuit board in a direction from an other end of the holding member in the longitudinal direction of the holding member toward the one end of the holding member in the longitudinal direction, and to cause the one end side to move in the direction of reciprocal movement by moving in the direction of reciprocal movement while supporting the holding member; a second moving member configured to support the other end side in the longitudinal direction of the holding member in a direction opposite to the gravitational direction, at a side further downstream from the lens and the circuit board in a direction from one end of the holding member in the longitudinal direction toward the other end of the holding member in the longitudinal direction, and to cause the other end side to move in the direction of reciprocal movement by moving in the direction of reciprocal movement while supporting the holding member; a first abutting portion that is provided to the holding member at a side further downstream from the first moving member in a direction from the other end of the holding member in the longitudinal direction toward the one end of the holding member in the longitudinal direction, and that is configured to protrude from the holding member further toward the drum unit side than a light emission face of the lens and abut one end side of the drum unit in the longitudinal direction; and a second abutting portion that is provided to the holding member at a side further downstream from the second moving member in a direction from the one end of the holding member in the longitudinal direction toward the other end of the holding member in the longitudinal direction, and that is configured to protrude from the holding member further toward the drum unit side than a light emission face of the lens and abut another end side of the drum unit in the longitudinal direction. Force in the direction opposite to the gravitational direction is applied to a portion between the first moving member and the second moving member, regarding the holding member that has been moved from the retracted position toward the exposure position by the first moving member and the second moving member, with the first abutting portion and second abutting portion abutting the drum unit.

An image forming apparatus according to the present invention has a drum unit rotatably supporting a photosensitive drum, where the lower side of the photosensitive drum is exposed by a plurality of lights from a side lower than a rotational axis of the photosensitive drum in the vertical direction. The image forming apparatus includes: a holding member configured to hold a circuit board having a plurality of light-emitting elements configured to emit light to expose the photosensitive drum, and a lens configured to collect the light on the surface of the photosensitive drum, and configured to reciprocally move between an exposure position where the light-emitting elements expose the photosensitive drum, and a retracted position further retracted from the drum unit than the exposure position; a sliding portion configured to move by sliding in the longitudinal direction of the holding member; a first spring that is provided to the holding member at a side further downstream from the lens and the circuit board in a direction from an other end of the holding member in the longitudinal direction toward the one end of the holding member in the longitudinal direction, and is configured to impart biasing force to the holding member to bias the holding member in a direction opposite to the gravitational direction; a second spring that is provided to the holding member at a side further downstream from the lens and the circuit board in a direction from the other end of the holding member in the longitudinal direction toward the one end of the holding member in the longitudinal direction, and is configured to impart biasing force to the holding member to bias the holding member in the direction opposite to the gravitational direction; a first link portion of which one end side is in contact with the first spring and the other end side is pivotably connected to one end side of the sliding portion in the longitudinal direction, and that is configured to pivot in conjunction with sliding movement of the sliding portion and to deform the first spring in conjunction with the pivoting; a second link portion of which one end side is in contact with the second spring and the other end side is pivotably connected to the other end side of the sliding portion in the longitudinal direction, and that is configured to pivot in conjunction with sliding movement of the sliding portion and to deform the second spring in conjunction with the pivoting; a first abutting portion that is provided to the holding member at a side further downstream from the first link portion in a direction from the other end of the holding member in the longitudinal direction toward the one end of the holding member in the longitudinal direction, and that is configured to protrude from the holding member further toward the drum unit side than a light emission face of the lens and abut one end side of the drum unit in the longitudinal direction; and a second abutting portion that is provided to the holding member at a side further downstream from the second link portion in a direction from the one end of the holding member in the longitudinal direction toward the other end of the holding member in the longitudinal direction, and that is configured to protrude from the holding member further toward the drum unit side than a light emission face of the lens and abut another end side of the drum unit in the longitudinal direction. Force in the direction opposite to the gravitational direction is applied to a portion between the first spring and the second spring, regarding the holding member that has been moved from the retracted position toward the exposure position in conjunction with the first moving member and the second moving member pivoting, with the first abutting portion and second abutting portion abutting the drum unit.

Further features of the present invention will become apparent from the following description of exemplary embodiments with reference to the attached drawings.

BRIEF DESCRIPTION OF THE DRAWINGS

FIGS. 5A through 5C2 are schematic diagrams for describing a circuit board, LED chips, and lens array of an optical print head.

FIGS. 7A1 through 7B2 are diagrams illustrating a state where an optical print head is in contact with a drum unit, and a retracted state.

FIGS. 15A1 through 15B are diagrams for describing an X-type movement mechanism.

DESCRIPTION OF THE EMBODIMENTS

Embodiment

Image Forming Apparatus

Figure 1:
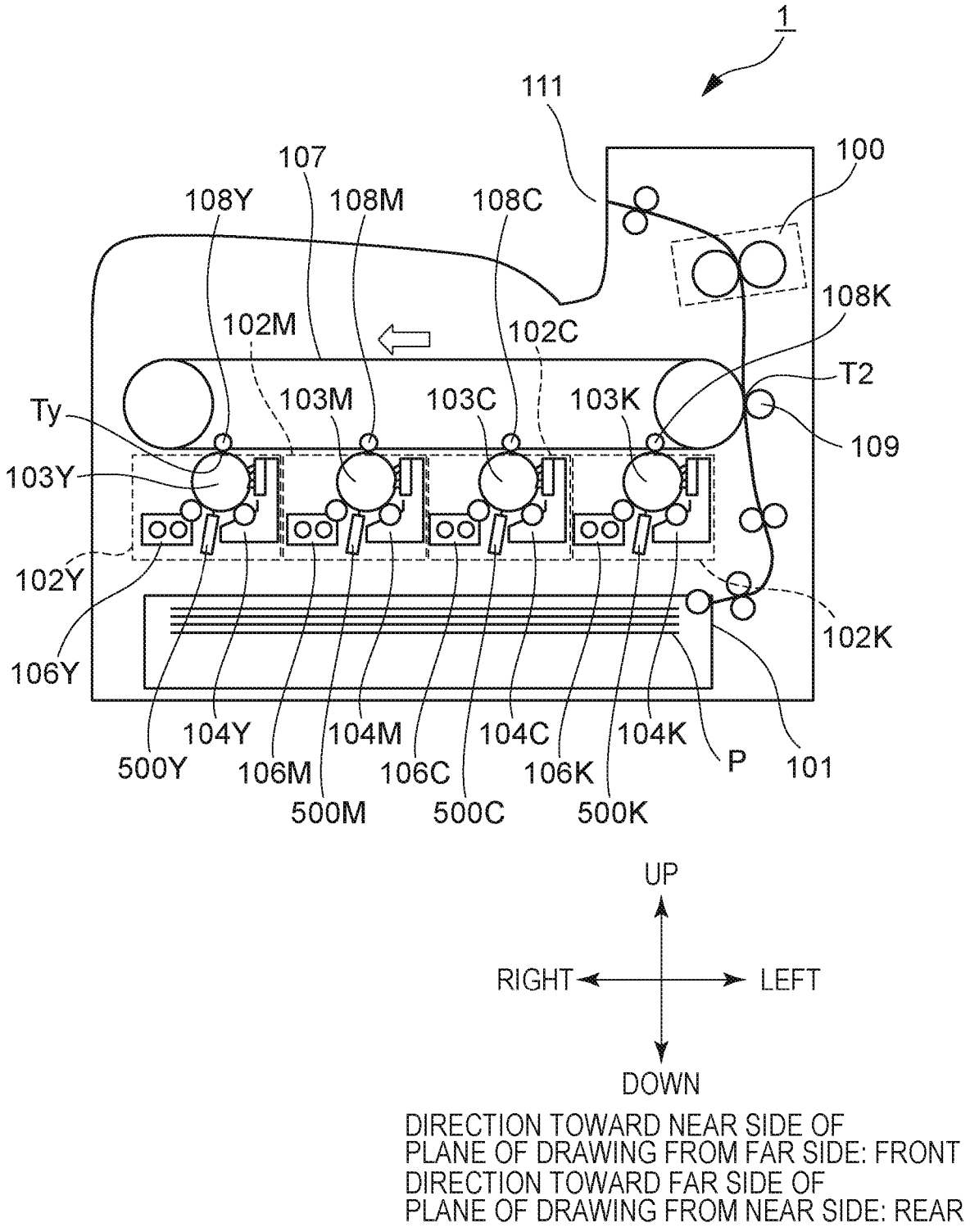
FIG. 1 is a schematic cross-sectional diagram of an image forming apparatus.

First, a schematic configuration of an image forming apparatus 1 will be described. FIG. 1 is a schematic cross-sectional view of the image forming apparatus 1. Although the image forming apparatus 1 illustrated in FIG. 1 is a color printer that does not have a reader, an embodiment may be a copying machine that has a reader. Also, an embodiment is not restricted to a color image forming apparatus having multiple photosensitive drums 103 as illustrated in FIG. 1, and may be a color image forming apparatus having one photosensitive drum 103 or an image forming apparatus that forms monochromatic images.

The image forming apparatus 1 illustrated in FIG. 1 has four image forming units 102Y, 102M, 102C, and 102K (hereinafter also collectively referred to simply as "image forming unit 102") that form toner images of the yellow, magenta, cyan, and black colors. The image forming units 102Y, 102M, 102C, and 102K respectively have a photosensitive drum 103Y, 103M, 103C, and 103K (hereinafter also collectively referred to simply as "photosensitive drum 103"). The image forming units 102Y, 102M, 102C, and 102K also respectively have a charger 104Y, 104M, 104C, and 104K (hereinafter also collectively referred to simply as "charger 104") for charging the photosensitive drums 103Y, 103M, 103C, and 103K. The image forming units 102Y, 102M, 102C, and 102K further respectively have a light-emitting diode (LED) exposing unit 500Y, 500M, 500C, and 500K (hereinafter also collectively referred to simply as "LED exposing unit 500") serving as an exposure light source that emits light to expose the photosensitive drums 103Y, 103M, 103C, and 103K. Moreover, the image forming units 102Y, 102M, 102C, and 102K respectively have a developing unit 106Y, 106M, 106C, and 106K (hereinafter also collectively referred to simply as "developing unit 106") that develops electrostatic latent images on the photosensitive drum 103 by toner, thereby developing toner images of the respective colors on the photosensitive drums 103. The Y, M, C, and K appended to the reference numerals indicate the color of the toner.

The image forming apparatus 1 is provided with an intermediate transfer belt 107 onto which toner images formed on the photosensitive drums 103 are transferred, and primary transfer roller 108 (Y, M, C, K) that sequentially transfer the toner images formed on the photosensitive drums 103 of the image forming units 102 onto the intermediate transfer belt 107. The image forming apparatus 1 further is provided with a secondary transfer roller 109 that transfers the toner image on the intermediate transfer belt 107 onto a recording sheet P conveyed from a sheet feed unit 101, and a fixing unit 100 that fixes the secondary-transferred image onto the recording sheet P.

Drum Unit

Figure 2A:
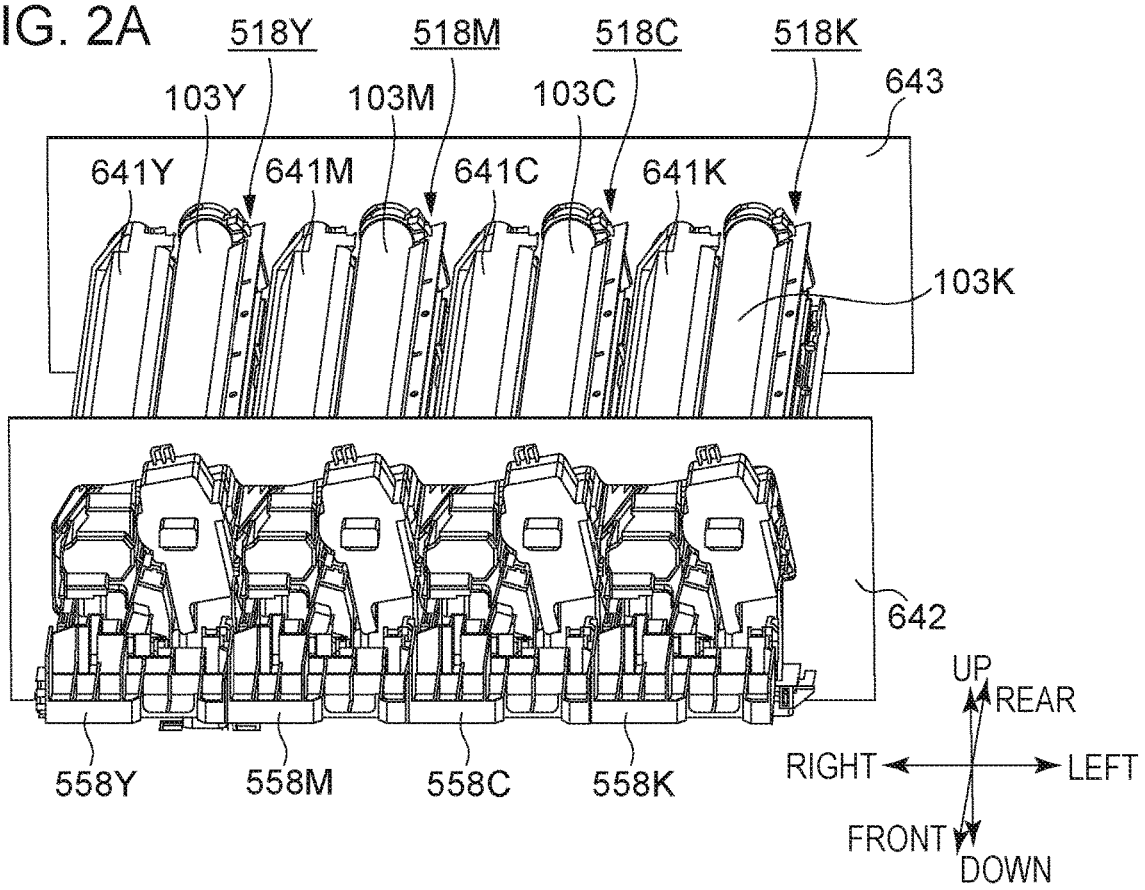
FIGS. 2A and 2B are perspective views of around drum units in the image forming apparatus.
Figure 2B:
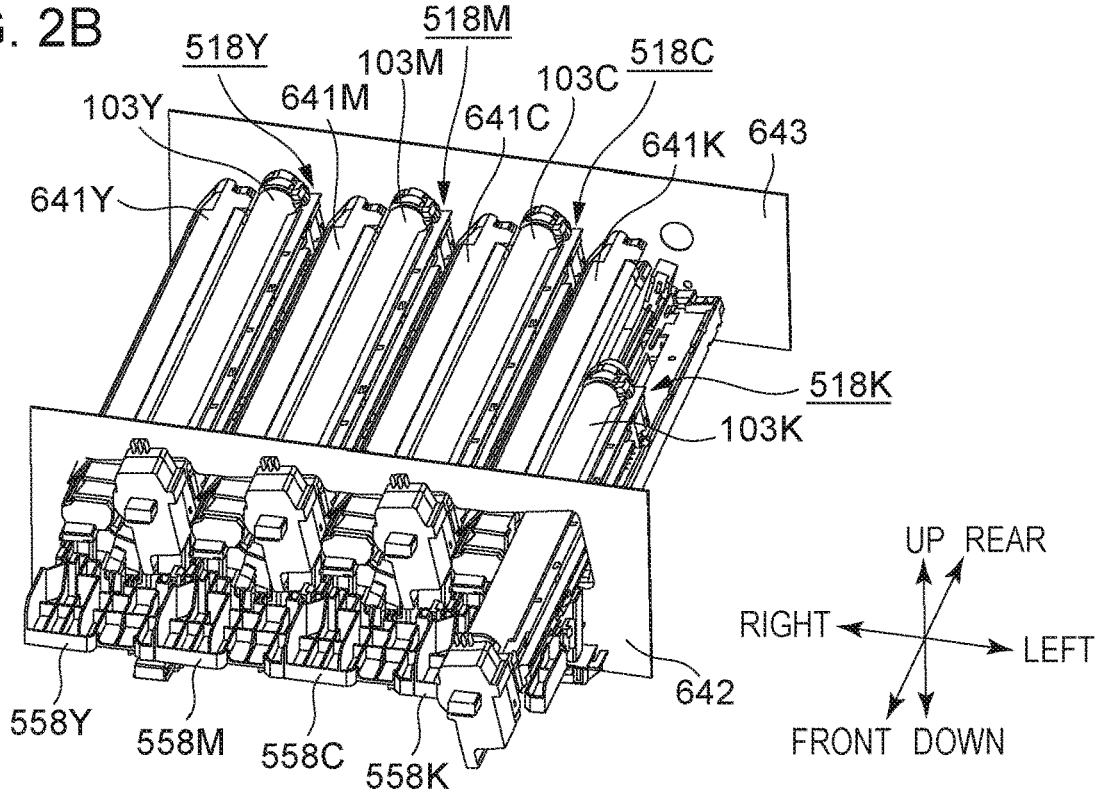

Next, drum units 518 (Y, M, C, K), and developing units 641 (Y, M, C, K), which are replacement units detachably mounted to the image forming apparatus 1 according to the present embodiment, will be described. FIG. 2A is a schematic perspective view around the drum units 518 and developing units 641 that the image forming apparatus 1 has. FIG. 2B is a diagram illustrating a drum unit 518 in a state partially inserted into the image forming apparatus 1 from the outer side of the apparatus main body.

The image forming apparatus 1 has a front-side plate 642 and a rear-side plate 643 that are formed from sheet metal, as illustrated in FIG. 2A. The front-side plate 642 is a side wall provided to the front side of the image forming apparatus 1. The rear-side plate 643 is a side wall provided to the rear side of the image forming apparatus 1. The front-side plate 642 and rear-side plate 643 are disposed facing each other as illustrated in FIG. 2A, with sheet metal serving as beams that are omitted from illustration crossing therebetween. The front-side plate 642, rear-side plate 643, and unshown beams make up part of a frame of the image forming apparatus 1.

Openings are formed on the front-side plate 642, through which the drum units 518 and developing units 641 can be inserted and extracted from the front side of the image forming apparatus 1. The drum units 518 and developing units 641 are mounted through openings to predetermined positions in the main body of the image forming apparatus 1 (mounting positions). The image forming apparatus 1 also has covers 558 (Y, M, C, K) as an example of pivoting members that cover the front side of the drum units 518 and developing units 641 mounted to the mounting positions. The covers 558 have one end thereof fixed integrally to the main body of the image forming apparatus 1 by a hinge, and are capable of pivoting as to the main body of the image forming apparatus 1 on the hinge. Unit replacement work is completed by a worker who performs maintenance opening a cover 558 and extracting a drum unit 518 or developing unit 641 within the main body, inserting a new drum unit 518 or developing unit 641, and closing the cover 558. The covers 558 will be described in detail later.

In the following description, the front-side plate 642 side of the image forming apparatus 1 is defined as the front side, and the rear-side plate 643 side as the rear side, as illustrated in FIGS. 2A and 2B. The side where the photosensitive drum 103Y that forms electrostatic latent images relating to yellow toner images is disposed is defined as the right side, with the photosensitive drum 103K that forms electrostatic latent images relating to black toner images as a reference. The side where the photosensitive drum 103K that forms electrostatic latent images relating to black toner images is disposed is defined as the left side, with the photosensitive drum 103Y that forms electrostatic latent images relating to yellow toner images as a reference. Further, a direction that is perpendicular to the front-and-rear directions and left-and-right directions defined here, and is upward in the vertical direction is defined as the upward direction, and a direction that is perpendicular to the front-and-rear directions and left-and-right directions defined here, and is downward in the vertical direction is defined as the downward direction. The defined front direction, rear direction, right direction, left direction, upward direction, and downward direction, are illustrated in FIGS. 2A and 2B. The term "one end side of the photosensitive drum 103 in the rotational axis direction" as used in the present specification means the front side as defined here, and "other end side" means the rear side as defined here. The one end side and other end side in the front-and-rear direction here also correspond to the front side and rear side defined here. The one side in the left-and-right direction means the right side as defined here, and the other end side means the left side as defined here.

Drum units 518 are attached to the image forming apparatus 1 according to the present embodiment. The drum units 518 are cartridges that are replaced. The drum units 518 according to the present embodiment have photosensitive drums 103 rotatably supported as to the casing of the drum units 518. The drum units 518 each have a photosensitive drum 103, charger 104, and cleaning device that is omitted from illustration. When the lifespan of a photosensitive drum 103 is expended due to wear by cleaning by the cleaning device for example, a worker who performs maintenance extracts the drum unit 518 from the apparatus main body, and replaces the photosensitive drum 103, as illustrated in FIG. 2B. Note that a configuration may be made where the drum unit 518 includes neither the charger 104 nor cleaning device, and only includes the photosensitive drum 103.

The developing units 641, which are separate from the drum units 518, are attached to the image forming apparatus 1 according to the present embodiment. The developing units 641 include the developing units 106 illustrated in FIG. 1. Each developing unit 106 is provided with a developing sleeve serving as a developing agent bearing member that bears a developing agent. Each developing unit 641 is provided with multiple gears for rotating a screw that agitates the toner and a carrier. When these gears deteriorate due to age or the like, a worker performing maintenance extracts the developing unit 641 from the apparatus main body of the image forming apparatus 1 and replaces it. The developing unit 641 according to the present embodiment is a cartridge where a developing unit 106 having a developing sleeve, and a toner container in which a screw is provided, have been integrated. An embodiment of the drum unit 518 and developing unit 641 may be a process cartridge where the drum unit 518 and developing unit 641 are integrated.

Image Forming Process

Next, an image forming process will be described. A later-described optical print head 105Y exposes the surface of the photosensitive drum 103Y that has been charged by the charger 104Y. Accordingly, an electrostatic latent image is formed on the photosensitive drum 103Y. Next, the developing unit 106Y develops the electrostatic latent image formed on the photosensitive drum 103Y by yellow toner. The yellow toner image developed on the surface of the photosensitive drum 103Y is transferred onto the intermediate transfer belt 107 by the primary transfer roller 108Y at a primary transfer position Ty. Magenta, cyan, and black toner images are also transferred onto the intermediate transfer belt 107 by the same image forming process.

The toner images of each color transferred onto the intermediate transfer belt 107 are conveyed to a secondary transfer position T2 by the intermediate transfer belt 107. Transfer bias for transferring the toner images onto a recording sheet P is applied to the secondary transfer roller 109 disposed at the secondary transfer position T2. The toner images conveyed to the secondary transfer position T2 are transferred onto a recording sheet P conveyed from the sheet feed unit 101 by the transfer bias of the secondary transfer roller 109. The recording sheet P onto which the toner images have been transferred is conveyed to the fixing unit 100. The fixing unit 100 fixes the toner images onto the recording sheet P by heat and pressure. The recording sheet P subjected to fixing processing by the fixing unit 100 is discharged to a sheet discharge unit 111.

Exposing Unit

Figure 3A:
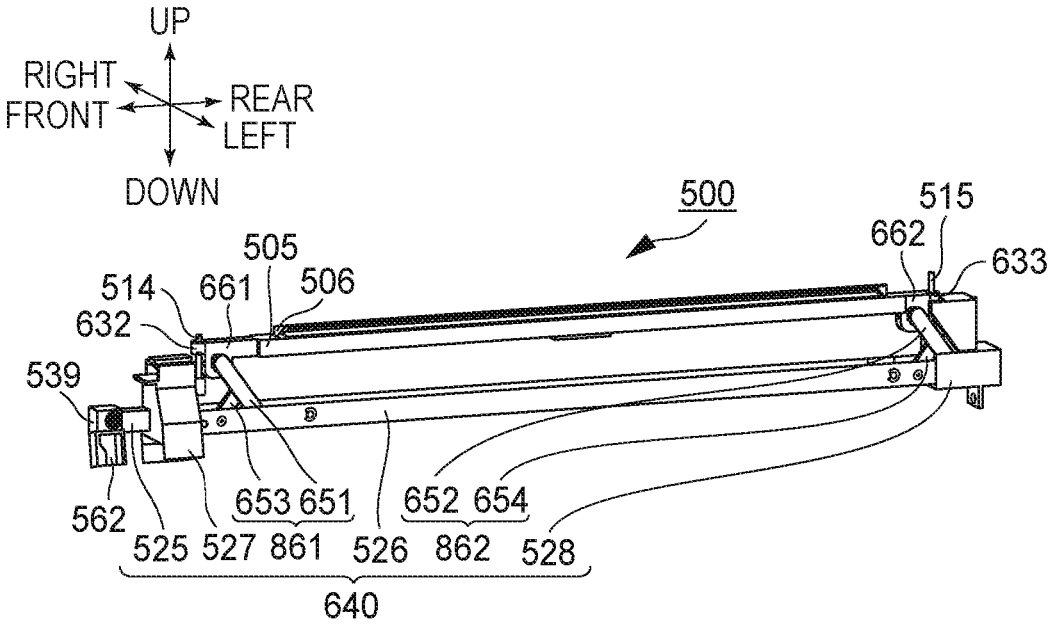
FIGS. 3A and 3B are schematic perspective views of an exposing unit.
Figure 3B:
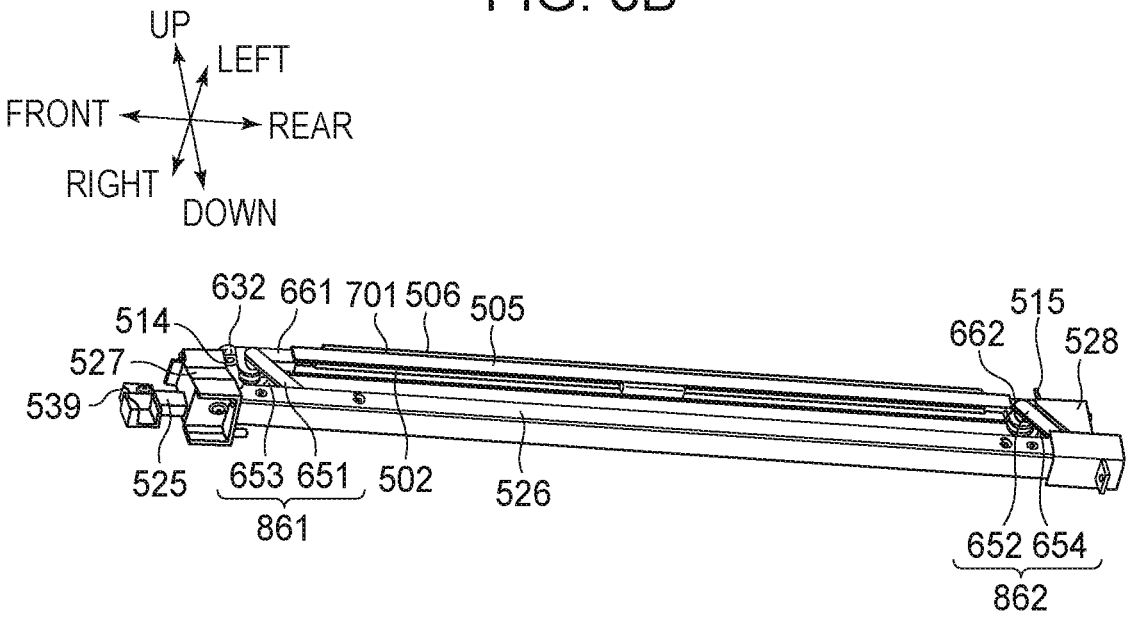
Figure 4:
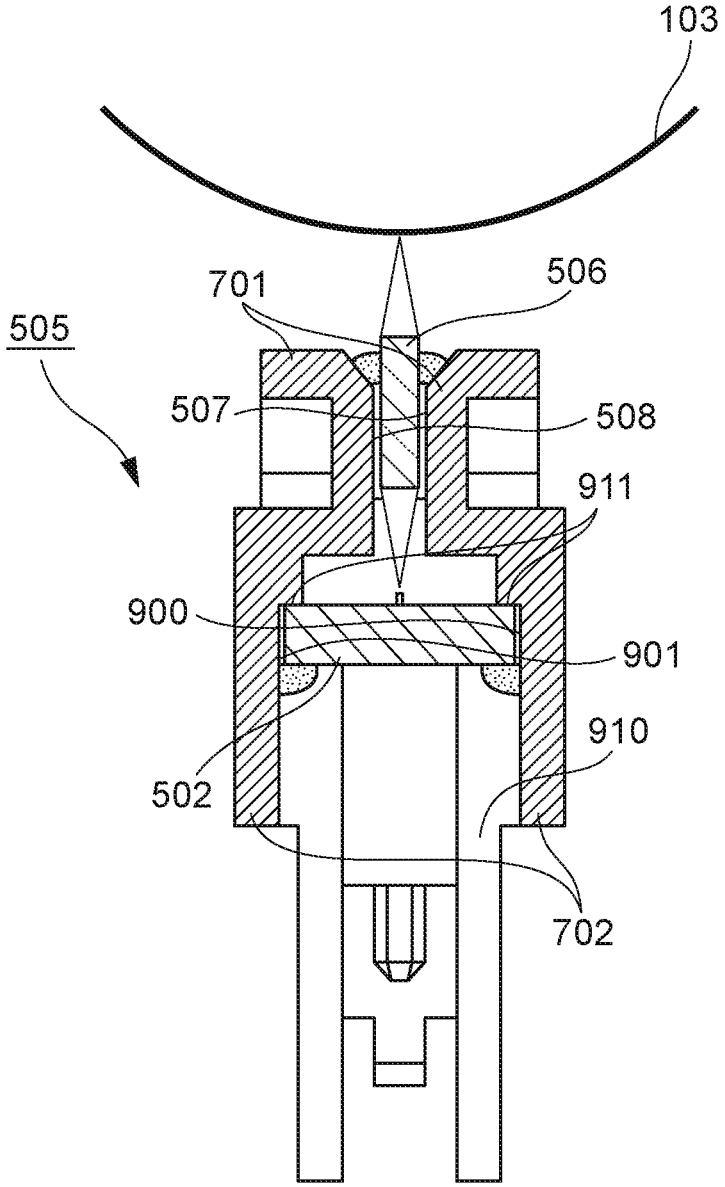
FIG. 4 is a cross-sectional view of an optical print head, taken along a direction perpendicular to a rotational axis of a photosensitive drum.

The exposing unit 500 including the optical print head 105 will be described next. Laser beam scanning exposure, where an emitted semiconductor laser beam is scanned using a rotating polygon mirror or the like and the photosensitive drum is exposed via an F-theta lens or the like is known as one example of an exposing method employed in electrophotographic image forming apparatuses. The "optical print head 105" described in the present embodiment is used in LED exposure where light-emitting elements such as LEDs or the like arrayed following the rotational axis direction of the photosensitive drum 103 are used to expose the photosensitive drum 103, but is not used in the above-described laser beam scanning exposure. FIG. 3A is a schematic perspective view of the exposing unit 500 that the image forming apparatus 1 according to the present embodiment has. FIG. 3B is a diagram viewing the exposing unit 500 illustrated in FIG. 3A from below. FIG. 4 is a schematic cross-sectional diagram where the exposing unit 500 illustrated in FIGS. 3A and 3B, and the photosensitive drum 103 disposed to the upper side of the exposing unit 500, have been cut away on a plane perpendicular to the rotational axis direction of the photosensitive drum 103. The exposing unit 500 has the optical print head 105 and a movement mechanism 640. The optical print head 105 is provided with a lens array 506 serving as lenses, a circuit board 502, a holding member 505 that holds the lens array 506, an abutting pin 514 (also referred to as "first abutting portion"), and an abutting pin 515 (also referred to as "second abutting portion"). The abutting pin 514 and abutting pin 515 protrude further to the side of the drum unit 518 from the light emission face of the lens array 506. The movement mechanism 640 has a link member 651 (example of first movement member), a link member 652 (example of second movement member), a sliding portion 525, a first support portion 527, a second support portion 528, and a third support portion 526 serving as an example of a slide supporting portion. Although the abutting pin 514 and abutting pin 515 are described as being cylindrical pins in the present embodiment, the shape thereof is not restricted to being cylindrical, and may be polygonal posts, or conical shapes where the diameter is tapered toward the tip. Also, one or the other of the abutting pin 514 and abutting pin 515 does not have to be a pin, and may be a protrusion protruding to the upper side and lower side of the holding member 505, for example, as having functions equivalent to those of a pin.

First, the holding member 505 will be described. The holding member 505 is a holder that holds the later-described circuit board 502, lens array 506, abutting pin 514, and abutting pin 515. As one example in the present embodiment, the length of the abutting pin 514 protruding from the upper face of the holding member 505 is 7 mm, the length of the abutting pin 515 protruding from the upper face of the holding member 505 is 11 mm, the length of the abutting pin 514 protruding from the lower face of the holding member 505 is 22 mm, and the length of the abutting pin 515 protruding from the lower face of the holding member 505 is 22 mm. The holding member 505 is provided with lens attaching portions 701 where the lens array 506 is attached, and circuit board attaching portions 702 where the circuit board 502 is attached, as illustrated in FIG. 4. The holding member 505 also has spring attaching portion 661, spring attaching portion 662, pin attaching portion 632, and pin attaching portion 633, which will be described later with reference to FIGS. 21A through 21D. The holding member 505 according to the present embodiment has the lens attaching portion 701, circuit board attaching portion 702, spring attaching portion 661, spring attaching portion 662, pin attaching portion 632, and pin attaching portion 633. The holding member 505 is a molded resin article, where the lens attaching portion 701, circuit board attaching portion 702, spring attaching portion 661, and spring attaching portion 662, have been integrally formed by injection molding.

The spring attaching portion 661 to which the link member 651 is attached is provided to the front side of both of the front-side end of the lens array 506 and the front-side end of the circuit board 502, and to the rear side from the pin attaching portion 632, as illustrated in FIG. 3B. The spring attaching position 662 to which the link member 652 is attached is provided to the rear side of both of the rear-side end of the lens array 506 and the rear-side end of the circuit board 502, and to the front side from the pin attaching portion 633. That is to say, the holding member 505 is supported by the link member 651 between the lens array 506 and abutting pin 514 in the front-and-rear direction, and is supported by the link member 652 between the lens array 506 and abutting pin 515 in the front-and-rear direction, when the optical print head 105 moves between the exposure position and the retracted position. Portions where biasing force is applied to the holding member 505 by the link member 651 and link member 652 do not overlap the lens array 506 in the vertical direction, so warping of the lens array 506 due to this biasing force is reduced.

The lens attaching portion 701 has a first inner wall face 507 that extends in the longitudinal direction of the holding member 505, and a second inner wall face 508 that faces the first inner wall face 507 and also extends in the longitudinal direction of the holding member 505. The lens array 506 is inserted between the first inner wall face 507 and the second inner wall face 508 when assembling the optical print head 105. Adhesive agent is coated between the side face of the lens array 506 and the lens attaching portion 701, thereby fixing the lens array 506 to the holding member 505.

The circuit board attaching portion 702 has a cross-sectional open-box shape, and has a third inner wall face 900 extending in the longitudinal direction of the holding member 505, and a fourth inner wall face 901 that faces the third inner wall face 900 and extends in the longitudinal direction of the holding member 505, as illustrated in FIG. 4. A gap 910 into which the circuit board 502 is inserted is formed between the third inner wall face 900 and fourth inner wall face 901. The circuit board attaching portion 702 also includes circuit board abutting portions 911 where the circuit board 502 abuts. The circuit board 502 is inserted from the gap 910 when assembling the optical print head 105, and pressed as far as the circuit board abutting portions 911. Adhesive agent is coated on the boundary portion between the gap 910 side of the circuit board 502 and the third inner wall face 900 and fourth inner wall face 901 in a state where the circuit board 502 is abutted against the circuit board abutting portions 911, thereby fixing the circuit board 502 to the holding member 505. The exposing unit 500 is disposed on the lower side in the vertical direction from the rotational axis of the photosensitive drum 103, and LEDs 503 that the optical print head 105 has expose the photosensitive drum 103 from below.

Next, the circuit board 502 held by the holding member 505 will be described. The circuit board 502 has multiple light-emitting elements (LEDs 503). FIG. 5A is a schematic perspective diagram of the circuit board 502. FIG. 5B1 illustrates an array of multiple LEDs 503 provided to the circuit board 502, and FIG. 5B2 is an enlarged view of FIG. 5B1.

LED chips 639 are mounted on the circuit board 502. The LED chips 639 are mounted on one face of the circuit board 502, while a connector 504 is provided to the rear face side, as illustrated in FIG. 5A. The circuit board 502 is provided with wiring to supply signals to the LED chip 639. One end of a flexible flat cable (FFC) that is omitted from illustration is connected to the connector 504. A circuit board is provided to the main body of the image forming apparatus 1. The circuit board has a control unit and connector. The other end of the FFC is connected to this connector. Control signals are input to the circuit board 502 from the control unit of the main body of the image forming apparatus 1 via the FFC and connector 504. The LED chips 639 are driven by the control signals input to the circuit board 502.

The LED chips 639 mounted on the circuit board 502 will be described in further detail. Multiple (29) LED chips 639-1 through 639-29, on which multiple LEDs 503 are arrayed, are arrayed on one face of the circuit board 502, as illustrated in FIGS. 5B1 and 5B2. Each of the LED chips 639-1 through 639-29 has 516 LEDs (light-emitting elements) arrayed in a single row in the longitudinal direction thereof. The center-to-center distance k2 between LEDs adjacent in the longitudinal direction in the LED chips 639 corresponds to the resolution of the image forming apparatus 1. The resolution of the image forming apparatus 1 according to the present embodiment is 1200 dpi, so the LEDs are arrayed in a single row so that the center-to-center distance k2 between adjacent LEDs in the longitudinal direction of the LED chips 639-1 through 639-29 is 21.16 μm. Accordingly, the range of exposure of the optical print head 105 according to the present embodiment is 316 mm. The photosensitive layer of the photosensitive drum 103 is formed 316 mm or wider. The long side of an A4-size recording sheet and the short side of an A3-size recording sheet are 297 mm, so the optical print head 105 according to the present embodiment has an exposing range capable of forming images on A4-size recording sheets and A3-size recording sheets.

The LED chips 639-1 through 639-29 are alternately arrayed to form two rows in the rotational axis direction of the photosensitive drum 103. That is to say, odd-numbered LED chips 639-1, 639-3, and so on through 639-29, are arrayed on one line in the longitudinal direction of the circuit board 502 from the left, and even-numbered LED chips 639-2, 639-2, and so on through 639-28, are arrayed on one line in the longitudinal direction of the circuit board 502, as illustrated in FIG. 5B1. Arraying the LED chips 639 in this way enables the center-to-center distance k1 between the LEDs disposed on one end of one LED chip 639 and the other end of another LED chip 639 among different adjacent LED chips 639 to be equal to the center-to-center distance k2 of LEDs on the same LED chip 639, in the longitudinal direction of the LED chips 639, as illustrated in FIG. 5B2.

An example where the exposing light source is configured using LEDs is described in the present embodiment. However, organic electroluminescence (EL) devices may be used instead of the exposing light source.

Next, the lens array 506 will be described. FIG. 5C1 is a schematic diagram viewing the lens array 506 from the photosensitive drum 103 side. FIG. 5C2 is a schematic perspective view of the lens array 506. These multiple lenses are arrayed in two rows in the direction of array of the multiple LEDs 503, as illustrated in FIG. 5C1. The lenses are disposed in a staggered manner such that each lens in one row comes into contact with two lenses in the other row that are adjacent in the direction of array of the lenses. The lenses are cylindrical glass rod lenses. Note that the material of the lenses is not restricted to glass, and that plastic may be used. The shape of the lenses is not restricted to a cylindrical shape either, and may be polygonal posts such as hexagonal posts or the like, for example.

A dotted line Z in FIG. 5C2 indicates the optical axis of a lens. The optical print head 105 is moved by the above-described movement mechanism 640 in a direction generally following the optical axis of the lens indicated by the dotted line Z. The term optical axis here means a line that connects the center of the light emitting face of the lens and the focal point of this lens. The discharged light emitted from an LED enters a lens included in the lens array 506, as illustrated in FIG. 4. The lens functions to condense the discharged light entering the lens onto the surface of the photosensitive drum 103. The attachment position of the lens array 506 as to the lens attaching portion 701 is adjusted when assembling the optical print head 105, such that the distance between the light-emitting face of the LED and incoming light face of the lens, and the distance between the light-emitting face of the lens and the surface of the photosensitive drum 103, are generally equal.

Figure 6A:
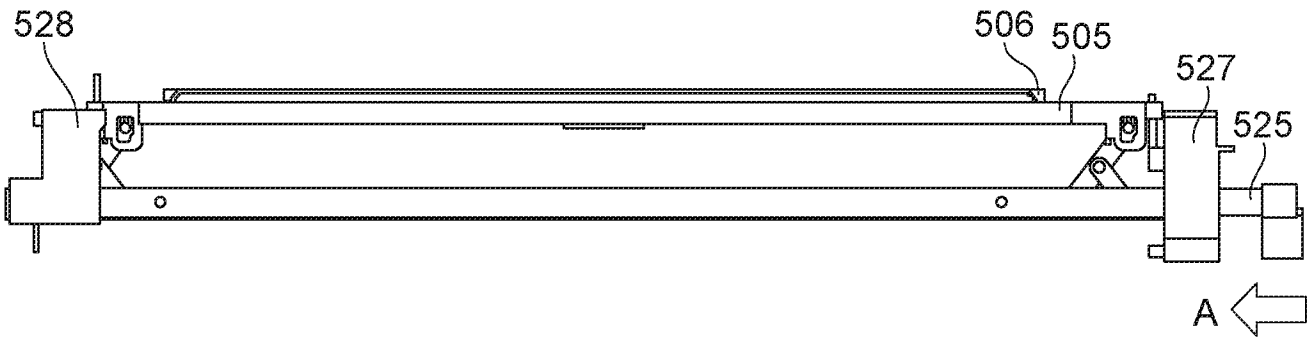
FIGS. 6A and 6B are side views of an optical print head.
Figure 6B:
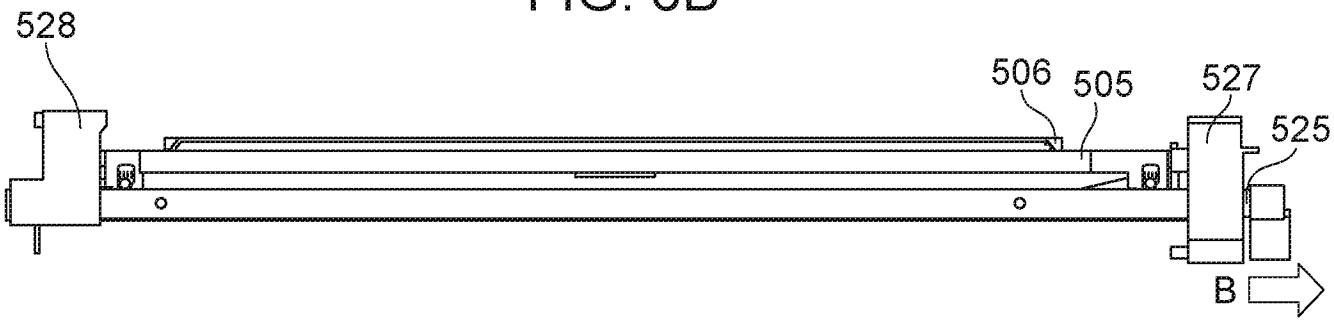

Now, the necessity of moving the optical print head 105 will be described. When replacing a drum unit 518 in the image forming apparatus 1 according to the present embodiment, the drum unit 518 is moved by sliding in the rotational axis direction of the photosensitive drum 103 to the front side of the apparatus main body, as illustrated in FIG. 2B. Moving the drum unit 518 in a state where the optical print head 105 is situated near the surface of the photosensitive drum 103 results in the drum unit 518 coming into contact with the surface of the photosensitive drum 103 while moving by sliding, and the surface of the photosensitive drum 103 being mounted will be scratched. Also, the lens array 506 will come into contact with the frame of the drum unit 518 and the lens array 506 will be scratched. Accordingly, a structure is necessary where the optical print head 105 is reciprocally moved between an exposure position (FIG. 6A) where the photosensitive drum 103 is exposed, and a retracted position (FIG. 6B) retracted from the exposure position. When the sliding portion 525 moves by sliding in the direction of arrow A with the optical print head 105 at the exposure position (FIG. 6A), the optical print head 105 moves in a direction toward the retracted position (FIG. 6B). On the other hand, when the sliding portion 525 moves by sliding in the direction of arrow B with the optical print head 105 at the retracted position (FIG. 6B), the optical print head 105 moves in a direction toward the exposure position (FIG. 6A). This will be described in detail later.

FIG. 7A1 is a perspective view illustrating a bushing 671 provided to the rear side of the optical print head 105 situated in the exposure position and the rear side of the drum unit 518. FIG. 7A2 is a cross-sectional view illustrating the second support portion 528 and the bushing 671 provided to the rear side of the drum unit 518 when the optical print head 105 situated in the exposure position. FIG. 7B1 is a perspective view illustrating the bushing 671 provided to the rear side of the optical print head 105 situated in the retracted position and the rear side of the drum unit 518. FIG. 7B2 is a cross-sectional view illustrating the second support portion 528 and the bushing 671 provided to the rear side of the drum unit 518 when the optical print head 105 is in the retracted position.

The way in which the abutting pin 515 provided to the rear side of the optical print head 105 abuts the bushing 671 provided to the rear side of the drum unit 518 will be described with reference to FIGS. 7A1 through 7B2. A part equivalent to the bushing 671 with which an abutting pin comes into contact is also provided on the front side of the drum unit 518, the structure thereof is the same as the structure of the bushing 671, and the function also is substantially the same. Just the way in which the abutting pin 515 comes into contact with the bushing 671 provided to the drum unit 518 side will be described here.

It can be seen from FIGS. 7A1 and 7B1 that the portion where the link member 652 is attached to the holding member 505 is closer to the photosensitive drum 103 side from the one of the ends of the abutting pin 515 that is opposite in the vertical direction (the direction in which the optical print head 105 moves between the exposure position and the retracted position, i.e., in the direction of reciprocal movement). The spring attaching position 662 to which the link member 652 is attached is disposed so as to not intersect the abutting pin 515 in the vertical direction. The portion where the link member 651 is attached to the holding member 505 also is closer to the photosensitive drum 103 side from the one of the ends of the abutting pin 514 that is opposite in the vertical direction (the direction in which the optical print head 105 moves between the exposure position and the retracted position, i.e., in the direction of reciprocal movement), although omitted from illustration here. The spring attaching portion 661 where the link member 651 is attached is disposed so as to not intersect the abutting pin 514 in the vertical direction. Accordingly, the size of the exposing unit 500 in the vertical direction can be suppressed.

The second support portion 528 has a second seating face 587, a restricting portion 128 that is an example of a first guide portion, a first wall face 588, and a second wall face 589, as illustrated in FIGS. 7A2 and 7B2. The two wall faces (first wall face 588 and second wall face 589) are an example of a second guide portion. Although the first guide portion and second guide portion are integrally formed to make up the second support portion 528, a configuration may be made where the first guide portion and second guide portion are separate members that are attachable to each other.

The second seating face 587 is provided to the lower side of the holding member 505. The lower side of the holding member 505 moving from the exposure position toward the retracted position abuts the second seating face 587 and the first seating face 586 of the later-described first support portion 527 from above in the vertical direction, and thus the optical print head 105 is at the retracted position. The restricting portion 128 is a recess formed in the second support portion 528 and having the shape of a box with one side open, being opened toward the front side, and disposed on the opposite side of the holding member 505 as to the side where the drum unit 518 is disposed, and fit further from the rear side than the abutting pin 515, so that the abutting pin 515 can move in the vertical direction. The abutting pin 515 that has protruded from the lower side of the holding member 505 moves through the gap formed by the restricting portion 128, and vertically moves along with the holding member 505, in a state fit to the restricting portion 128 so movement in the left-and-right direction is restricted. This gap is formed from the rear side of the abutting pin 515 to positions facing the abutting pin 515 in both sides in the left-and-right direction.

The first support portion 527 also has a restricting portion 127 that is an example of a first guide portion, though omitted from illustration here. The restricting portion 127 is a recess formed in the first support portion 527 and having the shape of a box with one side open, being opened toward the front side. The restricting portion 127 is formed to the opposite side of the holding member 505 from the side where the drum unit 518 is situated, and is fit further from the front side than the abutting pin 514, so that the abutting pin 514 is capable of vertical movement. The abutting pin 514 that has protruded from the lower side of the holding member 505 moves through the gap formed by the restricting portion 127, and vertically moves along with the holding member 505, in a state fit to the restricting portion 128 so movement in the left-and-right direction is restricted. This gap is formed from the from side of the abutting pin 514 to positions facing the abutting pin 514 in both sides in the left-and-right direction.

The state where the abutting pin 514 (or abutting pin 515) and the restricting portion 127 (or restricting portion 128) are fit, as described in the present embodiment, indicates a state of fitting where the difference between the width in the left-and-right direction of the gap formed by the restricting portion 127 (or restricting portion 128) and the width in the left-and-right direction of a portion where the abutting pin 514 (or abutting pin 515) moves through the gap formed by the restricting portion 127 (or restricting portion 128) is a gap of around 10 to 30 μm. The restricting portion 128 (or restricting portion 127) is formed tapered, with the thickness in the vertical direction being smaller the closer to the abutting pin 514, to maximally reduce friction occurring due to contact with the abutting pin 515 (or abutting pin 514). Thus, the abutting pin 514 (abutting pin 515) can smoothly move vertically in the gap at the restricting portion 127 (restricting portion 128). Accordingly, movement of the holding member 505 that is integral with the abutting pin 515 and abutting pin 514 is restricted in directions intersecting both the front-and-rear direction (rotational axis direction of the photosensitive drum 103) and the vertical direction (the direction in which the optical print head 105 moves between the exposure position and the retracted position, i.e., in the direction of reciprocal movement). The restricting portion 127 may restrict the abutting pin 514 from moving from the rear side to the front side, and the restricting portion 128 may restrict the abutting pin 515 from moving from the front side to the rear side.

The first wall face 588 and second wall face 589 are disposed at positions facing each other in the left-and-right direction, with a gap formed. When the optical print head 105 reciprocally moves between the exposure position and the retracted position, the holding member 505 moves vertically through the gap formed by the first wall face 588 and second wall face 589, in a state of being slackly fit in this gap. During this time, movement of the holding member 505 is restricted in directions intersecting both the front-and-rear direction (rotational axis direction of the photosensitive drum 103) and the vertical direction (the direction in which the optical print head 105 moves between the exposure position and the retracted position, i.e., in the direction of reciprocal movement), by the first wall face 588 and second wall face 589. The state in which the holding member 505 is slackly fit in the gap formed by the first wall face 588 and second wall face 589, as described in the present embodiment, indicates a state of fitting with a gap, where the difference between the width in the left-and-right direction of the gap and the width in the left-and-right direction of the rear side of the holding member 505, is around 0.5 to 2 mm.

According to the above configuration, the optical print head 105 moves between the exposure position and retracted position in a state where movement is restricted in directions intersecting both the front-and-rear direction (rotational axis direction of the photosensitive drum 103) and the vertical direction (the direction in which the optical print head 105 moves between the exposure position and the retracted position, i.e., in the direction of reciprocal movement). Note that it is sufficient for at least one of the restricting portion 127 and restricting portion 128 to be provided to the first support portion 527 or second support portion 528. That is to say, it is sufficient for the restricting portion 127 to be provided to the first support portion 527 that is an example of a support portion, or the restricting portion 128 to be provided to the second support portion 528. The first wall face 588 and second wall face 589 may also be provided to the first support portion 527 instated of the second support portion 528.

The position at which the abutting pin 515 comes into contact with the bushing 671 provided to the rear side of the drum unit 518, and the abutting pin 514 (omitted from illustration) comes into contact with the part equivalent to the bushing 671 that is provided to the front side of the drum unit 518, is the exposure position of the optical print head 105, as illustrated in FIGS. 7A1 and 7A2. The distance between the lens array 506 and the surface of the photosensitive drum 103 becomes the designed nominal distance by the abutting pin 514 and the abutting pin 515 abutting the bushing 671 and the part equivalent to the bushing 671.

On the other hand, the position where the abutting pin 515 is retracted from the bushing 671 provided to the rear side of the drum unit 518, as illustrated in FIGS. 7B1 and 7B2 is equivalent to the retracted position of the optical print head 105. The optical print head 105 is in a state where the drum unit 518 that moves by sliding for being replaced and the optical print head 105 do not come into contact, by the optical print head 105 being at the retracted position illustrated in FIGS. 7B1 and 7B2.

Figure 8:
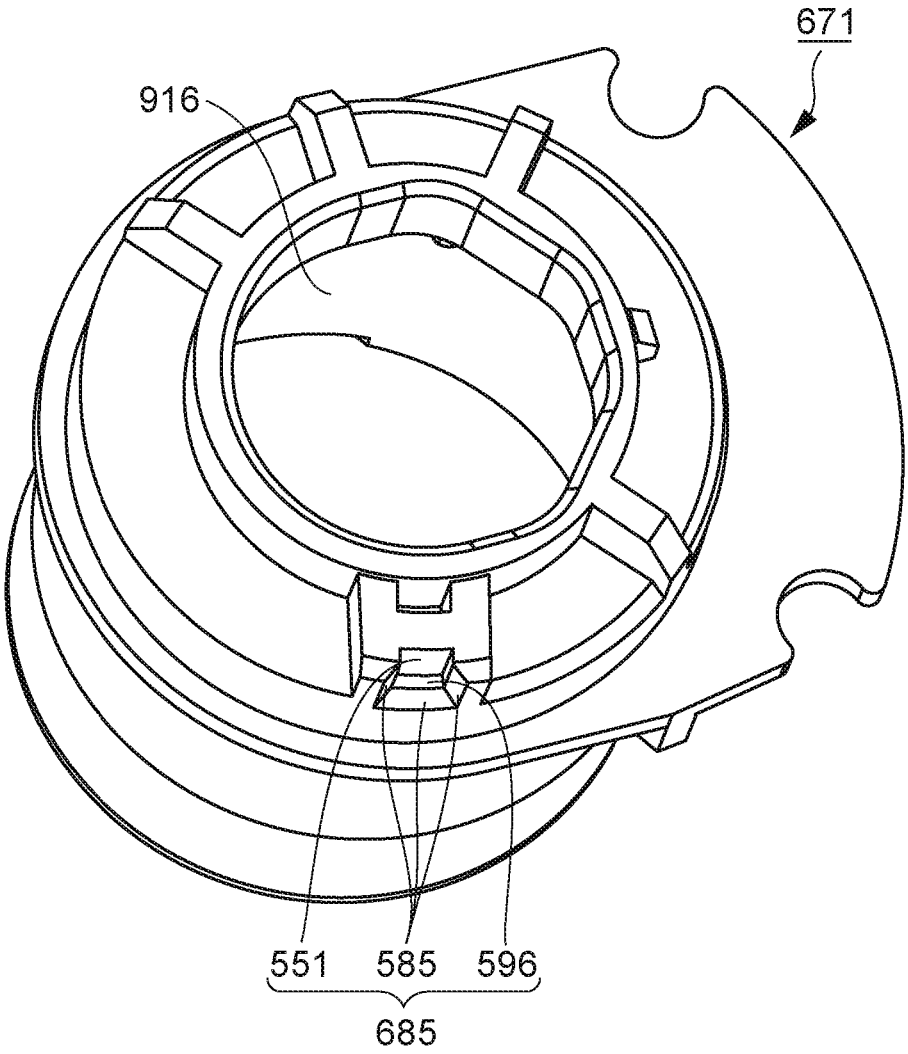
FIG. 8 is a perspective view of a bushing attached to the rear side of a drum unit.

Now, the bushing 671 that the drum unit 518 has will be described. FIG. 8 illustrates a perspective view of the bushing 671. The bushing 671 is a member fixed to the casing of the drum unit 518 by screws or adhesive agent. An opening 916 is formed in the bushing 671, as illustrated in FIG. 8. A shaft member at the other end side of the photosensitive drum 103 is rotatably inserted into the opening 916. That is to say, the bushing 671 rotatably bears the photosensitive drum 103.

The photosensitive drum 103 has a photosensitive layer formed on an outer wall face of a hollow cylindrical aluminum tube. Flanges 673 are press-fitted top both ends of the aluminum tube. The flange 673 at the other end side of the photosensitive drum 103 is rotatably inserted into the opening 916 formed in the bushing 671. The flange 673 rotates while rubbing against the inner wall face of the opening 916 formed in the bushing 671. That is to say, the bushing 671 rotatably bears the photosensitive drum 103. An opening the same as that of the bushing 671 is also formed at the middle portion of the part equivalent to the bushing 671 provided to the front side of the drum unit 518, with which the abutting pin 514 comes into contact. The flange 673 of the one end side (front side) of the photosensitive drum 103 is rotatably inserted into the opening formed in the part equivalent to the bushing 671. The flange 673 rotates while rubbing against the inner wall face of this opening. That is to say, the part equivalent to the bushing 671 rotatably bears the photosensitive drum 103 at the front side, the same as the rear side of the drum unit 518.

The bushing 671 has a fitting portion 685 (abutting portion) to which the abutting pin 515 fits. The fitting portion 685 is provided with an abutting face 551, a rear-side wall face 596, and a tapered portion 585. The fitting portion 685 may be recessed as to the bushing 671, or may be erected. The abutting pin 515 that moves in the direction from the retracted position toward the exposure position abuts the abutting face 551. The lower edge of the fitting portion 685 has the tapered portion 585 formed, that is tapered. The tapered portion 585 guides movement of the abutting pin 515 heading from the retracted position toward the exposure position, so as to abut the abutting face 551. Contact of the rear-side wall face 596 and the abutting pin 515 will be described later.

The movement of the abutting pin 515 that has abutted the abutting face 551 of the fitting portion 685 is restricted in directions intersecting both the front-and-rear direction (rotational axis direction of the photosensitive drum 103) and the vertical direction (the direction in which the optical print head 105 moves between the exposure position and the retracted position, i.e., in the direction of reciprocal movement) by the fitting portion 685. That is to say, movement of the upper end of the abutting pin 515 is restricted in directions intersecting both the front-and-rear direction and the vertical direction by being fit to the fitting portion 685, and movement of the lower end of the abutting pin 515 is restricted in directions intersecting both the front-and-rear direction and the vertical direction by being fit to the gap formed by the restricting portion 128, with regard to the optical print head 105 situated in the exposure position (FIG. 7A2). Now, the difference between the width of the fitting portion 685 in the left-and-right direction and the width of the upper end of the abutting pin 515 in the left-and-right direction, and the difference between the width of the gap formed by the restricting portion 128 in the left-and-right direction and the width of the lower end of the abutting pin 515 in the left-and-right direction, are smaller than the difference between the width in the left-and-right direction between the first wall face 588 and second wall face 589 and the width in the left-and-right direction of the holding member 505 situated between the first wall face 588 and second wall face 589. Accordingly, when the optical print head 105 is in the exposure position, the first wall face 588 and second wall face 589 do not contribute to restriction of movement of the holding member 505 in directions intersecting either of the front-and-rear direction and the vertical direction. Note that it is not necessary for the first wall face 588, second wall face 589, and holding member 505 to be in non-contact when the optical print head 105 is at the exposure position. A structure is sufficient where the movement of the holding member 505 in the left-and-right direction is not restricted by the first wall face 588 and second wall face 589, by the first wall face 588 and second wall face 589 being elastically deformable members or the like.

Movement Mechanism

Figure 9A:
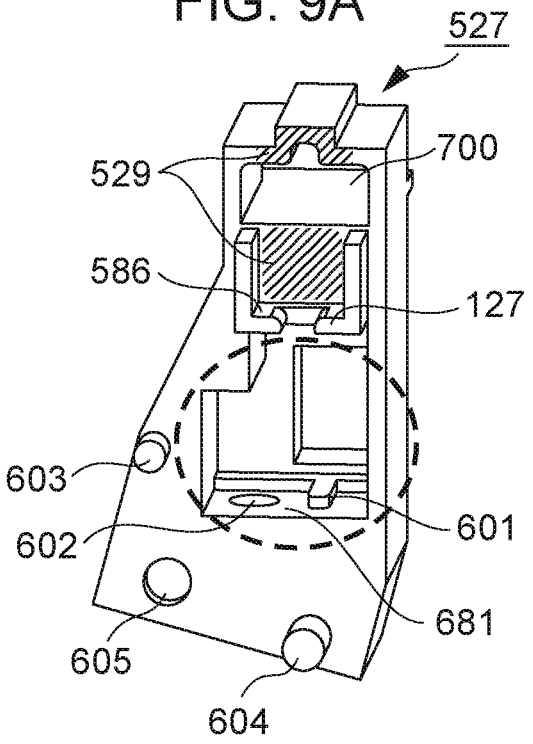
FIGS. 9A through 9C are perspective views of a first support portion and a third support portion.

The movement mechanism 640 for moving the optical print head 105 will be described next. First, the first support portion 527 will be described. FIG. 9A is a schematic perspective view of the first support portion 527. Formed on the first support portion 527 are the first seating face 586 that is an example of an abutting portion (stopping mechanism), an opening 700 serving as an example of an insertion portion, an abutting portion 529, restricting portion 127, protrusion 601, screw hole 602, positioning boss 603, positioning boss 604, and screw hole 605. The first support portion 527 may be an article where the opening 700 and first seating face 586 have been integrally formed by injection molding, or these may be separate members.

The first seating face 586 is a portion where the lower side of the holding member 505 moving from the exposure position toward the retracted position abuts from above in the vertical direction, and is fixed to the main body of the image forming apparatus 1. The lower side of the holding member 505 abuts the first seating face 586, and the optical print head 105 is at the retracted position.

A cleaning member 572 for cleaning the light-emitting face of the lens array 506 contaminated by toner or the like is inserted through the opening 700 from the outer side of the main body of the image forming apparatus 1. The cleaning member 572 is a slender rod-like member. Although a through hole through which the cleaning member 572 passes in the front-and-rear direction is illustrated as an example of the opening 700 in the present embodiment, this is not restricted to being a hole, and a slit may be formed above, for example. The abutting portion 529 is a rear-side face of the first support portion 527, as indicated by hatching in FIG. 9A, and is regions above and below the opening 700. The function of the abutting portion 529 will be described later in detail.

The restricting portion 127 is a recess formed in the first support portion 527 and having the shape of a box with one side open, being opened toward the rear side, as illustrated in FIG. 9A. Part of the abutting pin 514 protruding from the lower side of the holding member 505 moves vertically along with the holding member 505 through the gap formed by the restricting portion 127. The restricting portion 127 is formed tapered, with the thickness in the vertical direction being smaller the closer to the abutting pin 514, to maximally reduce friction occurring due to contact with the abutting pin 514. Accordingly, the abutting pin 514 can smoothly move vertically in the gap of the restricting portion 127.

The first support portion 527 is fixed to the front-side face of the front-side plate 642. Multiple holes (omitted from illustration), corresponding to the positioning boss 603, positioning boss 604, and fixing screws are formed in the front-side plate 642. The positioning boss 603 and positioning boss 604 are inserted into respective holes of the multiple holes provided to the front-side plate 642, and in this state, the first support portion 527 is fixed to the front-side plate 642 by screws passed through the screw holes of the first support portion 527.

Figure 9B:
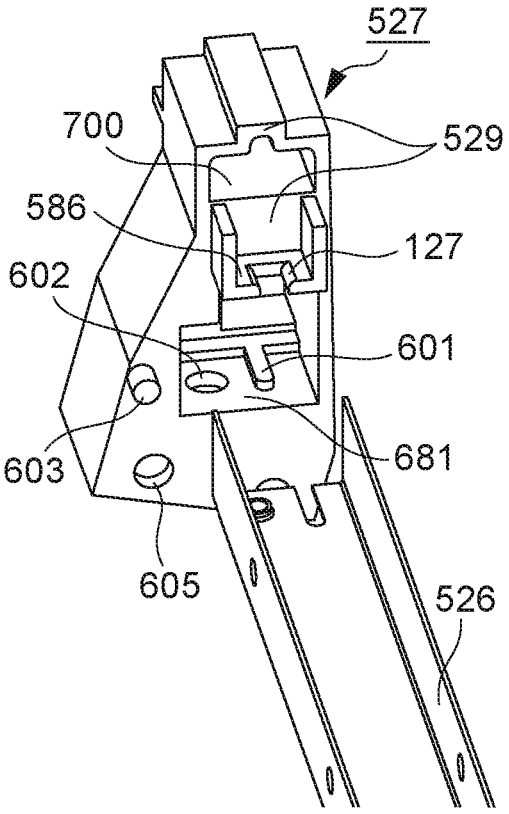
Figure 9C:
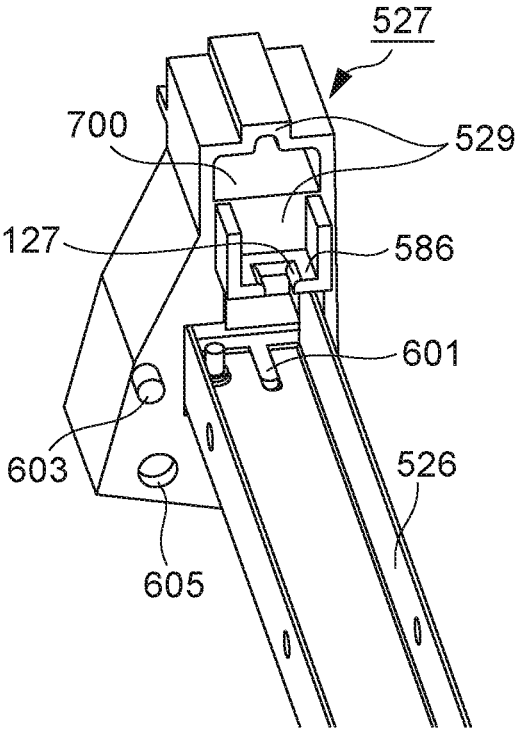

The third support portion 526, which will be described later, is sheet metal folded into the shape of a box with one side opened. FIG. 9B is a diagram for describing the way in which one end portion of the third support portion 526 in the longitudinal direction is inserted into the portion surrounded by a dotted line in FIG. 9A. FIG. 9C is a diagram illustrating the one end portion of the third support portion 526 in the longitudinal direction having been inserted into the portion surrounded by the dotted line in FIG. 9A. A notch is provided at the one end portion of the third support portion 526 as illustrated in FIGS. 9B and 9C, with the protrusion 601 of the first support portion 527 side engaging the notch of the third support portion 526. This engaging of the protrusion 601 with the notch in the third support portion 526 positions the third support portion 526 as to the first support portion 527 in the left-and-right direction. The third support portion 526 is pressed from the lower side in FIG. 9C by the screw inserted from the screw hole 602, and is fixed to the first support portion 527 by abutting a contact face 681 of the first support portion 527.

Figure 10A:
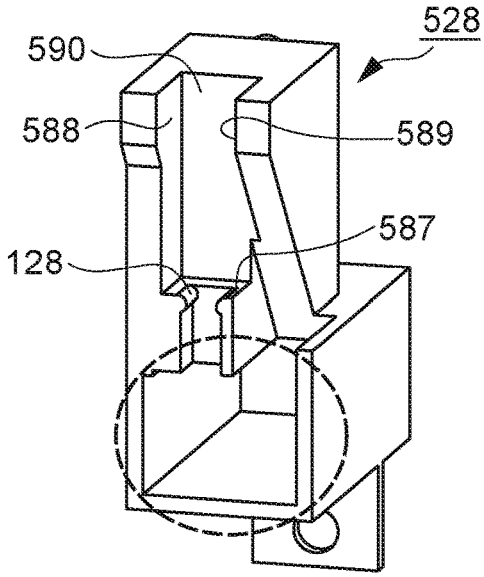
FIGS. 10A through 10C are perspective views of a second support portion, a rear-side plate, and an exposing unit attached to the second support portion.

Next, the second support portion 528 will be described. FIG. 10A is a schematic perspective view of the second support portion 528. The second seating face 587, first wall face 588, second wall face 589, a third wall face 590, and the restricting portion 128, are formed on the second support portion 528. The second seating face 587 is the portion that the lower side of the holding member 505 moving from the exposure position toward the retracted position abuts, as described earlier. The second seating face 587 is fixed to the main body of the image forming apparatus 1. The lower side of the holding member 505 abuts the second seating face 587, and thus the optical print head 105 is at the retracted position.

Figure 10B:
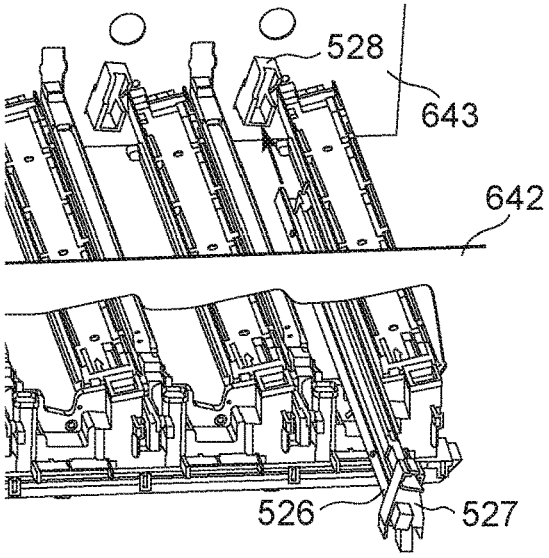
Figure 10C:
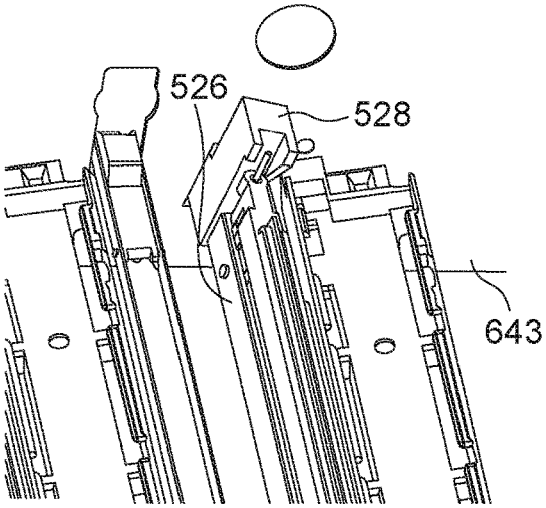

The second support portion 528 is fixed to the front-side face of the rear-side plate 643, as illustrated in FIG. 10B. The second support portion 528 is fixed to the rear-side plate 643 by positioning bosses and screws, in the same way that the first support portion 527 is fixed to the front-side plate 642. FIG. 10C illustrates a state where the other end side (rear side) of the third support portion 526 in the longitudinal direction of the third support portion 526 is inserted into the portion surrounded by a dotted line in FIG. 10A. That is to say, one end portion of the third support portion 526 is supported by the first support portion 527, and the other end portion is supported by the second support portion 528, with the first support portion 527 and the second support portion 528 being fixed to the front-side plate 642 and rear-side plate 643, respectively. In other words, the third support portion 526 is fixed to the main body of the image forming apparatus 1.

Note that an arrangement may be made where the second support portion 528 is fixed to the third support portion 526 by screws or the like, and is not fastened to the rear-side plate 643 by screws. In this case, a structure is made, for example, where a recessed portion is formed in the second support portion 528, which fits with a protruding portion formed on the rear-side plate 643, thereby positioning the second support portion 528 as to the rear-side plate 643. The first wall face 588 and second wall face 589 of the second support portion 528 will be described later.

The restricting portion 128 is a recess formed in the second support portion 528 and having the shape of a box with one side open, being opened toward the front side, as illustrated in FIG. 10A. Part of the abutting pin 515 protruding from the lower side of the holding member 505 moves vertically along with the holding member 505 through the gap formed by the restricting portion 128. The restricting portion 128 is formed tapered, to maximally reduce friction occurring due to contact with the abutting pin 515 with the thickness in the vertical direction being thinner, the closer to the abutting pin 515. Accordingly, the abutting pin 515 can smoothly move vertically in the gap of the restricting portion 128.

The third wall face 590 restricts the holding member 505 from moving to the rear side. The third wall face 590 along with the first wall face 588 and second wall face 589 may be referred to as the second guide portion. In a case of a configuration where the first wall face 588 and second wall face 589 are provided to the first support portion 527, the holding member 505 is restricted from moving forward by the abutting portion 529.

Next, the third support portion 526 and sliding portion 525 will be described with reference to FIGS. 11*a* and 11B. The third support portion 526 and sliding portion 525 are disposed on the opposite side of the holding member 505 from the photosensitive drum 103.

Figure 11A:
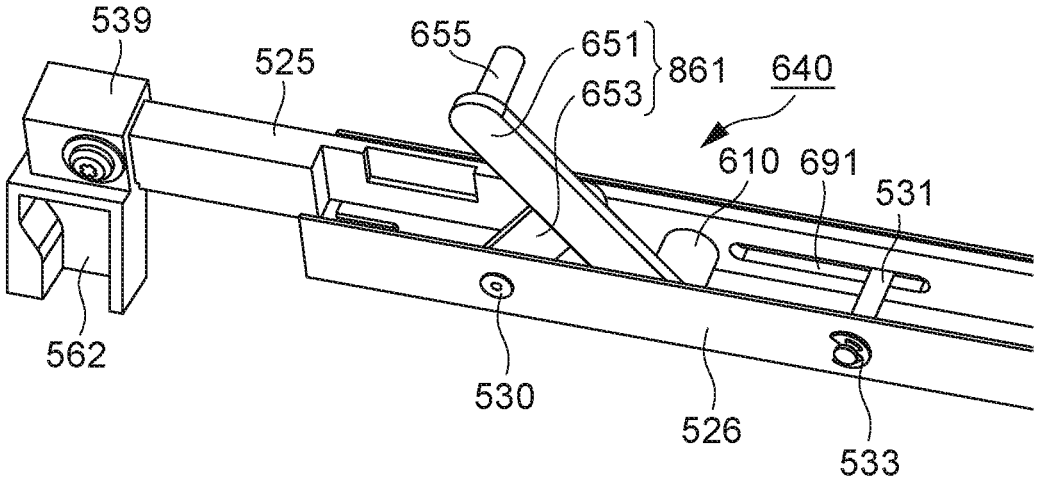
FIGS. 11A and 11B are perspective views of a movement mechanism, with the first support portion omitted from illustration.
Figure 11B:
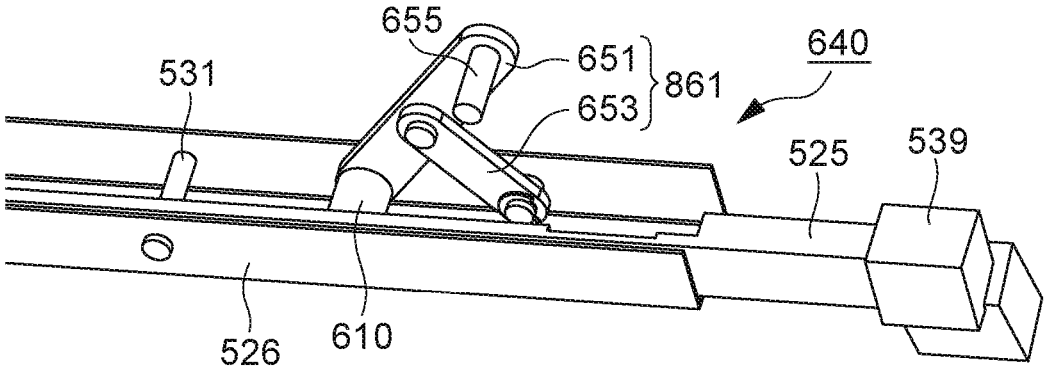

FIG. 11A is a schematic perspective view of the front side of the movement mechanism 640 as viewed from the left side, with the first support portion 527 omitted from illustration. FIG. 11B is a schematic perspective view of the front side of the movement mechanism 640 as viewed from the right side, with the first support portion 527 omitted from illustration. The movement mechanism 640 has the link member 651, the sliding portion 525, and the third support portion 526. The third support portion 526 has a support shaft 531 and an E-type snap ring 533. It can be seen from FIGS. 11A and 11B that the support shaft 531 is inserted through openings formed in the opposing faces (left-side face and right-side face) of the third support portion 526 that has been formed into the shape of a box with one side open. The support shaft 531 passes through the right-side face and the left-side face of the third support portion 526. The support shaft 531 is retained by the E-type snap ring 533 on the outer side of the left-side face, so as not to fall out from the openings of the third support portion 526. On the other hand, a slot 691 that is an elongated opening and that extends in the front-and-rear direction is formed in the sliding portion 525, as illustrated in FIG. 11A. The support shaft 531 is inserted through the slot 691 of the sliding portion 525, and is loosely fit with a gap of around 0.1 to 0.5 mm as to the slot 691 in the vertical direction, for example. Accordingly, movement of the sliding portion 525 in the vertical direction as to the third support portion 526 is restricted, and the sliding portion 525 can only move by sliding as to the third support portion 526 by the length of the slot 691 in the front-and-rear direction.

A slide aiding member 539 having an accommodation space 562 from the left side to the lower side is attached to one end side of the sliding portion 525. The slide aiding member 539 is fixed to the sliding portion 525 by being fastened by a screw from the left side. The accommodation space 562 accommodates a later-described pressing member 561, serving as an example of a pressing portion, that the cover 558 has. The relation between the accommodation space 562 and the pressing member 561, and structural features thereof, will be described later along with description of the cover 558.

The movement mechanism 640 will be described with reference to FIGS. 3 and 11A through 12B. FIG. 3 is a schematic perspective view of the exposing unit 500 having the movement mechanism 640. The movement mechanism 640 has the first link mechanism 861, second link mechanism 862, sliding portion 525, first support portion 527, second support portion 528, and third support portion 526, as illustrated in FIG. 3. The first link mechanism 861 includes the link member 651 and link member 653, and the second link mechanism 862 includes the link member 652 and link member 654. The link member 651 and link member 653, and link member 652 and link member 654, each make up a λ-type link mechanism, as illustrated in FIG. 3.

FIG. 11A is a schematic perspective view of the front side of the movement mechanism 640, as viewed from the left side, with the first support portion 527 omitted from illustration. FIG. 11B is a schematic perspective view of the front side of the movement mechanism 640, as viewed from the right side, with the first support portion 527 omitted from illustration.

Figure 12A:
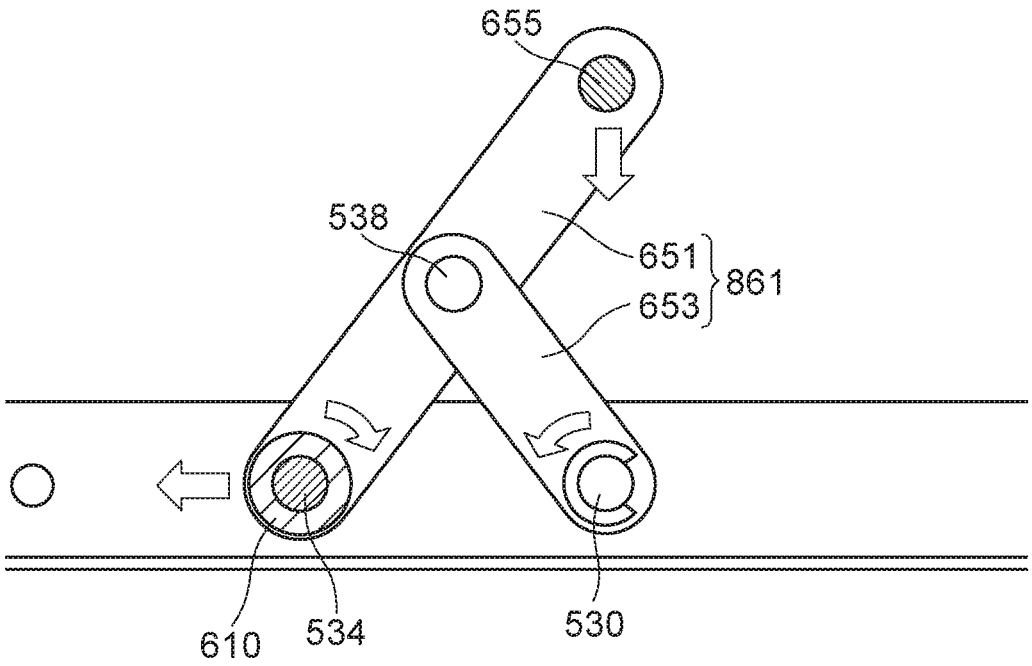
FIGS. 12A and 12B are side views of a λ-type first link mechanism.
Figure 12B:
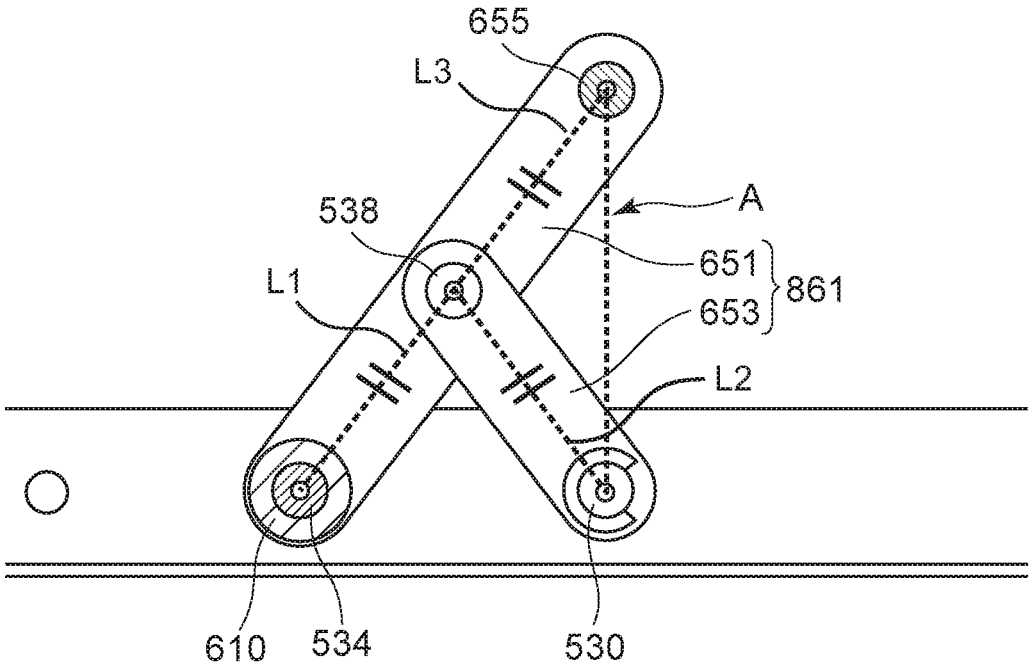

The first link mechanism 861 will be described with reference to FIGS. 11A through 12B. FIG. 12A is a diagram where a cross-sectional view of the first link mechanism 861 taken along the rotational axis of the photosensitive drum 103 is viewed from the right side. The first link mechanism 861 has the link member 651 and link member 653. The link member 651 and link member 653 making up the first link mechanism 861 are each single link members, but may be configured by combining multiple link members. The length of the link member 653 in the longitudinal direction is shorter than the length of the link member 651 in the longitudinal direction, as illustrated in FIGS. 12A and 12B.

The link member 651 has a bearing 610, a protrusion 655, and a connecting shaft portion 538. The bearing 610 is provided to one end side in the longitudinal direction of the link member 651. The protrusion 655 is a cylindrical protrusion erected in the pivoting axis direction of the link member 651 provided at the other end side in the longitudinal direction of the link member 651, for causing deformation of a spring provided to the holding member 505 side of the optical print head 105. The connecting shaft portion 538 is provided between the bearing 610 and protrusion 655 in the longitudinal direction of the link member 651. Although the protrusion 655 serves as a first moving portion, the first moving portion is not restricted to the protrusion 655, and may be a structure where one end side in the longitudinal direction of the link member 651 is bent in the pivoting axis direction.

A circular hollowed space that extends in the left-and-right direction in FIG. 12A is formed in the bearing 610, as a hole. A fitting shaft portion 534 is provided to the sliding portion 525. The fitting shaft portion 534 is a cylindrical protrusion erected from the sliding portion 525 to the left direction in FIG. 12A. The fitting shaft portion 534 forms a first connecting portion by being pivotably fit to the hole of the bearing 610. That is to say, the link member 651 is capable of pivoting as to the sliding portion 525, with the first connecting portion as the center of pivoting. Note that the fitting shaft portion 534 may be formed on the link member 651 side, and the bearing 610 formed on the sliding portion 525.

The link member 653 has a connecting shaft portion 530. The connecting shaft portion 530 is provided to one end side in the longitudinal direction of the link member 653. The connecting shaft portion 530 is a cylindrical protrusion erected from the link member 653 to the left side in FIG. 12A. The connecting shaft portion 530 is rotatably inserted into a hole formed in the third support portion 526, and thus forms a third connecting portion. The connecting shaft portion 530 may be formed to the third support portion 526 rather than the link member 653. That is to say, the connecting shaft portion 530 formed on the third support portion 526 may be inserted to a hole formed in the link member 653.

A circular hole that extends in the left-and-right direction in FIG. 12A is formed at the other end side in the longitudinal direction of the link member 653. The connecting shaft portion 538 of the link member 651 is pivotably inserted into this hole, whereby the connecting shaft portion 538 and the hole of the link member 653 make up a fourth connecting portion. That is to say, the link member 653 is capable of pivoting as to the third support portion 526 with the third connecting portion as a center of pivoting, and is capable of pivoting as to the link member 651 with the fourth connecting portion as a center of pivoting. Now, the connecting shaft portion 538 may be formed on the link member 653 rather than the link member 651. That is to say, the connecting shaft portion 538 formed on the link member 653 may be inserted into a hole formed in the link member 651.

Note that the configuration of the second link mechanism 862 is the same as the configuration of the first link mechanism 861 described above. The link member 652 and link member 654 that the second link mechanism 862 has correspond to the link member 651 and link member 653, respectively. The one end side in the longitudinal direction of the link member 652 and the connecting portion of the sliding portion 525 make up a second connecting portion, corresponding to the first connecting portion. A protrusion 656 corresponding to the protrusion 655 of the link member 651 is formed on the link member 652, as an example of a moving portion. Note that one of the link member 653 and link member 654 may be omitted from the embodiment regarding the movement mechanism 640.

According to the above configuration, when the sliding portion 525 moves by sliding from the front side toward the rear side with regard to the third support portion 526, the bearing 610 to which the fitting shaft portion 534 has been fit moves by sliding from the front side toward the rear side as to the third support portion 526, along with the sliding portion 525. Accordingly, when viewing the first link mechanism 861 from the right side as illustrated in FIG. 12A, the link member 651 pivots in the clockwise direction with the fitting shaft portion 534 as the center of pivoting, and the link member 653 pivots in the counter-clockwise direction with the connecting shaft portion 530 as the center of pivoting. Accordingly, the protrusion 655 moves in a direction from the exposure position toward the retracted position.

On the other hand, when the sliding portion 525 moves by sliding from the rear side toward the front side as to the third support portion 526, the link member 651 and link member 653 move in the opposite directions as to the arrows in FIG. 12A. When the sliding portion 525 moves by sliding from the rear side toward the front side with regard to the third support portion 526, the bearing 610 to which the fitting shaft portion 534 has been fit moves by sliding from the rear side toward the front side as to the third support portion 526, along with the sliding portion 525. Accordingly, when viewing the first link mechanism 861 from the right side as illustrated in FIG. 12A, the link member 651 pivots in the counter-clockwise direction with the fitting shaft portion 534 as the center of pivoting, and the link member 653 pivots in the clockwise direction with the connecting shaft portion 530 as the center of pivoting. Accordingly, the protrusion 655 moves in a direction from the retracted position toward the exposure position.

Now, (1) the distance between the pivoting center axis of the connecting shaft portion 538 and the pivoting center axis of the bearing 610 will be referred to as L1, (2) the distance between the pivoting center axis of the connecting shaft portion 538 and the pivoting center axis of the connecting shaft portion 530 will be referred to as L2, and (3) the distance between the pivoting center axis of the connecting shaft portion 538 and the pivoting center axis of the protrusion 655 will be referred to as L3. In the movement mechanism 640, the first link mechanism 861 forms a Scott Russel linkage where L1, L2, and L3 are equal (see FIG. 12B). The protrusion 655 moves perpendicular (along line A in FIG. 12B) to the direction of sliding movement of the fitting shaft portion 534 due to the distances L1, L2, and L3 being equal, so the optical print head 105 can be moved generally in the optical axis direction in the above-described link mechanism.

A configuration may be made where the front-and-rear directions of the first link mechanism 861 and second link mechanism 862 are opposite, so that when the sliding portion 525 is moved by sliding from the front side toward the rear side, the optical print head 105 moves from the retracted position toward the exposure position, and when the sliding portion 525 is moved by sliding from the rear side toward the front side, the optical print head 105 moves from the exposure position toward the retracted position. In this case, the later-described cover 558 presses the sliding portion 525 from the front side toward the rear side when moving from an opened state to a closed state, and pulls the sliding portion 525 from the rear side toward the front side when moving from a closed state to an opened state.

The mechanism for moving optical print head 105 is not restricted to the movement mechanism 640. A movement mechanism 140 illustrated in FIGS. 13A and 13B may be used. The movement mechanism 140 will be described below with reference to FIGS. 13A through 14B. Members which have substantially the same functions as the members making up the movement mechanism 640 are denoted by the same reference numerals, and redundant description may be omitted.

The arrangement by which the movement mechanism 140 moves the holding member 505 will be described with reference to FIGS. 13A through 14B. FIG. 14A is a cross-sectional view of the holding member 505 and the movement mechanism 140 illustrated in FIG. 14B, taken along the rotational axis of the photosensitive drum 103.

Figure 13A:
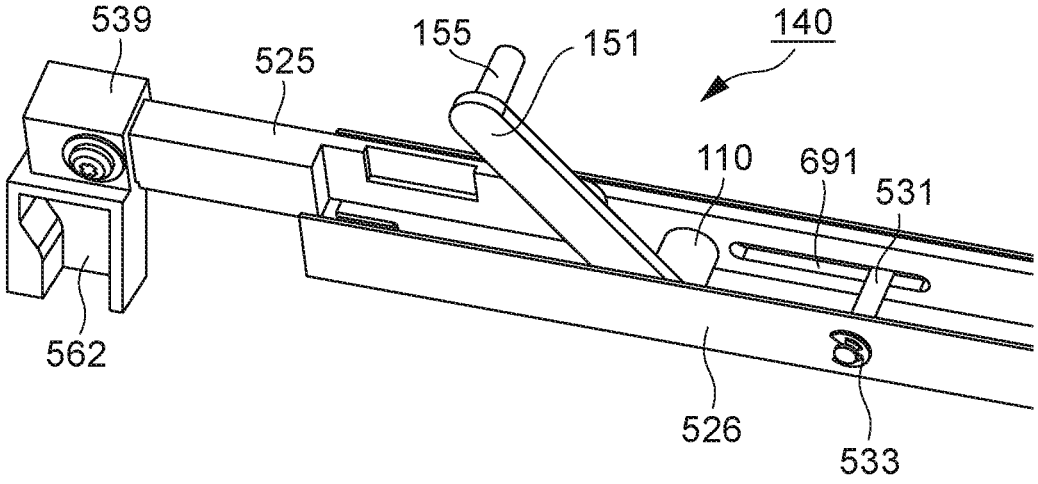
FIGS. 13A and 13B are perspective views of a movement mechanism, with the first support portion omitted from illustration.
Figure 13B:
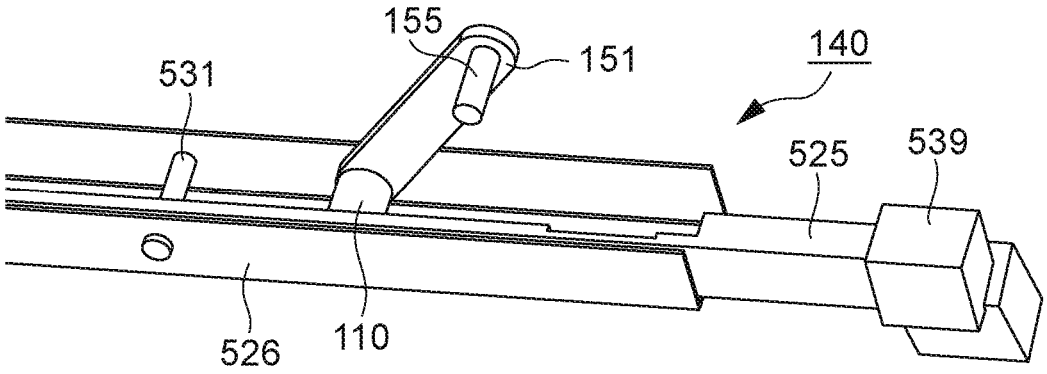
Figure 14A:
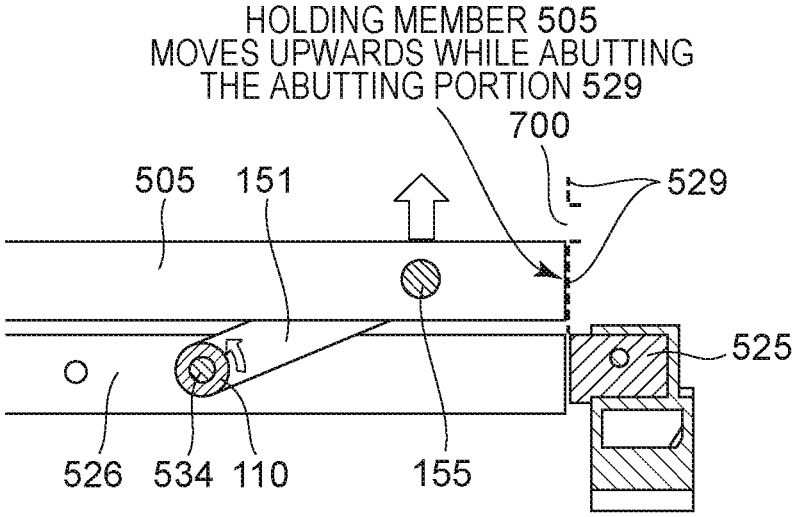
FIGS. 14A and 14B are diagrams describing a movement mechanism.
Figure 14B:
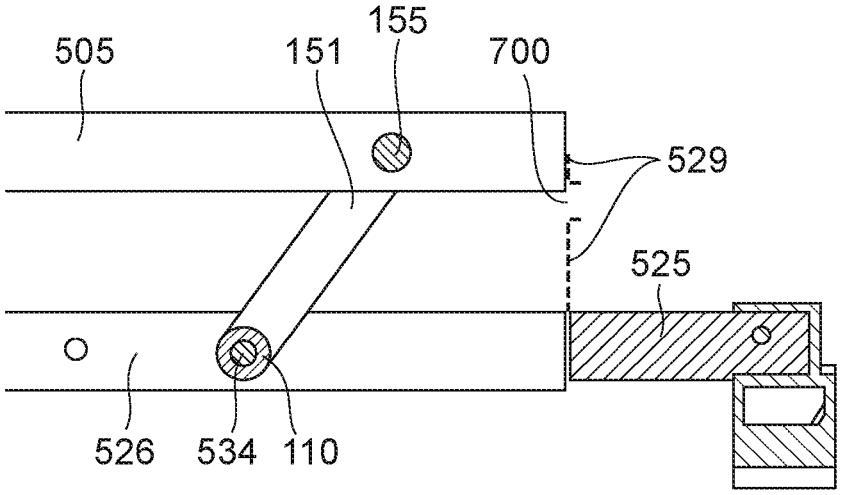

The link member 151 has a bearing 110 and a protrusion 155, as illustrated in FIGS. 13A and 13B. The link member 151 is disposed such that the protrusion 155 is situated on the downstream side from the bearing 110 in the direction of sliding movement of the sliding portion 525. Note that the direction of sliding movement as used here is the direction of sliding movement of the sliding portion 525 when moving the optical print head 105 from the retracted position toward the exposure position. The bearing 110 is provided at the one end side of the link member 151 in the longitudinal direction. The protrusion 155 also is, as illustrated in FIGS. 14A and 14B, provided on the other end side of the link member 151 in the longitudinal direction. The protrusion 155 is a cylindrical protrusion that is erected in the pivoting axis direction of the link member 151, and deforms a spring provided on the holding member 505 side of the optical print head 105. Note that the first moving portion is not restricted to being the protrusion 155, and may be a structure where the one end side in the longitudinal direction of the link member 151 is bent in the pivoting axis direction of the link member 151.

A circular hollowed space that extends in the left-and-right direction is formed in the bearing 110, as a hole. A fitting shaft portion 534 is provided to the sliding portion 525, as illustrated in FIGS. 14A and 14B. The fitting shaft portion 534 is a cylindrical protrusion erected from the sliding portion 525 toward the left. The hole of the bearing 110 is fit with the fitting shaft portion 534 so as to be capable of pivoting, thereby forming a first connecting portion. That is to say, the link member 151 is pivotable as to the sliding portion 525, with the first connecting portion as the center of pivoting. Note that an arrangement may be made where the fitting shaft portion 534 is formed on the link member 151 side, and the bearing 110 is formed on the sliding portion 525.

Note that a shaft the same as the support shaft 531 is provided at the rear side of the third support portion 526, a slot the same as the slot 691 is formed at the rear side of the sliding portion 525, and the structure of the rear side of the movement mechanism 140 is the same as the front side. The structure of the link member 152 also is the same as the link member 151. The connecting portion of the one end side in the longitudinal direction of the link member 152 and the sliding portion 525 make up the second connecting portion, corresponding to the first connecting portion.

The abutting portion 529 of the first support portion 527 (omitted from illustration in FIGS. 13A through 14B) is disposed further toward the front side as compared to the one end of the holding member 505. Accordingly, when the sliding portion 525 moves by sliding as to the third support portion 526 from the rear side to the front side, the bearing 110 to which the fitting shaft portion 534 is fit also moves by sliding as to the third support portion 526 toward the front side, along with the sliding portion 525. The holding member 505 to which the protrusion 155 is attached also attempts to move from the rear side to the front side in conjunction with this, but the one end of the holding member 505 is abutting the abutting portion 529, and accordingly movement toward the front side is restricted. The link member 151 is disposed intersecting the rotational axis direction of the photosensitive drum 103 such that the one end side having the protrusion 155 is situated closer to the drum unit 518 side as compared to the other end side having the bearing 110, and accordingly pivots in a counter-clockwise direction with the fitting shaft portion 534 as the center of pivoting, as viewed from the right side as illustrated in FIG. 14A. Accordingly, the holding member 505 moves from the retracted position toward the exposure position with the one end of the holding member 505 abutting the abutting portion 529.

On the other hand, when the sliding portion 525 moves by sliding as to the third support portion 526 from the front side to the rear side, the bearing 110 fit to the fitting shaft portion 534 moves by sliding as to the third support portion 526 from the rear side to the front side, along with the sliding portion 525. Accordingly, the link member 151 pivots in a clockwise direction with the fitting shaft portion 534 as the center of pivoting, as viewed from the right side as illustrated in FIG. 14A. Thus, the protrusion 155 moves in a direction from the exposure position toward the retracted position. The sliding portion 525 moves from the rear side to the front side in conjunction with a closing operation of the cover 558, and moves from the front side to the rear side in conjunction with an opening operation of the cover 558, which will be described in detail later. That is to say, when the cover 558 moves from an opened state to a closed state, the holding member 505 moves in a direction from the retracted position toward the exposure position, and when the cover 558 moves from the closed state to the opened state, the holding member 505 moves in a direction from the exposure position toward the retracted position.

The mechanism for moving the optical print head 105 is not restricted to the movement mechanism 140 and movement mechanism 640. A movement mechanism 840 illustrated in FIGS. 15A1 through 15B may be used. The movement mechanism 840 will be described below with reference to FIGS. 15A1 through 15B. Note that members having substantially the same functions as members making up the movement mechanism 140 (640) are denoted by the same reference numerals, and redundant description may be omitted.

FIGS. 15A1 and 15A2 illustrate the movement mechanism 840. The movement mechanism 840 includes a first link mechanism 858, a second link mechanism 859, sliding portion 825, and the third support portion 526, as illustrated in FIGS. 15A1 and 15A2. The first link mechanism 858 includes a link member 843 and a link member 844, and the second link mechanism 859 includes a link member 845 and a link member 846. The link member 843 and link member 844, and the link member 845 and link member 846, each pivotably intersect each other, making up an X-shaped link mechanism as illustrated in FIGS. 15A1 through 15B. A protrusion 847 of the link member 843, a protrusion 848 of the link member 844, a protrusion 849 of the link member 845, and a protrusion 850 of the link member 846, are each pivotably attached to a holding member 805 that is omitted from illustration. When a sliding portion 825 is moved by sliding in the direction of the arrow A in FIG. 15A1, the link members 843 through 846 pivot with regard to the sliding portion 825, and the protrusions 847 through 850 move downwards (FIG. 15A2). On the other hand, when the sliding portion 825 is moved by sliding in the direction of the arrow B in FIG. 15A2, the link members 843 through 846 pivot with regard to the sliding portion 825, and the protrusions 847 through 850 move upwards (FIG. 15A1).

FIG. 15B is a diagram illustrating the front side of the movement mechanism 840 with the front side of the holding member 805. The arrangement by which the movement mechanism 840 moves the holding member 805 will be described below with reference to FIG. 15B. Now, the first link mechanism 858 and second link mechanism 859 are substantially the same, so the first link mechanism 858 will be described here with reference to FIG. 15B. The first link mechanism 858 has the link member 843 and link member 844. The link member 843 and link member 844 making up the first link mechanism 858 are single members, but may be configured by combining multiple members.

The movement mechanism 840 in FIG. 15B has the first link mechanism 858 and sliding portion 825. The sliding portion 825 has a slot 863 that is an elongated opening, passing through the sliding portion 825 in the left-and-right direction and extending in the front-and-rear direction.

The link member 843 has a protrusion 810, the protrusion 847, and the connecting shaft portion 538. The protrusion 810 is provided to one end side in the longitudinal direction of the link member 843. The protrusion 847 is a cylindrical protrusion erected to the right side in the pivoting axial direction of the link member 843, provided to the other end side in the longitudinal direction of the link member 843. The connecting shaft portion 538 is provided between the protrusion 810 and protrusion 847 in the longitudinal direction of the link member 843. Although the protrusion 847 serves as a first moving portion, the first moving portion is not restricted to the protrusion 847, and may be a structure where one end side in the longitudinal direction of the link member 843 is bent in the pivoting axis direction.

The protrusion 810 is pivotably loosely fit to the slot 863 of the sliding portion 825, thereby forming the first connecting portion. That is to say, the link member 843 is pivotable as to the sliding portion 825 with the first connecting portion as the center of pivoting. The protrusion 810 is capable of moving in the slot 863 in the front-and-rear direction within the range of the slot 863 in the front-and-rear direction (within the opening). A coil spring 860 is disposed between the rear-side edge of the slot 863 and the protrusion 810.

The link member 844 has the connecting shaft portion 530 and the protrusion 848. The connecting shaft portion 530 is provided to one end side in the longitudinal direction of the link member 844. The connecting shaft portion 530 is a cylindrical protrusion erected from the link member 844 to the right side in FIG. 15B. The connecting shaft portion 530 is pivotably inserted into a hole formed in the third support portion 526, thereby forming the third connecting portion. Now, the connecting shaft portion 530 may be formed on the third support portion 526 rather than the link member 844. That is to say, the connecting shaft portion 530 formed on the third support portion 526 may be inserted into a hole formed in the link member 844.

The protrusion 848 is a cylindrical protrusion provided to the other end side in the longitudinal direction of the link member 844, erected to the right side in the pivoting axis direction of the link member 844. A circular hole that extends in the left-and-right direction in FIG. 15B is formed between the protrusion 848 of the link member 844 and the third connecting portion. The connecting shaft portion 538 of the link member 843 is pivotably inserted into this hole, whereby the connecting shaft portion 538 and the hole of the link member 844 make up the fourth connecting portion. That is to say, the link member 844 is capable of pivoting as to the third support portion 526 with the third connecting portion as a center of pivoting, and is capable of pivoting as to the link member 843 with the fourth connecting portion as a center of pivoting. Now, the connecting shaft portion 538 may be formed on the link member 844 rather than the link member 843. That is to say, the connecting shaft portion 538 formed on the link member 844 may be inserted into a hole formed in the link member 843. Note that one of the link member 843 and link member 844 may be omitted from the embodiment regarding the movement mechanism 840.

The holding member 805 has the lens array 506, a link attaching portion 851, a link attaching portion 852, and a pin attaching portion 855. The link attaching portion 851 and link attaching portion 852 both are provided between pins 514 attached to the lens array 506 and holding member 805. Although omitted from illustration, a link attaching portion 853 and link attaching portion 854 to which the link member 859 and link member 846 making up the second link mechanism 859 are attached are both provided between pins 515 attached to the other end side of the lens array 506 and holding member 805. The link attaching portion 851 is a hole formed to the holding member 805 between the lens array 506 and pin attaching portion 855, passing through in the left-and-right direction. The link attaching portion 852 is a slot that is formed in the holding member 805 between the lens array 506 and the link attaching portion 851, and that passes through in the left-and-right direction and extends in the front-and-rear direction.

The protrusion 847 of the link member 843 is pivotably attached to the link attaching portion 851, and the protrusion 848 of the link member 844 is pivotably attached to the link attaching portion 852. The protrusion 848 is attached to the link attaching portion 851 so as to be capable of moving in the front-and-rear direction. Accordingly, the link member 844 is capable of moving by sliding in the front-and-rear direction within the range of the link attaching portion 852 in the front-and-rear direction, while pivoting with the protrusion 848 as a center of pivoting.

According to the above-described configuration, when the sliding portion 825 moves by sliding from the front side to the rear side as to the third support portion 526, the protrusion 810 moves by sliding from the front side to the rear slide as to the third support portion 526 along with the sliding portion 825. Accordingly, when viewing the first link mechanism 858 from the right side as illustrated in FIG. 15A1, the protrusion 848 moves from the front side to the rear side at the link attaching portion 852 with the link member 843 pivoting clockwise with the protrusion 810 as the center of pivoting and the link member 844 pivoting counter-clockwise with the connecting shaft portion 530 as the center of pivoting. Accordingly, the protrusion 847 and protrusion 848 move in the direction from the exposure position toward the retracted position.

On the other hand, when the sliding portion 825 moves by sliding from the rear side to the front side as to the third support portion 526, the protrusion 810 moves by sliding from the rear side to the front slide as to the third support portion 526 along with the sliding portion 825. Accordingly, when viewing the first link mechanism 858 from the right side as illustrated in FIG. 15A2, the protrusion 848 moves from the rear side to the front side at the link attaching portion 852 with the link member 843 pivoting counter-clockwise with the protrusion 810 as the center of pivoting and the link member 844 pivoting clockwise with the connecting shaft portion 530 as the center of pivoting. Accordingly, the protrusion 847 and protrusion 848 move from the retracted position toward the exposure position. When the sliding portion 825 further moves by sliding to the front side in a state where the abutting pin 514 is in contact with an abutting face 550, as illustrated in FIG. 15B, the coil spring 860 is compressed between the rear side edge of the slot 863 and the protrusion 810. The protrusion 810 is biased to the front side by the restoration force of the compressed coil spring 860. Accordingly, biasing force heading upwards is applied to the holding member 805.

A configuration may be made where the front-and-rear directions of the first link mechanism 858 and second link mechanism 859 are opposite, so that when the sliding portion 825 is moved by sliding from the front side toward the rear side, the optical print head 105 moves from the retracted position toward the exposure position, and when the sliding portion 825 is moved by sliding from the rear side toward the front side, the optical print head 105 moves from the exposure position toward the retracted position. In this case, the later-described cover 558 presses the sliding portion 825 from the front side toward the rear side when moving from an opened state to a closed state, and pulls the sliding portion 825 from the rear side toward the front side when moving from a closed state to an opened state.

Next, the cover 558 will be described with reference to FIGS. 16A through 16C. The cover 558 is a member for causing the sliding portion 525 to move by sliding as described above. Note that the configuration causing the sliding portion 525 to move by sliding is not restricted to the cover 558. For example, a configuration may be made where the sliding portion 525 moves by sliding in conjunction with opening/closing of an unshown front door. Alternatively, a configuration may be made where the sliding portion 525 moves by sliding in conjunction with turning of a turning member such as a lever or the like, rather than a covering member such as the cover 558 or a door.

Figure 16A:
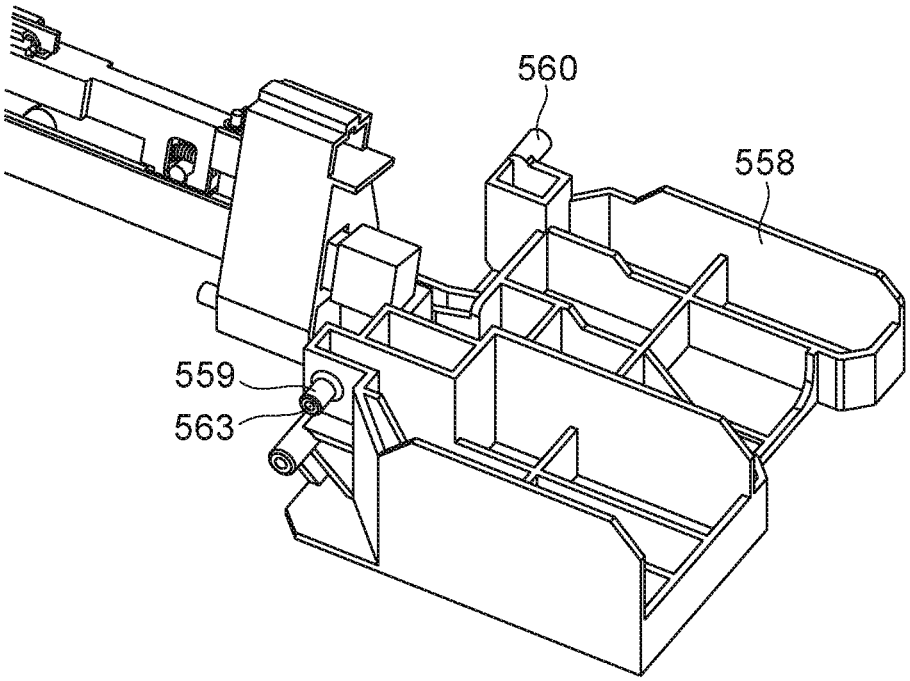
FIG. 16A through 16C are perspective views of a cover.

FIG. 16A is a perspective view of the cover 558. The cover 558 has a pivoting shaft portion 559 and a pivoting shaft portion 560, as illustrated in FIG. 16A. The pivoting shaft portion 559 is a cylindrical protrusion protruding in the right-side direction of the cover 558, while the pivoting shaft portion 560 is a cylindrical protrusion protruding in the left-side direction of the cover 558.

Figure 16B:
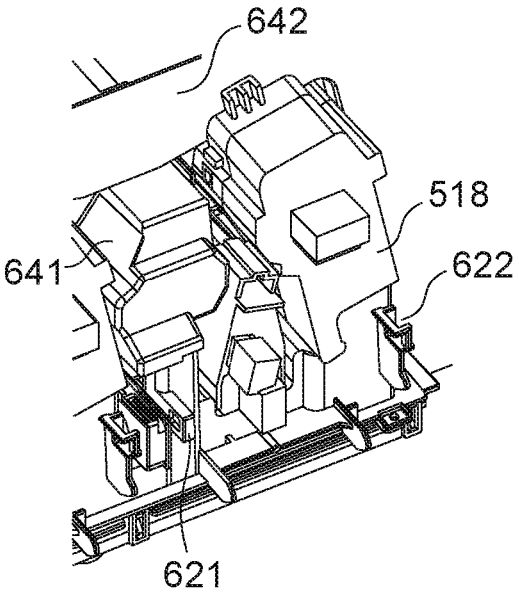
Figure 16C:
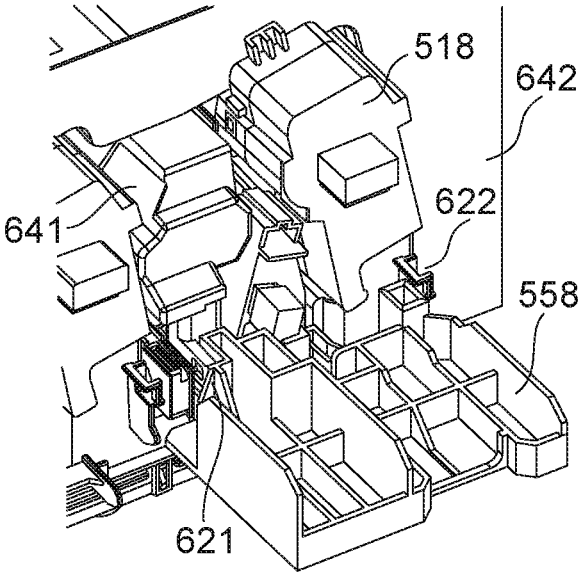

FIG. 16B is an enlarged view of the portion where the cover 558 is attached to the front-side plate 642. FIG. 16C is a perspective view of the cover 558 that has been attached to the front-side plate 642. The front-side plate 642 has a bearing member 621 to which the pivoting shaft portion 559 of the cover 558 fits, and a bearing member 622 to which the pivoting shaft portion 560 fits, as illustrated in FIG. 16B. The pivoting shaft portion 559 of the cover 558 pivotably fits to the bearing member 621 of the front-side plate 642, and the pivoting shaft portion 560 pivotably fits to the bearing member 622 of the front-side plate 642, as illustrated in FIG. 16C. The pivoting axis of the pivoting shaft portion 559 and the pivoting axis of the pivoting shaft portion 560 are on the same axial line (pivoting axis 563), as illustrated in FIG. 16A. This pivoting axis 563 is situated below the rotational axis line of the photosensitive drum 103 in the vertical direction. The cover 558 pivots as to the main body of the image forming apparatus 1, with the pivoting axis 563 as the center of pivoting, and is capable of opening/closing. The cover 558 moves between a closed state (closed position) to close the conveyance path for replacing the drum unit 518 and developing unit 641, and an opened state (opened position) opened to secure the conveyance path. Accordingly, when the cover 558 is in a closed state, replacement of the drum unit 518 and developing unit 641 cannot be performed by the worker. The worker can replace the drum unit 518 by opening the cover 558, and closes the cover 558 when the work is completed.

Figure 17A:
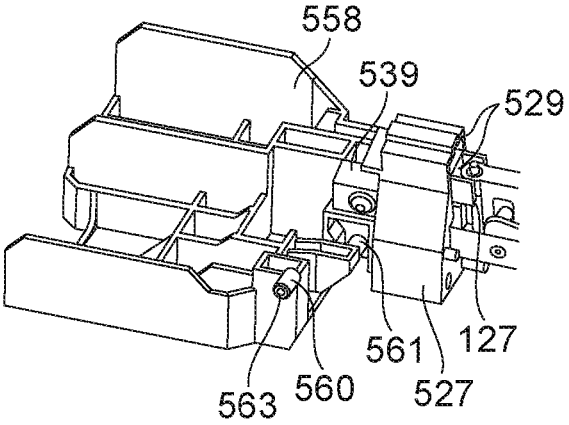
FIGS. 17A through 17D are perspective views of a cover, for description of operations when the cover is closed.
Figure 17B:
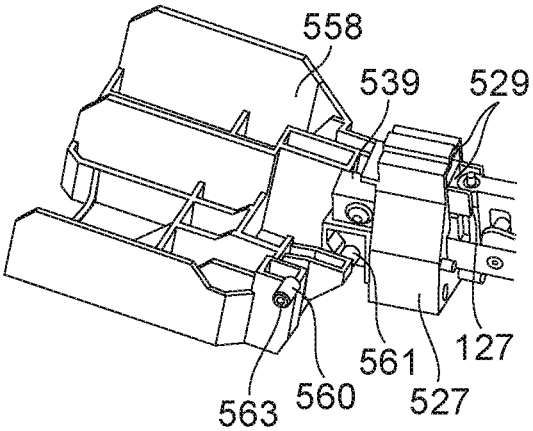

Next, the configuration by which the sliding portion 525 moves by sliding in the pivoting axial line direction of the photosensitive drum 103 in conjunction with opening/closing operations of the cover 558 (pivoting member) will be described with reference to FIGS. 17A through 20D. FIGS. 17A through 17D are perspective diagrams illustrating the cover 558 pivoting from an opened state toward a closed state. FIGS. 18A through 18D are cross-sectional views illustrating the cover 558 pivoting from the opened state toward the closed state. FIGS. 17A and 18A illustrate the opened state of the cover 558. FIGS. 17D and 18D illustrate the closed state of the cover 558. FIGS. 17B and 18B, and FIGS. 17C and 18C, are diagrams illustrating the cover 558 transitioning from the opened state to the closed state. Note that the closed state of the cover 558 in the closed state illustrated in FIGS. 17D and 18D is maintained by a snap fit mechanism for engaging to the main body, a stopper for preventing pivoting, or the like.

The cover 558 pivots as to the main body of the image forming apparatus 1, centered on the pivoting axis 563, as illustrated in FIGS. 17A through 17D. The cover 558 has the pressing member 561 (pressing portion) that moves around the pivoting axis 563, and the lower side from the pivoting axis 563. The pressing member 561 is a cylindrical protrusion for example, protruding from the left side toward the right side of the cover 558, and is situated at the accommodation space 562 provided to one end of the sliding portion 525. The pressing member 561 moves over part of a circle (movement path 564) centered on the pivoting axis 563 in accordance with pivoting of the cover 558, as illustrated in FIGS. 18A through 18D. When the cover 558 is in an opened state, the pressing member 561 is situated further toward the rear side than the pivoting axis 563, and when the cover 558 is in an opened state, the pressing member 561 is situated further toward the front side than the pivoting axis 563. The position of the pressing member 561 when the cover 558 is in the closed state is closer to the photosensitive drum 103 side than the position of the pressing member 561 when the cover 558 is in the opened state.

Figure 18A:
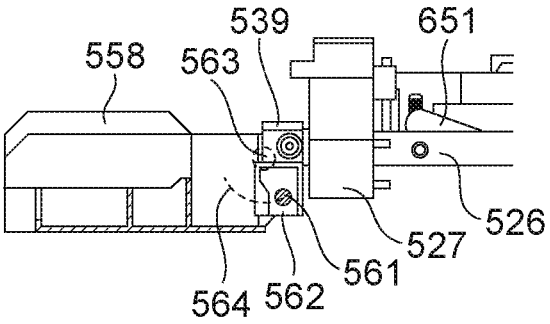
FIGS. 18A through 18D are perspective views of a cover, for description of operations when the cover is closed.
Figure 18B:
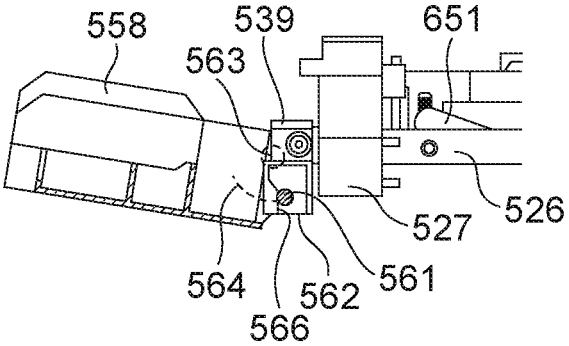
Figure 18C:
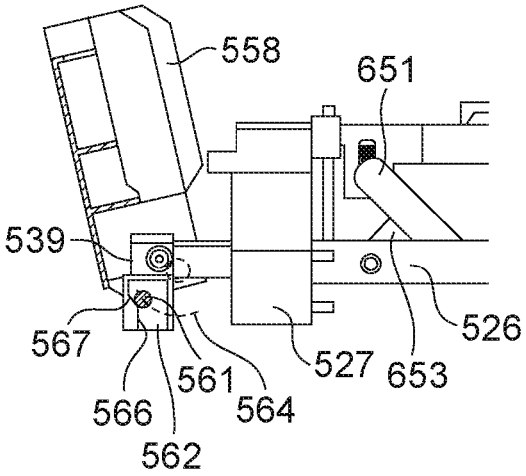

The slide aiding member 539 is attached to one end side of the sliding portion 525, as illustrated in FIGS. 18A through 18D. The accommodation space 562 where the later-described pressing member 561 is accommodated is formed in the slide aiding member 539. The slide aiding member 539 also includes a first pressed portion 566, second pressed portion 567, and third pressed portion 569. In a case where the optical print head 105 is in the retracted position, the first pressed portion 566 is situated on the movement path 564, and the second pressed portion 567 is provided adjacent to the first pressed portion 566 to the downstream side (front side) of the first pressed portion 566 in the direction following the movement path 564, as illustrated in FIG. 18A. The third pressed portion 569 is situated to the upper side of the second pressed portion 567 at the downstream side (front side). The shape of the second pressed portion 567 is a shape that matches part of a circle centered on the pivoting axis 563 in a case where the pressing member 561 is on the second pressed portion 567, as illustrated in FIG. 18C. At this time, the curvature of the circle of which the radius is the distance from the pivoting axis 563 to the second pressed portion 567 with the pivoting axis 563 as the center thereof is equal to the curvature of the movement path 564. Note that the second pressed portion 567 does not need to be a shape strictly following the movement path 564. For example, a shape generally following a tangential line of which the point of tangent is a point on the movement path 564 that is closest to the boundary portion between the first pressed portion 566 and second pressed portion 567 (an inclined face inclining to the photosensitive drum 103 from the rear side toward the front side) will suffice. From a state where the pressing member 561 abuts the first pressed portion 566, the pressing member 561 sequentially moves from above the first pressed portion 566, to above the second pressed portion 567, and above a fourth pressed portion 568, in conjunction with the cover 558 having moved from the opened state toward the closed state.

Operations of the pressing member 561 as to the sliding portion 525 will be described with reference to FIGS. 18A through 18D. When the cover 558 is in the state in FIG. 18A (opened state), the optical print head 105 is situated at the retracted position, and the pressing member 561 is situated at the other end side as compared to the first pressed portion 566 and second pressed portion 567. When the cover 558 pivots in the clockwise direction from the state in FIG. 18A, the pressing member 561 abuts the first pressed portion 566 situated on the movement path 564 (FIG. 18B). Upon the cover 558 further pivoting in the clockwise direction from this state, the pressing member 561 presses the first pressed portion 566 to the front side. Accordingly, the slide aiding member 539 moves to the front side. The slide aiding member 539 is fixed to the sliding portion 525, so the sliding portion 525 also moves by sliding to the front side along with the movement of the slide aiding member 539. Ideally, the first pressed portion 566 is perpendicular to the rotational axis of the photosensitive drum 103 at this time, in order to maximize the amount of movement of the sliding portion 525 as to the amount of pivoting of the cover 558. However, this does not need to be strictly perpendicular, and may be inclined toward the front side by around 0 to 100 from the perpendicular direction, for example.

When the cover 558 further pivots in the clockwise direction, the pressing member 561 moves from above the first pressed portion 566 to above the second pressed portion 567 (FIG. 18C). The second pressed portion 567 has a shape following the movement path 564 of the pressing member 561, so in a case of the cover 558 further pivoting in the clockwise direction from the state in FIG. 18C, the pressing member 561 moves upwards in contact with the second pressed portion 567, but the pressing member 561 does not impart force to further move the slide aiding member 539 toward the front side by sliding. That is to say, the sliding portion 525 maintains a stopped state, without moving in conjunction with the pivoting of the cover 558. When the cover 558 is in the state in FIG. 18C (closed state), the optical print head 105 is situated at the exposure position, and the pressing member 561 is situated further toward the side of the rotational axis of the photosensitive drum 103, which is further toward the one end side as compared to the first pressed portion 566.

Figure 17C:
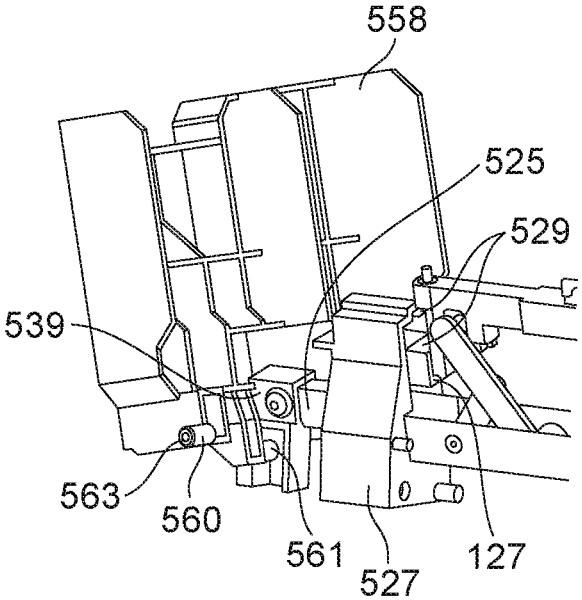
Figure 17D:
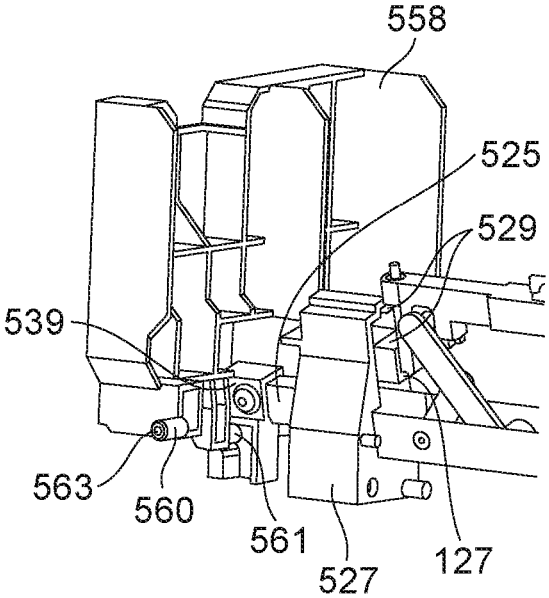
Figure 18D:
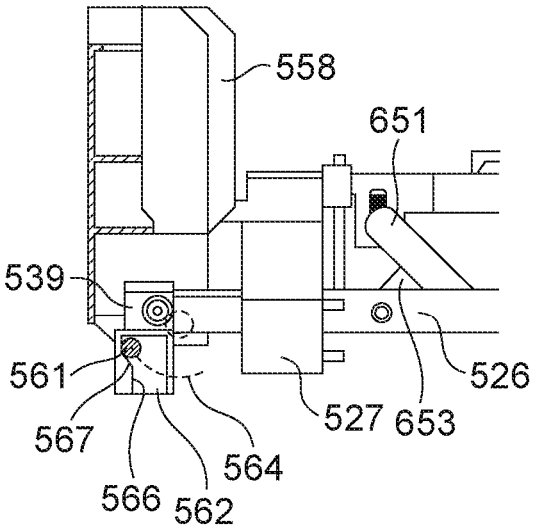

It can be seen from FIGS. 17C and 18C that when the cover 558 pivots from the opened state toward the closed state, the pressing member 561 abuts the second pressed portion 567 of the accommodation space 562 immediately after the holding member 505 has reached the exposure position. In a case of further pivoting the cover 558 from the state in FIG. 18C in the clockwise direction, the pressing member 561 moves sliding over the second pressed portion 567 that it abuts. In a state where the pressing member 561 abuts the second pressed portion 567, the distance between the movement path 564 and the second pressed portion 567 is equal regardless of the position of the pressing member 561. Accordingly, even if the cover 558 pivots, force to move the slide aiding member 539 further toward the front side by sliding is not imparted from the pressing member 561 to the second pressed portion 567. Accordingly, the slide aiding member 539 does not move from the rear side toward the front side while the pressing member 561 is moving over the second pressed portion 567. Also, the sliding portion 525 tries to move from the front side toward the rear side by sliding, due to the deadweight of the holding member 505 and so forth, but the pressing member 561 has abutted the second pressed portion 567 from the rear side toward the front side, so the sliding portion 525 cannot move from the front side toward the rear side. That is to say, the movement mechanism 640 according to the present embodiment is configured such that when the cover 558 pivots in a state where the pressing member 561 is abutting the first pressed portion 566, the sliding portion 525 moves by sliding in conjunction with the movement of the pressing member 561, but the sliding portion 525 does not move by sliding even if the cover 558 pivots in a state where the pressing member 561 is abutting the second pressed portion 567. By further pivoting the cover 558 from the state in FIG. 18C in the clockwise direction, the pressing member 561 moves to above the third pressed portion 569, and the cover 558 reaches the closed state illustrated in FIG. 18D.

According to this arrangement, the amount of movement of the sliding portion 525 in the front-and-back direction in a case where the pressing member 561 is in contact with (or pressing) the second pressed portion 567 as to the amount of moment of the pressing member 561 in the front-and-back direction can be made to be smaller than the amount of movement of the sliding portion 525 in the front-and-back direction as to the amount of movement of the pressing member 561 in the front-and-back direction in a case where the pressing member 561 is pressing the first pressed portion 566. That is to say, the amount of movement of the protrusion 655 in the vertical direction as to the amount of movement of the pressing member 561 in the front-and-back direction in a case where the pressing member 561 is in contact with (or pressing) the second pressed portion 567 can be made to be smaller than the amount of movement of the protrusion 655 in the vertical direction as to the amount of movement of the pressing member 561 in the front-and-back direction in a case where the pressing member 561 is pressing the first pressed portion 566.

Figure 19A:
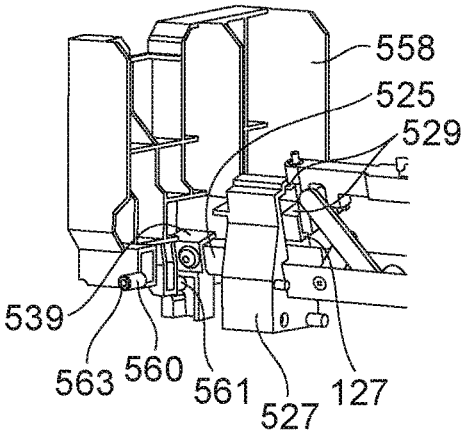
FIGS. 19A through 19D are perspective views of a cover, for description of operations when the cover is opened.
Figure 19B:
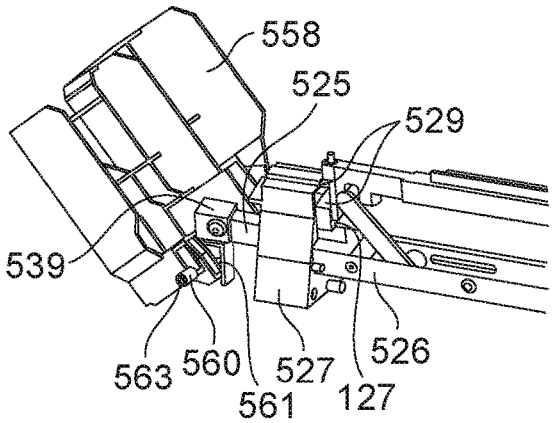
Figure 19C:
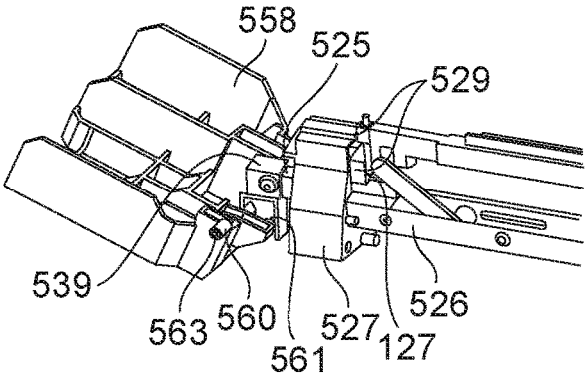
Figure 19D:
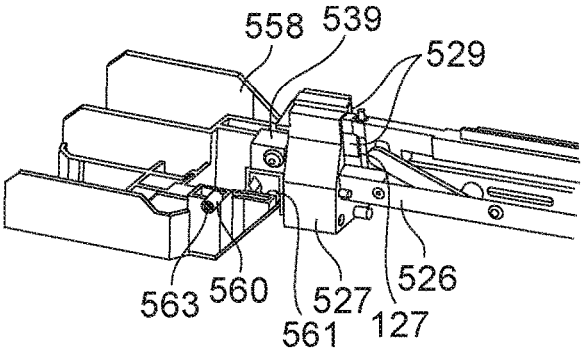
Figure 20A:
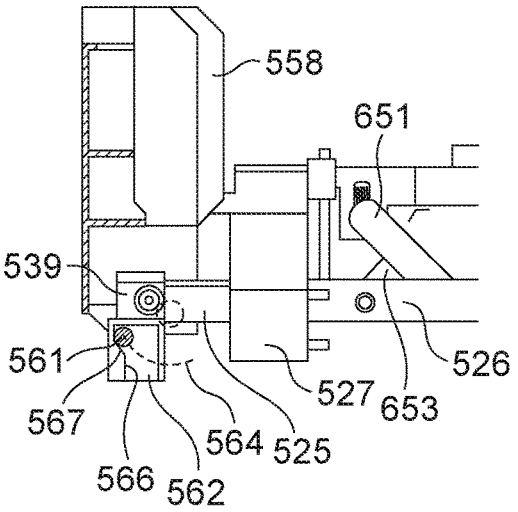
FIGS. 20A through 20D are side views of a cover, for description of operations when the cover is opened.

FIGS. 19A through 19D are perspective diagrams illustrating the cover 558 pivoting from the closed state toward the opened state. FIGS. 20A through 20D are cross-sectional views illustrating the cover 558 pivoting from the closed state toward the opened state. FIGS. 19A and 20A illustrate the closed state of the cover 558. FIGS. 19D and 20D illustrate the opened state of the cover 558. FIGS. 19B and 20B, and FIGS. 19C and 20C, are diagrams illustrating the cover 558 transitioning from the closed state to the opened state.

In the closed state of the cover 558 illustrated in FIG. 20A, force is placed on the sliding portion 525 via the first link mechanism 861 and second link mechanism 862 to slide from the front side toward the rear side, by the deadweight of the optical print head 105 and the restoring force of later-described springs. However, the cover 558 in the closed state is fixed to the main body of the image forming apparatus 1 so that the cover 558 does not pivot, and the pressing member 561 restricts movement of the slide aiding member 539 to the rear side, so the sliding portion 525 does not move by sliding to the rear side.

The slide aiding member 539 has the fourth pressed portion 568, as illustrated in FIGS. 20A through 20D. The fourth pressed portion 568 is provided to the rear side from the pressing member 561 on the movement path 564, and faces the first pressed portion 566. Although the fourth pressed portion 568 is perpendicular to the rotational axis of the photosensitive drum 103 in the present embodiment, this does not need to be strictly perpendicular, and may be inclined toward the front side or the rear side by around 0 to 10° from the perpendicular direction, for example.

Figure 20B:
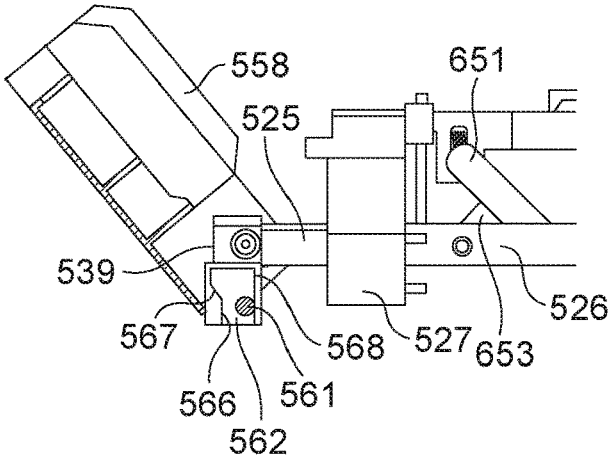
Figure 20C:
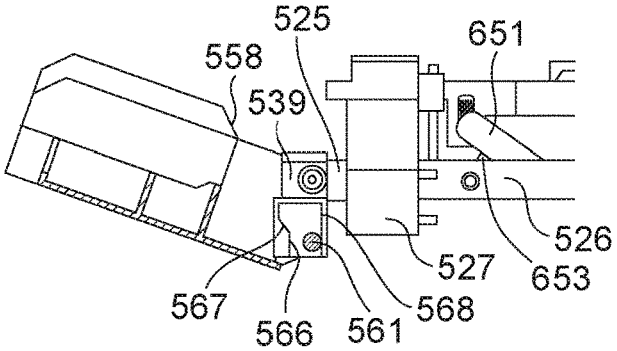
Figure 20D:
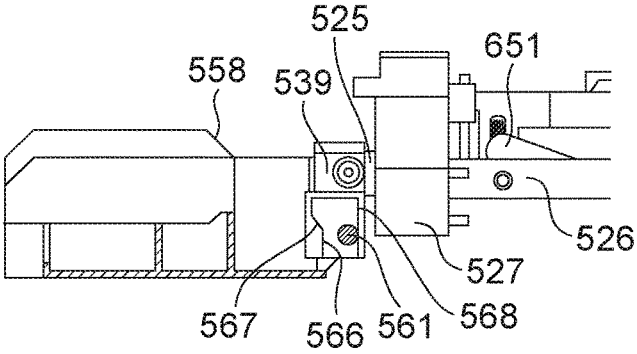

When the cover 558 pivots in the counter-clockwise direction from the state in FIG. 20A, the pressing member 561 abuts the fourth pressed portion 568, as illustrated in FIG. 20B. Upon the cover 558 further pivoting in the counter-clockwise direction from the state in FIG. 20B, the pressing member 561 presses the fourth pressed portion 568 from the front side toward the rear side as illustrated in FIGS. 20B and 20C, and the sliding portion 525 moves toward the rear side. Thereafter, further pivoting of the cover 558 in the counter-clockwise direction brings the cover 558 to the opened state as illustrated in FIG. 20D.

The mechanism where the pressing member 561 presses the fourth pressed portion 568 is provided from the following reason. That is to say, a case can be conceived where the sliding portion 525 does not move to the rear side even if restriction on movement of the slide aiding member 539 by the pressing member 561 is released by the cover 558 being pivoted in the counter-clockwise direction from the state in FIG. 19A, if frictional force among the link members, frictional force between the link member 651 or link member 653 and the sliding portion 525, and frictional force between the link member 652 or link member 654 and the third support portion 526, are great. That is to say, a case can be conceived where the sliding portion 525 does not move by sliding even though the cover 558 has been opened. In order to deal with this, the movement mechanism according to the present embodiment includes the mechanism where the pressing member 561 presses the fourth pressed portion 568, so that opening the cover 558 causes the sliding portion 525 to move toward the rear side. According to the configuration described above, a worker performing maintenance opening and closing the cover 558 causes the sliding portion 525 to move by sliding with regard to the third support portion 526, in conjunction with movement of the cover 558.

Note that a member for moving the sliding portion 525 by sliding is not restricted to the cover 558, and a lever may be used. In this case, this lever may be integrally structured with a cover pivotably attached to the main body of the image forming apparatus 1, so that the level moves in conjunction with a worker who performs maintenance opening/closing the cover. Also, although the first pressed portion 566, second pressed portion 567, and fourth pressed portion 568 in the present embodiment are faces which the pressing member 561 comes into contact with, the structures thereof are not restricted to planar forms, and may be linear forms.

Figure 21A:
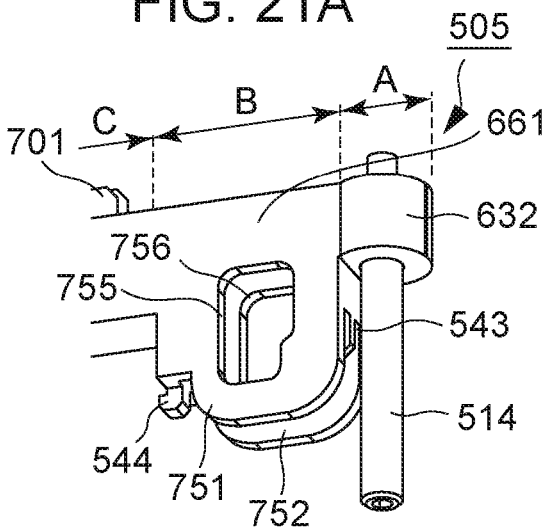
FIGS. 21A through 21D are perspective views for describing the structure of both ends of a holding member.
Figure 21B:
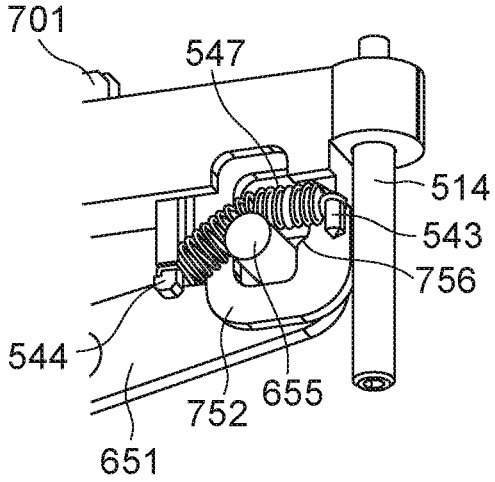
Figure 21C:
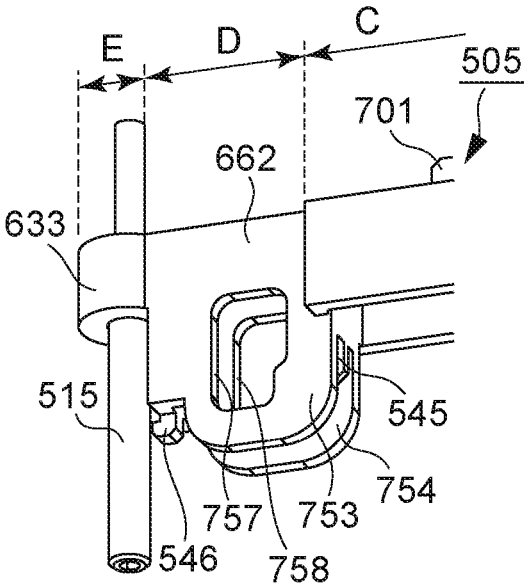
Figure 21D:
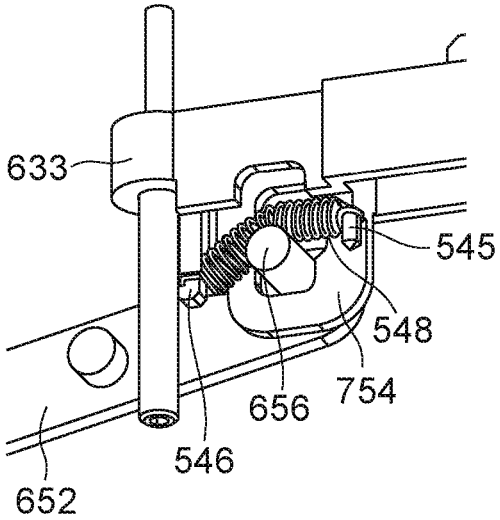

Next, a connection mechanism between the holding member 505 and the link member 651 will be described. FIGS. 21A and 21C are perspective views illustrating the one end side of the holding member 505 in the front-and-rear direction. FIGS. 21B and 21D are perspective views illustrating the other end side of the holding member 505 in the front-and-rear direction.

The holding member 505 is provided with the lens attaching portion 701 to which the lens array 506 is attached, the spring attaching portion 661 to which a coil spring 547 is attached, the spring attaching portion 662 to which a coil spring 548 is attached, the pin attaching portion 632 to which the abutting pin 514 is attached, and the pin attaching portion 633 to which the abutting pin 515 is attached, as illustrated in FIG. 21A. The holding member 505 is a resin molded article where the lens attaching portion 701, circuit board attaching portion 702 (omitted from illustration), spring attaching portion 661, and spring attaching portion 662, have been integrally molded by injection molding. The spring attaching portion 661 is disposed to the one end side of the lens attaching portion 701 in the front-and-rear direction, and the pin attaching portion 632 is disposed further to the end side of the spring attaching portion 661 in the holding member 505. The spring attaching portion 662 is disposed to the other end side of the lens attaching portion 701 in the front-and-rear direction, and the pin attaching portion 632 is disposed further to the other end side of the spring attaching portion 662 in the holding member 505. The places where the lens attaching portion 701, spring attaching portion 661, and pin attaching portion 632 are formed in the holding member 505 are region C, region B, and region A in FIG. 21A. The holding member 505 is subjected to upwards biasing force from below, by the protrusion 155 of the link member 651 via the coil spring 547, at a position to the front side of the lens array 506 but to the rear side of the abutting pin 514. Also, the places where the lens attaching portion 701, spring attaching portion 662, and pin attaching portion 633 are formed in the holding member 505 are region C, region D, and region E in FIG. 21C. Biasing force is applied to the holding member 505 from the lower side toward the upper side by the protrusion 156 of the link member 652 via the coil spring 548, at a position to the rear side from the lens array 506 but to the front side from the abutting pin 515.

First, description will be made regarding the spring attaching portion 661. The spring attaching portion 661 includes a first wall portion 751, a second wall portion 752, a first engaging portion 543, and a second engaging portion 544. The first wall portion 751 is disposed to the one side of the holding member 505 in the left-and-right direction, and the second wall portion 752 is disposed to the other side of the holding member 505 in the left-and-right direction. The first wall portion 751 and second wall portion 752 are disposed to both left and right sides of the abutting pin 514, in the present embodiment. The first wall portion 751 and second wall portion 752 each have an inner wall face facing each other, as illustrated in FIG. 21A. An opening 755 is formed in the first wall portion 751, and an opening 756 is formed in the second wall portion 752. The opening 755 and the opening 756 are slots extending in the vertical direction. The protrusion 155 is inserted to the opening 755 and opening 756. The protrusion 155 is not fit to the opening 755 and opening 756, and is inserted with a gap of around 0.5 mm even at the narrowest place in the front-and-rear direction. Accordingly, the direction of movement of the protrusion 155 is guided in the vertical direction by the opening 755 and opening 756, without any great frictional force being applied by the inner wall faces of the opening 755 and opening 756.

FIG. 21B is a diagram where the first wall portion 751 has been omitted from illustration in FIG. 21A. The first engaging portion 543 (first attaching portion) and second engaging portion 544 (first attaching portion) are disposed between the first wall portion 751 and second wall portion 752 in the left-and-right direction (one pair of first attaching portions). The first engaging portion 543 and second engaging portion 544 also are respectively disposed on the front side and rear side of the opening 755 and opening 756 in the front-and-rear direction. The first engaging portion 543 is disposed further toward the front side of the holding member 505 than the second engaging portion 544 in the present embodiment. The first engaging portion 543 and second engaging portion 544 are protrusions that protrude downwards from connecting portions connecting the first wall portion 751 and second wall portion 752 of the holding member 505. One end side of the coil spring 547 in the longitudinal direction of the coil spring 547 is engaged with the first engaging portion 543, and the other end side of the coil spring 547 in the longitudinal direction of the coil spring 547 is engaged with the second engaging portion 544. The first engaging portion 543 and second engaging portion 544 are disposed at the spring attaching portion 661 such that the coil spring 547 that is engaged at the first engaging portion 543 and second engaging portion 544 traverses the opening 755 and opening 756.

The first engaging portion 543 and second engaging portion 544 are disposed at positions that are different from each other in the vertical direction. The first engaging portion 543 is disposed closer to the photosensitive drum 103 side than the second engaging portion 544 in the present embodiment. Note that an arrangement may be made where the first engaging portion 543 and second engaging portion 544 are provided at positions to be generally the same height in the vertical direction, and the second engaging portion 544 may be disposed closer to the photosensitive drum 103 side than the first engaging portion 543.

The protrusion 155 is inserted to the opening 756 of the second wall portion 752 from the outer wall face side thereof, passes beneath the coil spring 547 strung between the first engaging portion 543 and second engaging portion 544, and is inserted into the opening 755 of the first wall portion 751, as illustrated in FIG. 21B.

Next, description will be made regarding the spring attaching portion 662. The spring attaching portion 662 includes a third wall portion 753, a fourth wall portion 754, a third engaging portion 545 (second attaching portion), and a fourth engaging portion 546 (second attaching portion) (a pair of second attaching portions), as illustrated in FIG. 21C. The third wall portion 753 is disposed to the one side of the holding member 505 in the left-and-right direction, and the fourth wall portion 754 is disposed to the other side of the holding member 505 in the left-and-right direction. The third wall portion 753 and fourth wall portion 754 are disposed to both right and left sides of the abutting pin 515, in the present embodiment. The first wall portion 751 and the third wall portion 753 are disposed on the same side in the left-and-right direction, i.e., the first wall portion 751 and the third wall portion 753 are disposed on the right side of the holding member 505 in the left-and-right direction. The second wall portion 752 and the fourth wall portion 754 are disposed on the same side in the left-and-right direction, i.e., the second wall portion 752 and the fourth wall portion 754 are disposed on the left side of the holding member 505 in the left-and-right direction.

The third wall portion 753 and fourth wall portion 754 each have an inner wall face facing each other, as illustrated in FIG. 21C. An opening 757 is formed in the third wall portion 753, and an opening 758 is formed in the fourth wall portion 754. The opening 757 and the opening 758 are slots extending in the vertical direction. The protrusion 156 is inserted to the opening 757 and opening 758. The protrusion 156 is not fit to the opening 757 and opening 758, and is inserted with a gap of around 0.5 mm even at the narrowest place in the front-and-rear direction. Accordingly, the direction of movement of the protrusion 156 is guided in the vertical direction by the opening 757 and opening 758, without any great frictional force being applied by the inner wall faces of the opening 757 and opening 758.

FIG. 21D is a diagram where the third wall portion 753 has been omitted from illustration in FIG. 21C. The third engaging portion 545 and fourth engaging portion 546 are disposed between the third wall portion 753 and fourth wall portion 754 in the left-and-right direction. The third engaging portion 545 and fourth engaging portion 546 also are respectively disposed on the front side and rear side of the opening 757 and opening 758 in the front-and-rear direction. The fourth engaging portion 546 is disposed further toward the rear side of the holding member 505 than the third engaging portion 545 in the present embodiment. The third engaging portion 545 and fourth engaging portion 546 are protrusions that protrude downwards from connecting portions connecting the third wall portion 753 and fourth wall portion 754 of the holding member 505. One end side of the coil spring 548 is engaged with the third engaging portion 545 in the longitudinal direction of the coil spring 548, and the other end side of the coil spring 548 is engaged with the fourth engaging portion 546 in the longitudinal direction of the coil spring 548. The third engaging portion 545 and fourth engaging portion 546 are disposed at the spring attaching portion 662 such that the coil spring 548 that is engaged at the third engaging portion 545 and fourth engaging portion 546 traverses the opening 757 and opening 758.

The third engaging portion 545 and fourth engaging portion 546 are disposed at positions that are different from each other in the vertical direction. The third engaging portion 545 is disposed closer to the photosensitive drum 103 side than the fourth engaging portion 546 in the present embodiment. Note that an arrangement may be made where the third engaging portion 545 and fourth engaging portion 546 are provided at positions to be generally the same height in the vertical direction, and the fourth engaging portion 546 may be disposed closer to the photosensitive drum 103 side than the third engaging portion 545.

The protrusion 156 is inserted to the opening 758 of the fourth wall portion 754 from the outer wall face side thereof, passes beneath the coil spring 548 strung between the third engaging portion 545 and fourth engaging portion 546, and is inserted into the opening 757 of the third wall portion 753, as illustrated in FIG. 21D. Although a coil spring has been described as an example of the coil spring 547 and coil spring 548 in the present embodiment, plate springs may be used instead.

Next, the operations of the protrusion 155 provided to the link member 651 on the coil spring 547, and the operations of the protrusion 156 provided to the link member 652 on the coil spring 548, will be described with reference to FIGS. 22A through 22C. The operations of the protrusion 155 on the coil spring 547 and the operations of the protrusion 156 on the coil spring 548 are substantially the same, so the operations of the protrusion 156 on the coil spring 548 will be exemplified in FIGS. 22A through 22C.

Figure 22A:
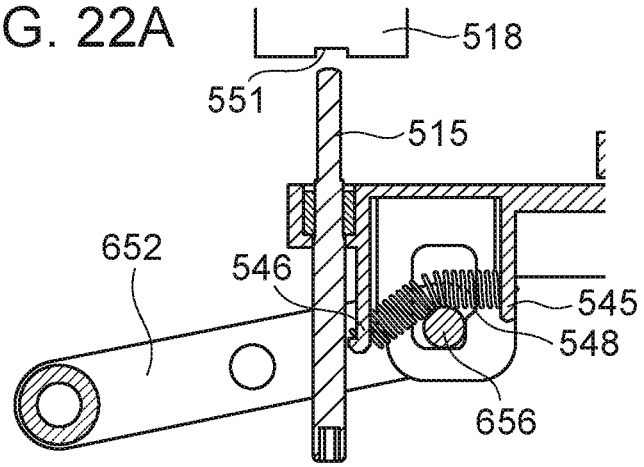
FIGS. 22A through 22C are side views for describing the structure of the other end of the holding member.

FIG. 22A is a diagram illustrating a state where the abutting pin 515 provided to the holding member 505 is retracted from the abutting face 551 of the drum unit 518. FIG. 22B is a diagram illustrating the point of the abutting pin 515 abutting the abutting face 551 of the drum unit 518. FIG. 22C is a diagram illustrating a state where the link member 652 has pivoted in the counter-clockwise direction from the state in FIG. 22B.

Upon the sliding portion 525 moving by sliding in the state in FIG. 22A, the link member 652 pivots in the counter-clockwise direction in conjunction therewith, and the protrusion 156 moves upwards. At this time, the protrusion 156 presses the coil spring 548 upwards. The protrusion 156 pressing the coil spring 548 upwards causes upward force to be applied to the holding member 505 via the third engaging portion 545 and fourth engaging portion 546. The abutting pin 515 is not in contact with the drum unit 518, and there is no force countering the force of the protrusion 156 pressing the coil spring 548, other than the gravity acting on the optical print head 105. Accordingly, when the upward force acting on the third engaging portion 545 and the fourth engaging portion 546 exceeds the gravity acting on the optical print head 105, the holding member 505 moves upwards by the force acting on the third engaging portion 545 and fourth engaging portion 546. Now, an arrangement may be made where, when the holding member 505 is in the retracted position, the lower end of the abutting pin 515 (514) and the holding member 505 are supported by the apparatus main body, and the protrusion 156 (155) of the link member 652 (651) is not in contact with the coil spring 548 (547).

Figure 22B:
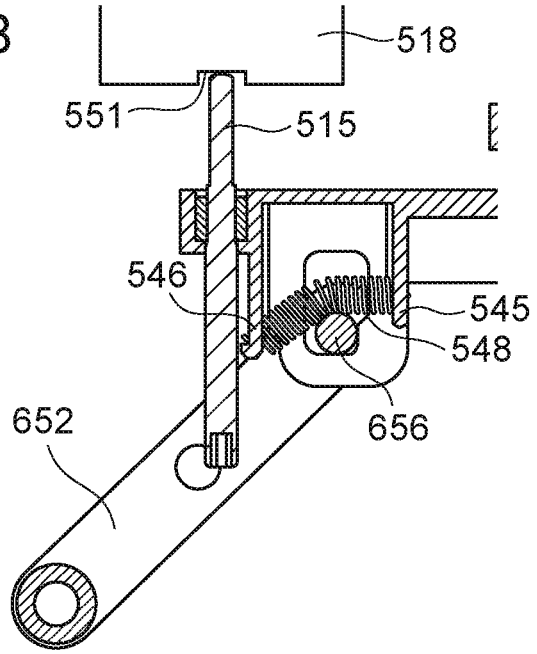

When the holding member 505 moves upwards, the abutting pin 515 abuts the abutting face 551 of the drum unit 518 as illustrated in FIG. 22B. In FIG. 22B, the optical print head 105 is situated at the exposure position, but the biasing force acting to the optical print head 105 to bias the optical print head 105 against the drum unit 518 is insufficient. Accordingly, the movement mechanism 640 according to the present embodiment has a configuration where the link member 652 is capable of further pivoting from the state in FIG. 22B, to apply the biasing force to the optical print head 105.

Further pivoting the link member 652 in the counter-clockwise direction from the state in FIG. 22B does not change the position of the holding member 505, since the abutting pin 515 is already abutting the abutting face 551 of the drum unit 518. On the other hand, the protrusion 156 moves upwards, so the coil spring 548 is pressed by the protrusion 156 passing between the third engaging portion 545 and fourth engaging portion 546, and flexes and stretches as illustrated in FIG. 22C.

Figure 22C:
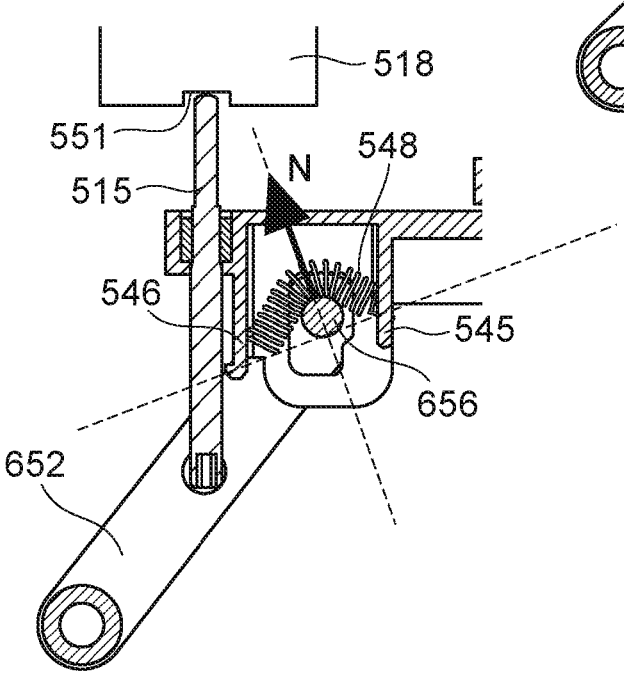

The state in FIG. 22C corresponds to the state of the cover 558 in FIGS. 18C and 18D. That is to say, the sliding portion 525 is in a state where there is no further movement by sliding toward the front side. Accordingly, the link member 652 does not pivot further in the counter-clockwise direction from the state in FIG. 22C, since the sliding portion 525 does not move by sliding, and the protrusion 156 does not move upwards and is stationary at the position in FIG. 22C. The contracting force of the coil spring 548 acts on the third engaging portion 545 and fourth engaging portion 546 in this state. A force component of the contracting force of the coil spring 548 acting on the third engaging portion 545 and fourth engaging portion 546 is directed upwards, so biasing force acts on the holding member 505 to bias the holding member 505 toward the drum unit 518 side, and the holding member 505 is biased against the drum unit 518 via the abutting pin 515.

As described above, the third engaging portion 545 is disposed closer to the photosensitive drum 103 side than the fourth engaging portion 546, so normal force in the direction of the arrow N acts on the coil spring 548 from the protrusion 156. The force component of the normal force in the direction of the arrow N acts on the holding member 505. Accordingly, force toward the rear side in the front-and-rear direction acts on the abutting pin 515, and the abutting pin 515 abutting the abutting face 551 is biased against and abuts the rear-side wall face 596 at the deepest part of the fitting portion 685. The reason why the first engaging portion 543 is disposed closer to the photosensitive drum 103 side than the second engaging portion 544 is also the same. That is to say, the first engaging portion 543, second engaging portion 544, third engaging portion 545, fourth engaging portion 546, spring attaching portion 661, and spring attaching portion 662 are formed on the holding member 505 so that the coil spring 547 and coil spring 548 are generally parallel to each other.

Force Acting on Holding Member at Exposure Position

Figure 23:
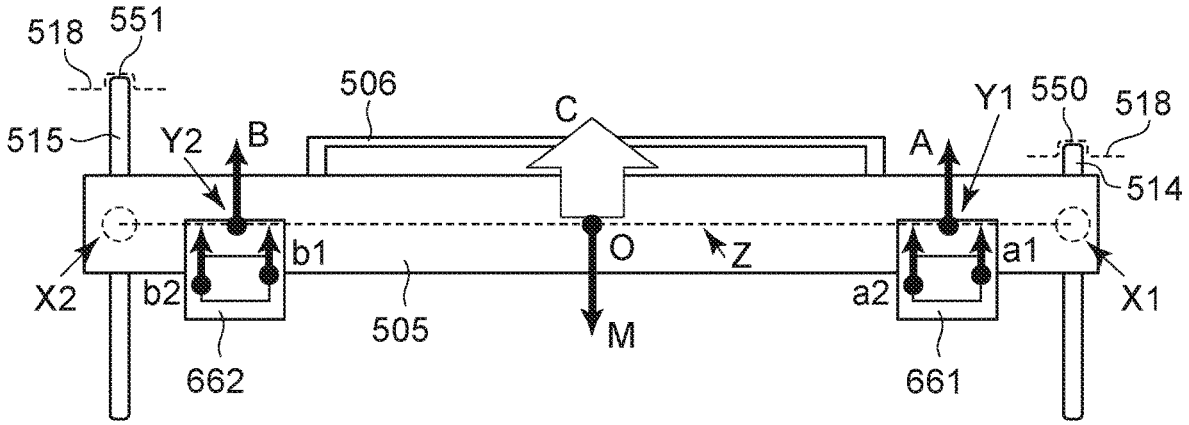
FIG. 23 is a diagram for describing force acting on the holding member situated at an exposure position.

FIG. 23 illustrates a state in which the abutting pin 514 and abutting pin 515 that the holding member 505 has are respectively abutting and being pressed against the abutting face 550 and abutting face 551 formed on the drum unit 518. The arrow a1 in FIG. 23 indicates the direction of force that the protrusion 655 of the link member 651 imparts to the holding member 505 via the first engaging portion 543. The arrow b1 indicates the direction of force that the protrusion 656 of the link member 652 imparts to the holding member 505 via the third engaging portion 545. The arrow a2 in FIG. 23 indicates the direction of force that the protrusion 655 of the link member 651 imparts to the holding member 505 via the second engaging portion 544. The arrow b2 indicates the direction of force that the protrusion 656 of the link member 652 imparts to the holding member 505 via the fourth engaging portion 546. The arrow A indicates the direction of the total force of arrow a1 and arrow a2, pressing the front side (point Y1) of the holding member 505 in the direction from the separated position to the exposure position. The arrow A indicates the direction of the total force of arrow b1 and arrow b2, pressing the rear side (point Y2) of the holding member 505 in the direction from the separated position to the exposure position. Point X1 in FIG. 23 indicates an example of a place where the abutting pin 514 and holding member 505 are connected, and point X2 indicates an example of a place where the abutting pin 515 and holding member 505 are connected.

Description will be made below regarding the effects of the forces indicated by arrow A and arrow B on the holding member 505, in a state where the abutting pin 514 is abutting the abutting face 550 formed on the drum unit 518, and a state where the abutting pin 515 is abutting the abutting face 551 formed on the drum unit 518, with the holding member 505 situated in the exposure position.

First, moment of force generated by the force indicated by the arrow A, in a case where the point X1 serves as a fulcrum, will be described. In this case, when force indicated by the arrow A acts upon the holding member 505, force in the same direction as the arrow A (moment force $\alpha$), which is calculated based on the product of the force indicated by the arrow A and a distance 11 (distance from point X1 to point Y1), acts on a side of the holding member 505 further toward the rear from the point Y1.

Next, moment of force generated by the force indicated by the arrow B, in a case where the point X2 serves as a fulcrum, will be described. In this case, when force indicated by the arrow B acts upon the holding member 505, force in the same direction as the arrow B (moment force $\beta$), which is calculated based on the product of the force indicated by the arrow B and a distance 12 (distance from point X2 to point Y2), acts on a side of the holding member 505 further toward the front from the point Y2.

The force indicated by arrow C in FIG. 23 is the total force of the moment force $\alpha$ and moment force $\beta$. Also, arrow M is force due to the deadweight of the holding member 505 that acts on the resin holding member 505. The force indicated by arrow C that is the total force of the moment force $\alpha$ and moment force $\beta$ acts in the opposite direction as the gravitational direction, thereby suppressing the portion of the holding member 505 between the spring attaching portion 661 and spring attaching position 662 from bowing in the direction of the arrow M due to deadweight. That is to say, the lens array 506 and circuit board 502 can be suppressed from bowing in the gravitational direction, by providing the spring attaching portion 661 to the front side from both the end portion at the front side of the lens array 506 and the front side of the circuit board 502 but to the rear side from the abutting pin 514, and providing the spring attaching position 662 to the rear side from both the end portion at the rear side of the lens array 506 and the rear side of the circuit board 502 but to the front side from the abutting pin 514.

As described above, the magnitude of force indicated by the arrow C comes from the lengths of distance 11 and distance 12, and the magnitude of force indicated by the arrow A and the magnitude of force indicated by the arrow B. That is to say, if the magnitude of force indicated by the arrow A and the magnitude of force indicated by the arrow B are constant, the magnitude of force indicated by the arrow C increases as the distance 11 or distance 12 increases. This indicates that depending on the position where the spring attaching portion 661 and spring attaching position 662 are provided to the holding member 505, the holding member 505 might be bowed beyond what is necessary, in the direction opposite to the gravitational direction. On the other hand, if the magnitude of force indicated by the arrow A and the magnitude of force indicated by the arrow B are constant, the magnitude of force indicated by the arrow C decreases as the distance 11 or distance 12 decreases. This indicates that depending on the position where the spring attaching portion 661 and spring attaching position 662 are provided to the holding member 505, bowing of the holding member 505 due to the force indicated by the arrow M might not be able to be sufficiently suppressed, since the force indicated by the arrow C might not be sufficiently applied to the holding member 505.

In the present embodiment, the distance from the front-side end portion of the lens array 506 to the second engaging portion 544 is 50% of the distance from the front-side end portion of the lens array 506 to the point X1, which is an example of the point where the abutting pin 514 and holding member 505 are connected. Further, the distance from the point X1 serving as an example of the point where the abutting pin 514 and holding member 505 are connected, to the first engaging portion 543, is 20% of the distance from the front-side end portion of the lens array 506 to the point X1 serving as an example of the point where the abutting pin 514 and holding member 505 are connected.

On the other hand, the distance from the rear-side end portion of the lens array 506 to the third engaging portion 545 is 30% of the distance from the rear-side end portion of the lens array 506 to the point X2, which is an example of the point where the abutting pin 515 and holding member 505 are connected. Further, the distance from the point X1 serving as an example of the point where the abutting pin 514 and holding member 505 are connected, to the fourth engaging portion 546, is 20% of the distance from the rear-side end portion of the lens array 506 to the point X2 serving as an example of the point where the abutting pin 515 and holding member 505 are connected.

The dotted line Z in FIG. 23 is a straight line connecting point X1 and point X2 assuming that there is absolutely no warping of the holding member 505, with the middle point between point X1 and point X2 being point O. When neither the abutting pin 514 nor the abutting pin 515 are in contact with the abutting face 550 and abutting face 551, the point O is situated 45 μm to the lower side in the vertical direction than the point O in a case where absolutely no warping of the holding member 505 is assumed. On the other hand, when the abutting pin 514 and abutting pin 515 are both pressed against the abutting face 550 and abutting face 551 under force of 300 grams, the point O is situated 18 μm to the lower side in the vertical direction than the point O in a case where absolutely no warping of the holding member 505 is assumed.

First Modification

Next, a modification regarding the way in which the coil spring 547 and coil spring 548 are attached to a spring attaching portion 361 and spring attaching portion 362 will be described with reference to FIGS. 24A and 24B. Note that members having substantially the same function as those in the movement mechanism 640 are denoted by the same reference numerals in the description, and redundant description may be omitted.

Figure 24A:
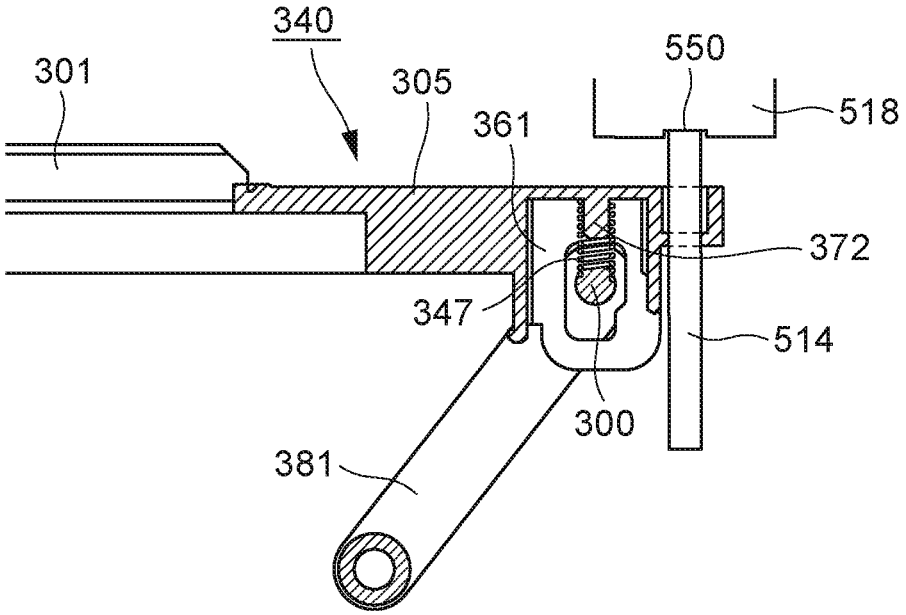
FIGS. 24A and 24B are diagrams for describing a movement mechanism according to a first modification.
Figure 24B:
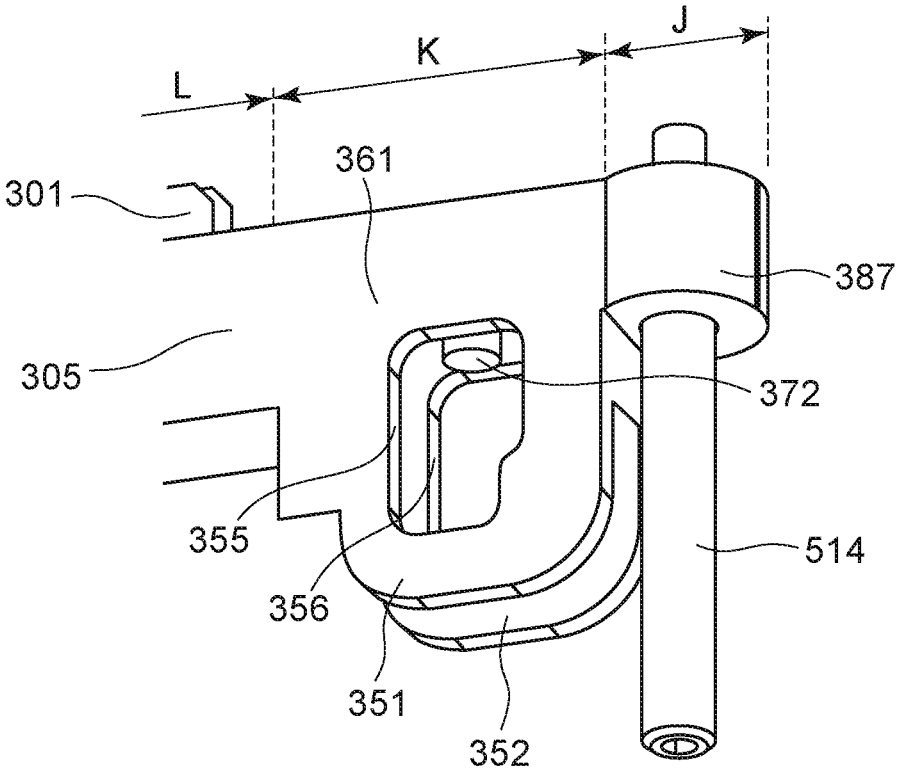

The way in which the coil spring 547 is attached in FIGS. 24*a* and 24B is the same as that described above. A holding member 305 illustrated in FIGS. 24A and 24B includes a lens attaching portion 301 to which the lens array 506 is attached, a spring attaching portion 361 to which a coil spring 347 is attached, and a pin attaching portion 387 to which the abutting pin 514 is attached. Note that FIGS. 24A and 24B only illustrate the front side of the holding member 305. The lens attaching portion 301, spring attaching portion 361, pin attaching portion 387, are an integral molded article formed by injection molding. The spring attaching portion 361 is disposed closer to the one end side of the holding member 305 than the lens attaching portion 301 in the front-and-rear direction, and the pin attaching portion 387 is disposed further toward the end side of the holding member 305 than the spring attaching portion 361.

The spring attaching portion 361 will be described with reference to FIG. 24B. The spring attaching portion 361 has a first wall portion 351, a second wall portion 352, and an engaging portion 372. The places where the lens attaching portion 301, spring attaching portion 361, and pin attaching portion 387 are formed respectively are region L, region K, and region J in FIG. 24B. The first wall portion 351 is disposed at the one end side of the holding member 305 in the left-and-right direction, and the second wall portion 352 is disposed at the other end side of the holding member 305 in the left-and-right direction. The first wall portion 351 and second wall portion 352 are formed on both sides of the abutting pin 514 in the left-and-right direction in the present modification. An opening 355 is formed in the first wall portion 351, and an opening 356 is formed in the second wall portion 352. The opening 355 and the opening 356 are slots extending in the vertical direction. A protrusion 300 is inserted to the opening 355 and opening 356 in that order from the left side of the holding member 305. The protrusion 300 is not fit to the opening 355 and opening 356, and is inserted with a gap of around 0.5 mm even at the narrowest place in the front-and-rear direction. Accordingly, the direction of movement of the protrusion 300 is guided in the vertical direction by the opening 355 and opening 356, without any great frictional force being applied by the inner wall faces of the opening 355 and opening 356. The engaging portion 372 is a cylindrical protrusion erected downwards from above between the first wall portion 351 and second wall portion 352, as illustrated in FIG. 24B. The one end of the coil spring 347 is inserted to the engaging portion 372, upwards from below, as illustrated in FIG. 24A. The other end of the coil spring 347 comes into contact with the protrusion 300. That is to say, the contact portion between the other end side of the coil spring 347 and the protrusion 300 is situated at a lower side than the contact portion between the one end side of the coil spring 347 and the engaging portion 372.

FIG. 24A illustrates a state immediately after the optical print head 105 has moved from the retracted position toward the exposure position and the abutting pin 514 has come into contact with an abutting face 550. The optical print head 105 is situated at the exposure position, but the biasing force acting on the optical print head 105 to bias the optical print head 105 against the drum unit 518 is insufficient. Accordingly, the movement mechanism 340 according to the present modification has a configuration where a link member 381 and link member 383 are capable of further pivoting from the state in FIG. 24A, to apply the above-described biasing force to the optical print head 105.

Further pivoting the link member 381 in the counter-clockwise direction from the state in FIG. 24A does not change the position of the holding member 305, since the abutting pin 514 is already abutting the abutting face 550 of the drum unit 518. On the other hand, the protrusion 300 moves upwards, so the coil spring 547 is compressed between the engaging portion 372 and the protrusion 300.

The state in which the link member 381 has been further pivoted in the counter-clockwise direction from the state in FIG. 24A corresponds to the state of the cover 558 in FIGS. 14C and 14D, and FIGS. 15C and 15D. That is to say, the sliding portion 525 is in a state where there is no further movement by sliding toward the front side. Accordingly, the link member 381 does not pivot further in the counter-clockwise direction since the sliding portion 525 does not move by sliding, and the protrusion 300 does not move upwards and is stationary. The restoring force of the compressed coil spring 347 in this state acts as biasing force on the holding member 305 to bias the holding member 305 toward the drum unit 518 side, and the holding member 305 is biased against the drum unit 518 via the abutting pin 515.

Second Modification

Another modification regarding the way in which a coil spring 447 is attached to a holding member 405 will be described with reference to FIGS. 25A and 25B. A holding member 405 illustrated in FIGS. 25A and 25B includes a lens attaching portion 401 to which the lens array 506 is attached, a spring attaching portion 461 to which the coil spring 447 is attached, a pin attaching portion 487 to which the abutting pin 514 is attached. Note that FIGS. 25A and 25B only illustrate the front side of the holding member 405. The lens attaching portion 401, spring attaching portion 461, and pin attaching portion 487 are an integral molded article formed by injection molding. The spring attaching portion 461 is disposed closer to the one end side of the holding member 405 than the lens attaching portion 401 in the front-and-rear direction, and the pin attaching portion 487 is disposed further toward the end side of the holding member 405 than the spring attaching portion 461.

The spring attaching portion 461 will be described with reference to FIG. 25B. The spring attaching portion 461 has a first wall portion 451, a second wall portion 452, and an engaging portion 472. The places where the lens attaching portion 401, spring attaching portion 461, and pin attaching portion 487 are formed respectively are region O, region N, and region M in FIG. 25B. The first wall portion 451 is disposed at the one end side of the holding member 405 in the left-and-right direction, and the second wall portion 452 is disposed at the other end side of the holding member 405 in the left-and-right direction. The first wall portion 451 and second wall portion 452 are formed on both sides of the abutting pin 514 in the left-and-right direction in the present modification. An opening 455 is formed in the first wall portion 451, and an opening 456 is formed in the second wall portion 452. The opening 455 and the opening 456 are slots extending in the vertical direction. A protrusion 400 is inserted to the opening 455 and opening 456, from the left side of the holding member 405, in that order, as illustrated in FIG. 25B. The protrusion 400 is not fit to the opening 455 and opening 456, and is inserted with a gap of around 0.5 mm even at the narrowest place in the front-and-rear direction. Accordingly, the direction of movement of the protrusion 400 that is an example of a second moving portion is guided in the vertical direction by the opening 455 and opening 456, without any great frictional force being applied by the inner wall faces of the opening 455 and opening 456. The engaging portion 472 is inserted from a hole formed in the first wall portion 451 toward the second wall portion 452, below the opening 455 of the first wall portion 451 and the opening 456 of the second wall portion 452 as illustrated in FIG. 25B, and is fixed to the first wall portion 451. The other end of the coil spring 447 is engaged with the engaging portion 472, between the first wall portion 451 and second wall portion 452, as illustrated in FIG. 25A. The one end side of the coil spring 447 is connected to the protrusion 400 so as to be capable of pivoting. That is to say, the contact portion between the other end side of the coil spring 447 and the protrusion 400 is situated at a higher side than the contact portion between the one end side of the coil spring 447 and the engaging portion 472.

Figure 25A:
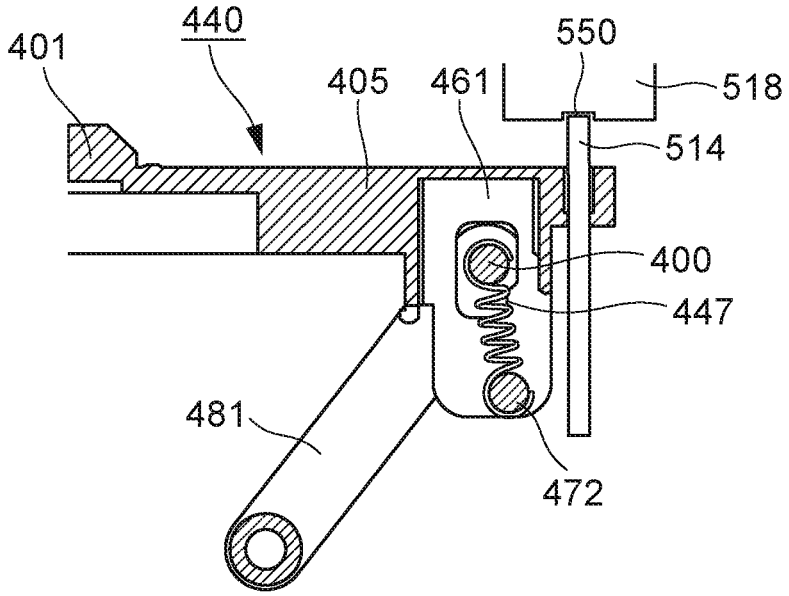
FIGS. 25A and 25B are diagrams for describing a movement mechanism according to a second modification.
Figure 25B:
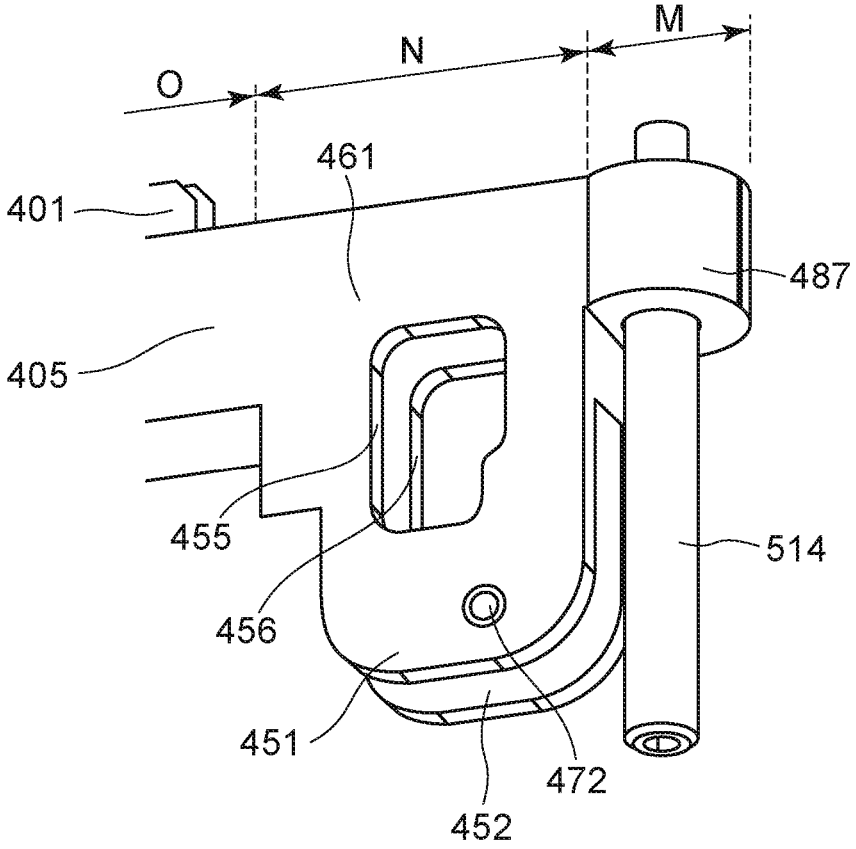

FIG. 25A illustrates a state immediately after the optical print head 105 has moved from the retracted position toward the exposure position and the abutting pin 514 has come into contact with an abutting face 550. The optical print head 105 is situated at the exposure position, but the biasing force acting on the optical print head 105 to bias the optical print head 105 against the drum unit 518 is insufficient. Accordingly, the movement mechanism 440 according to the present modification has a configuration where the link member 481 is capable of further pivoting from the state in FIG. 25A, to apply the above-described biasing force to the optical print head 105.

Further pivoting the link member 481 in the counter-clockwise direction from the state in FIG. 25A does not change the position of the holding member 405, since the abutting pin 514 is already abutting the abutting face 550 of the drum unit 518. On the other hand, the protrusion 400 moves upwards, so the coil spring 447 is stretched by the engaging portion 472 and the protrusion 400.

The state in which the link member 481 has been further pivoted in the counter-clockwise direction from the state in FIG. 25A corresponds to the state of the cover 558 in FIGS. 17C and 17D, and FIGS. 18C and 18D. That is to say, the sliding portion 525 is in a state where there is no further movement by sliding toward the front side. Accordingly, the link member 481 does not pivot further in the counter-clockwise direction since the sliding portion 525 does not move by sliding, and the protrusion 400 does not move upwards and is stationary. The restoring force of the stretched coil spring 447 in this state acts as biasing force on the holding member 405 to bias the holding member 405 toward the drum unit 518 side, and the holding member 405 is biased against the drum unit 518 via the abutting pin 514. Note that a structure may be made where the coil spring 447 is directly stretched by the upper end portion of the link member 481 rather than the protrusion 400, i.e., the first moving portion may be the upper end portion of the link member 481.

As described above, in the image forming apparatus 1 according to the above-described embodiment and modifications, the lens array 506 and circuit board 502 can be suppressed from bowing in the gravitational direction when the abutting pin 514 and abutting pin 515 abut and are pressed against the abutting face 550 and abutting face 551, by providing the spring attaching portion 661 to the front side from both the front side of the lens array 506 and the front side of the circuit board 502 but to the rear side from the abutting pin 514, and providing the spring attaching position 662 to the rear side from both the rear side of the lens array 506 and the rear side of the circuit board 502 but to the front side from the abutting pin 514.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-118999 filed Jun. 16, 2017, which is hereby incorporated by reference herein in its entirety.

What is claimed is:

1. An image forming apparatus comprising:

a drum unit having a photosensitive drum;

a holding member configured to hold a circuit board having a plurality of light-emitting elements configured to emit light to expose the photosensitive drum, and a lens configured to condense light entering the lens on to a surface of the photosensitive drum, and configured to move between an exposure position where the photosensitive drum is exposed from below in a vertical direction and a retracted position further retracted from the photosensitive drum than the exposure position;

a first protruding portion protrudes from the holding member toward the drum unit, the first protruding portion disposed in the holding member on an upstream side of the circuit board and the lens in a direction from one side of the holding member in a longitudinal direction of the holding member toward another side of the holding member in the longitudinal direction;

a second protruding portion protrudes from the holding member toward the drum unit, the second protruding portion disposed in the holding member on a downstream side of the circuit board and the lens in the direction from the one side toward the another side;

a first pivotably supporting member configured to support the holding member in a direction opposite to a gravitational direction between the first protruding portion and both of the circuit board and the lens in the longitudinal direction; and a second pivotably supporting member configured to support the holding member in a direction opposite to the gravitational direction between the second protruding portion and both of the circuit board and the lens in the longitudinal direction, wherein the first pivotably supporting member and the second pivotably supporting member are pivoting, and configured to move the holding member between the exposure position and the retracted position, wherein force in the direction opposite to the gravitational direction is applied to a portion between the first pivotably supporting member and the second pivotably supporting member, regarding the holding member that has been moved from the retracted position toward the exposure position by the first pivotably supporting member and the second pivotably supporting member, with the first protruding portion and second protruding portion abutting the drum unit.

2. The image forming apparatus according to claim 1, wherein the holding member is a resin molded article.

3. The image forming apparatus according to claim 1, further comprising:

a sliding portion configured to move by sliding in the longitudinal direction, wherein one side of the first pivotably supporting member in a longitudinal direction of the first pivotably supporting member is pivotably attached to the one side of the holding member in the longitudinal direction of the holding member, and another side of the first pivotably supporting member in the longitudinal direction of the first pivotably supporting member is pivotably attached to one side of the sliding portion in a longitudinal direction of the sliding portion, wherein one side of the second pivotably supporting member in a longitudinal direction of the second pivotably supporting member is pivotably attached the another side of the holding member in the longitudinal direction of the holding member, and the another side of the second pivotably supporting member in a longitudinal direction of the second pivotably supporting member is pivotably attached to the another side of the sliding portion in the longitudinal direction of the sliding portion, and wherein the first pivotably supporting member and the second pivotably supporting member pivot relative to the sliding portion in conjunction with a sliding movement of the sliding portion.

4. The image forming apparatus according to claim 3 wherein, the holding member has a first spring and a second spring to be deformed to apply biasing force to bias the holding member in the direction opposite to the gravitational direction to the holding member, wherein the first spring is disposed between the first protruding portion and both of the circuit board and the lens in the longitudinal direction, wherein the second spring is disposed between the second protruding portion and both of the circuit board and the lens in the longitudinal direction, wherein the one side of the first pivotably supporting member comes into contact with the first spring and the one side of the first pivotably supporting member deforms the first spring in conjunction with pivoting of the first pivotably supporting member.

5. The image forming apparatus according to claim 4, further comprising:

a third pivotably supporting member that is pivotably connected between the one side of the first pivotably supporting member and the another side of the first pivotably supporting member, and that is configured to be pivotably connected to a portion fixed to the main body of the image forming apparatus, to assist pivoting of the first pivotably supporting member and pivoting of the second pivotably supporting member.

6. The image forming apparatus according to claim 4, further comprising:

a first moving portion that is formed at one side of the first pivotably supporting member, and that is configured to deform the first spring in conjunction with pivoting of the first pivotably supporting member; and a second moving portion that is formed at one side of the second pivotably supporting member, and that is configured to deform the second spring in conjunction with pivoting of the second pivotably supporting member, wherein the first moving portion and the second moving portion move toward the drum unit in conjunction with sliding movement of the sliding portion, and biasing force is imparted to the holding member by deformation of the first spring and the second spring.

7. The image forming apparatus according to claim 6, wherein the first pivotably supporting member is connected to the sliding portion and the holding member with the first moving portion being situated at the downstream side of a connection portion of the first pivotably supporting member and the sliding portion, in the direction of sliding movement of the sliding portion, and the second pivotably supporting member is connected to the sliding portion and the holding member with the second moving portion being situated at the downstream side of the connection portion of the second pivotably supporting member and the sliding portion, in the direction of sliding movement of the sliding portion.

8. The image forming apparatus according to claim 7, wherein the first pivotably supporting member is connected to the sliding portion and the holding member with the first moving portion being situated closer to the drum unit than the connection portion of the first pivotably supporting member and the sliding portion, in directions of movement of the holding member, and the second pivotably supporting member is connected to the sliding portion and the holding member with the second moving portion being situated closer to the drum unit than the connection portion of the second pivotably supporting member and the sliding portion, in directions of movement of the holding member.

9. The image forming apparatus according to claim 6, further comprising:

a pair of first attaching portions that is formed on one side of the holding member, and that is configured to be attached with one side and another side of the first spring in a longitudinal direction of the first spring; and a pair of second attaching portions that is formed the another side of the holding member, and that is configured to be attached with one side and another side of the second spring in a longitudinal direction of the second spring, wherein the first pivotably supporting member is pivotably connected to the sliding portion and the holding member, with the first moving portion abutting the first spring attached to the pair of first attaching portions between the one side of the first spring and another side of the first spring, from a side opposite to the side at which the photosensitive drum is disposed, wherein the second pivotably supporting member is pivotably connected to the sliding portion and the holding member, with the second moving portion abutting the second spring attached to the pair of second attaching portions between the one side of the second spring and the another side of the second spring in the longitudinal direction of the second spring, from a side opposite to the side at which the photosensitive drum is disposed, and wherein the sliding portion is moved by sliding in a state where the holding member is in contact with the drum unit, the first moving portion that moves toward the drum unit in conjunction with the sliding movement of the sliding portion stretches the first spring, the second moving portion that moves toward the drum unit in conjunction with the sliding movement of the sliding portion stretches the second spring, and the restoring forces of the stretched first spring and second spring act on the holding member, thereby imparting biasing force to the holding member.

10. The image forming apparatus according to claim 9, wherein the first spring and the second spring are coil-shaped springs.

11. The image forming apparatus according to claim 6, wherein the first moving portion formed at the one side of the first pivotably supporting member is a protrusion protruding in a pivoting axis direction of the first pivotably supporting member that pivots as to the holding member, and wherein the second moving portion formed at one side of the second pivotably supporting member is a protrusion protruding in a pivoting axis direction of the second pivotably supporting member that pivots as to the holding member.

* * * * *